US010323567B2

(12) United States Patent
Han

(10) Patent No.: US 10,323,567 B2
(45) Date of Patent: Jun. 18, 2019

(54) AIR CHARGING APPARATUS DRIVEN BY ROTATING MAGNETIC FIELD

(71) Applicant: Seungjoo Han, Busan (KR)

(72) Inventor: Seungjoo Han, Busan (KR)

( * ) Notice: Subject to any disclaimer, the term of this patent is extended or adjusted under 35 U.S.C. 154(b) by 723 days.

(21) Appl. No.: 14/765,836

(22) PCT Filed: Feb. 6, 2014

(86) PCT No.: PCT/KR2014/000999

§ 371 (c)(1),
(2) Date: Aug. 5, 2015

(87) PCT Pub. No.: WO2014/123361

PCT Pub. Date: Aug. 14, 2014

(65) Prior Publication Data

US 2015/0361870 A1 Dec. 17, 2015

(30) Foreign Application Priority Data

Feb. 6, 2013 (KR) ..... 10-2013-0013193

(51) Int. Cl.

| | |
|---|---|
| ***F02B 33/40*** | (2006.01) |
| ***F04D 29/42*** | (2006.01) |
| ***F04D 29/28*** | (2006.01) |
| ***F04D 29/70*** | (2006.01) |

(Continued)

(52) U.S. Cl.

CPC ..... *F02B 33/40* (2013.01); *F04D 17/10* (2013.01); *F04D 25/06* (2013.01);

(Continued)

(58) Field of Classification Search

CPC ..... F04D 17/10; F04D 25/06; F04D 25/0653; F04D 29/284; F04D 29/4206;

(Continued)

(56) References Cited

U.S. PATENT DOCUMENTS 4,253,031 A * 2/1981 Frister ..... F01D 15/10 290/52
4,485,310 A * 11/1984 de Valroger ..... F01D 15/10 123/565

(Continued)

FOREIGN PATENT DOCUMENTS

JP 07-158463 A 6/1995
JP 2008-045410 A 2/2008

(Continued)

*Primary Examiner* — Dominick L Plakkoottam
(74) *Attorney, Agent, or Firm* — Patent Office of Dr. Chung Park

(57) ABSTRACT

Provided is an air charging apparatus driven by a rotating magnetic field and compressing or pressurizing and transferring air. The air charging apparatus includes at least one impeller sucking air and giving kinetic energy to intake air; an impeller case leading external air inhaled by the impeller into the impeller and converting velocity energy of air out of the impeller into air having pressure energy to discharge air; and a rotating body accelerator equipped with the impeller and the impeller case and driving the impeller. Here, the rotating body accelerator drives the impeller by generating a torque by interaction with an intake negative pressure, by generating a torque by interaction with the intake negative pressure and using supplied power, or by generating a torque using supplied power.

7 Claims, 26 Drawing Sheets

(51) Int. Cl.

| | |
|---|---|
| ***F04D 17/10*** | (2006.01) |
| ***F04D 25/06*** | (2006.01) |
| *F02B 39/10* | (2006.01) |
| *F02B 37/10* | (2006.01) |

(52) U.S. Cl.
CPC ..... *F04D 25/0653* (2013.01); *F04D 29/284* (2013.01); *F04D 29/4206* (2013.01); *F04D 29/701* (2013.01); *F02B 37/10* (2013.01); *F02B 39/10* (2013.01); *F05D 2220/40* (2013.01)

(58) Field of Classification Search
CPC .. F04D 29/701; F04D 29/056; F05D 2220/40; Y02T 10/144; F02C 6/12; H02K 7/1823; Y10S 416/04
See application file for complete search history.

(56) References Cited

U.S. PATENT DOCUMENTS

2010/0275890 A1* 11/2010 McDonald-Walker ..... B60K 6/24 123/564
2013/0294928 A1* 11/2013 Rosinski ..... F04D 13/06 417/5
2014/0159378 A1* 6/2014 Wright ..... F01C 1/22 290/1 A

FOREIGN PATENT DOCUMENTS

KR 10-2008-0068257 A 7/2008
KR 10-2009-0078016 A 7/2009

* cited by examiner

AIR CHARGING APPARATUS DRIVEN BY ROTATING MAGNETIC FIELD

CROSS-REFERENCE TO PRIOR APPLICATIONS

This application is a national Stage Patent Application of PCT International Patent Application No. PCT/KR2014/000999, filed on Feb. 6, 2014 under 35 U.S.C. § 371, which claims priority of Korean Patent Application No. 10-2013-0013193, filed on Feb. 6, 2013, which are all hereby incorporated by reference in their entirety.

BACKGROUND OF THE INVENTION

The present invention disclosed herein relates to an air charging apparatus driven by a rotating magnetic field, which increases the volumetric efficiency of an internal combustion engine and compressing and pressurizing air in order to supply compressed or pressurized air to a fuel cell vehicle.

Various driving types of air supply devices are being used to increase the volumetric efficiency of an internal combustion engine and thus improve the output of the internal combustion engine and the acceleration performance of a vehicle.

Compared to a supercharging vehicle including a supercharging device which compresses and transfers intake air using power of the internal combustion engine, a motor cycle and a natural aspirated vehicle mounted with an natural aspiration internal combustion engine which inhales air using an intake negative pressure and a pressure difference of the atmospheric pressure are low in load failure rate of the internal combustion engine, emit steady output even at high RPM, and are good in instant reaction. However, since air volume flow inhaled into a combustion chamber in intake stroke is not sufficient due to air intake resistance compared to actual displacement volume, there is a limitation in increasing the output. In order to overcome this limitation, a natural aspirated vehicle and a motor cycle to which an inertia pressurization supercharging air supply type of a ram charging system using vehicle speed is applied is being used. However, even in this case, the air density of head wind increases only at high-speed driving and thus the volumetric efficiency increases.

Also, as representative supercharging devices applied to the supercharging vehicles, there are a turbocharger using exhaust gas energy of the internal combustion engine and a supercharger using a crankshaft torque of the internal combustion engine.

The turbocharger is mounted onto the outlet side of an exhaust manifold of the internal combustion engine to use exhaust gas energy increasing in accordance with the load of the internal combustion engine and thus drive a turbine wheel, and a compressor wheel directly connected to the turbine wheel compresses intake air to increase the air density and supply air to an inlet pipe of the internal combustion engine. Thus, the volumetric efficiency increases, and the output of the internal combustion engine is improved. On the other hand, the supercharger operates the compressor using a torque of the crankshaft, and the compressor compresses intake air to increase the air density and supply air into the inlet pipe of the internal combustion engine. Thus, the volumetric efficiency increases, and the output of the internal combustion engine is improved.

However, the supercharging vehicle equipped with the turbocharger acquires sufficient super pressure in a high-speed driving region, but cannot obtain desired boost due to efficiency reduction caused by low exhaust gas energy in a low-speed driving region. Accordingly, a response time delay of a vehicle occurs upon load variation in the low-speed driving region and transient section. Also, since the supercharging vehicle equipped with the supercharger operates the compressor in proportion to RPM of the crankshaft, the response characteristics of a vehicle is good upon load variation of the internal combustion engine, but the driving loss of the internal combustion engine increases in accordance with an increase of RPM of the crankshaft.

As described above, the supercharging vehicles equipped with the turbocharger and the supercharger have opposite advantages and disadvantages to each other in the low-speed and high-speed driving regions. In order to overcome these limitations, a variable turbocharger, a two-stage turbocharger system, a twincharger, an integral electric assisting turbocharger system, and a complex sequential supercharging system are being variously applied to obtain necessary super pressure in the whole driving region of a vehicle and thus increase the volumetric efficiency. In the variable turbocharger, a vane nozzle is installed at the side of turbine. The vane angle of the nozzle is reduced to increase the flow velocity in a low-speed driving region in which the exhaust gas flow rate is deficient, and the vane angle is opened to increase the flow rate of the exhaust gas in a high-speed driving region. In the two-stage turbocharger system, large-capacity and small-capacity turbocharger are connected in series to optimize the performance in accordance with the operation of the internal combustion engine. In the twincharger, the turbocharger and the supercharger operate at the same time in a low-speed driving region, and only the turbocharger operates in a high-speed driving region. In the integral electric assisting turbocharger system, a motor is installed in a central housing part of an existing turbocharger. Also, in the complex sequential supercharging system, a motor compressor and a large-capacity turbocharger are combined. However, in these complex supercharging devices, the increase of the number of parts, the complication of the structure, the addition of a control system cause the increase of cost.

Also, in case of an internal combustion engine ignited at an air-fuel ratio like gasoline fuel, when a supercharging device is applied, due to supercharged air increase in temperature, knocking easily occurs from the compression ratio of the internal combustion engine. Accordingly, the super pressure is difficult to increase to a certain level. On the other hand, when the super pressure is supplied at a low level, it is difficult to expect the increase of the output, and when the compression ratio of the internal combustion engine is lowered and the super pressure is increased, a high output can be obtained in the whole load, but the fuel efficiency is reduced in a partial load. Accordingly, great care is needed for application according to the purpose of the supercharger. The gasoline internal combustion engine equipped with the supercharger includes a knocking sensor, a knocking protecting device such as a device for injecting water mixed with ethanol, and a large-capacity intercooler to lower the supercharging temperature and thus deal with knocking.

Also, in the supercharging internal combustion engine equipped with the turbocharger and the supercharger, fuel is additionally consumed to drive the supercharger and generate compressed air in addition to fuel consumption necessary for improvement of volumetric efficiency.

Also, since the turbocharger is mounted on the side of the outlet of the exhaust manifold and the supercharger needs to be aligned with a belt connected to the crankshaft supplying the power, the location and the direction of the mounting space are restricted, complicating the arrangement of parts of the internal combustion engine.

The turbocharger is equipped with an oil supply device for protecting bearing supporting the turbine wheel rotating at a high speed from exhaust heat, and a driving power of an oil pump is additionally needed to increase the oil pressure of the internal combustion engine.

Also, a vehicle driven by the power of the internal combustion engine needs to satisfy the CO2 emission according to the emission regulation for the global warming. As the downsizing of the internal combustion engine and the increase of the specific power are needed in accordance with the high oil price, the supercharger needs to produce and supply supercharged air having high super pressure. Thus, durability and cooling performance corresponding to the increasing supercharging temperature need to be complemented, while the temperature of the supercharged air needs to be lowered.

In the supercharging vehicle, the superchargers are developed into high supercharging types that generate high super pressure using power of the internal combustion engine while having advantages and disadvantages. The internal combustion engines of the supercharging vehicles have a structure absorbing a supercharger driving load and a cooling device. Since the superchargers receive power of the internal combustion engine to perform necessary operations by controllers of components, air volume flow could not be controlled and supplied corresponding to the characteristics of the internal combustion engine and the vehicle.

Accordingly, air volume flow corresponding to the characteristics of the internal combustion engine and the vehicle having durability to supercharging needs to be supplied to increase the volumetric efficiency. In a low-speed driving region and transient section, the torque needs to be increased to shorten the spool-up time and thus improve the response characteristic of a vehicle. In order to increase a deficient super pressure supplied by an existing supercharger in a low-speed region, the fuel consumption needs to be reduced. Also, the load of the internal combustion engine operated in order to maintain the super pressure in a high-speed driving region needs to be reduced. Thus, an air supply device corresponding to the internal combustion engine having high specific power according to the carbon emission regulation and the downsizing trend of a vehicle is needed. Without giving a load to a vehicle and an internal combustion engine, the temperature of supplied air is low and the air density is relatively high compared to an existing supercharger. In such air supply device, the driving loss and driving noise are lower, and the durability is better. Also, the air supply device uses low power or does not need the driving cost, and can be easily installed without limitations of a specific location and a mounting direction.

Also, in the natural aspirated vehicle and motor cycle, since air is not charged corresponding to actual displacement volume due to the air intake resistance, there is a limitation in increasing the output. Accordingly, in order to increase the volumetric efficiency, an inertial pressurization supercharging air supply type of ram charging system using the vehicle speed may be applied.

However, the inertia pressurization supercharging air supply type can achieve an effect of increasing the volumetric efficiency because the air density of head wind increases only at high-speed driving.

Accordingly, there is a need for an air supply device which supplies air volume flow corresponding to the characteristics of the natural aspiration internal combustion engine, the natural aspirated vehicle, and the motor cycle within an error correction range of the driving system and the control system while maintaining the advantages of the natural aspirated vehicle and the motor cycle, increases the volumetric efficiency, deals with the carbon emission regulation by reducing the fuel consumption of the internal combustion engine, and improves the acceleration force in the transient section. Thus, without giving a load to the vehicle and the internal combustion engine, the driving loss and driving noise are lower, and the durability is better. Also, the air supply device uses low power or does not need the driving cost, and can be easily installed without limitations of a specific location and a mounting direction.

Also, in a fuel cell vehicle, an air supply system of a fuel cell driving device is using an air blower or an electric air compressor for supplying air that is an oxidant to a fuel cell.

However, since the electric air compressor uses power produced in the fuel cell or battery charged power, the capacity and the volume of the fuel cell and the battery become larger, inevitably affecting the travelling distance of a vehicle.

Accordingly, in order to overcome the above limitation, an air supply device that supplies air volume flow corresponding to the characteristics of the fuel cell to the fuel cell driving device of the fuel cell vehicle is needed. Thus, without giving a load to the vehicle, the driving loss and the driving noise become lower, and the durability becomes better. Also, the air supply device is operated by lower power than the electric air compressor.

SUMMARY OF THE INVENTION

The present invention provides an air charging apparatus. Here, air volume flow corresponding to the characteristics of the internal combustion engine and the vehicle having durability to supercharging is supplied to increase the volumetric efficiency of the internal combustion engine by being mounted between an air filter and an inlet pipe of the internal combustion engine to compressing or pressurizing air and thus increase the air density and flow rate. In a low-speed driving region and transient section, the torque is increased to shorten the spool-up time and thus improve the response characteristic of a vehicle. In order to increase a deficient super pressure supplied by an existing supercharger in a low-speed region, the fuel consumption of the internal combustion engine is reduced. Also, the load of the internal combustion engine operated in order to maintain the super pressure at a high level in a high-speed driving region is reduced. Thus, the air supply device corresponding to the internal combustion engine having high specific power according to the carbon emission regulation and the downsizing trend of a vehicle is achieved. Without giving a load to a vehicle and an internal combustion engine, the temperature of supplied air becomes lower and the air density becomes relatively higher compared to an existing supercharger. In such air supply device, the driving loss and driving noise become lower, and the durability becomes better. Also, the air supply device uses low power or does not need the driving cost, and can be easily installed without limitations of a specific location and a mounting direction.

The present invention also provides an air charging apparatus, which increases the volumetric efficiency by compressing or pressurizing air to increase the air density and flow rate and thus supplying air volume flow corresponding to the characteristics of an internal combustion engine and a vehicle, improves the response characteristics of a vehicle by increasing a torque in a low-speed driving region and a transient section and thus shortening the spool-up time, and additionally improves the volumetric efficiency by increasing the driving force in accordance with an instruction of a vehicle in a specific driving region and thus supplying compressed air having a high pressure ratio or pressurized air having a high pressurization ratio and increased air volume flow.

The present invention also provides an air charging apparatus, which increases the volumetric efficiency by compressing or pressurizing air to increase the air density and flow rate and thus supplying air volume flow corresponding to the characteristics of an internal combustion engine and a vehicle, improves the response characteristics of a vehicle by increasing a torque in a low-speed driving region and a transient section and thus shortening the spool-up time, and simultaneously produces power to charge a storage battery of a vehicle or a separate storage battery.

The present invention also provides an air charging apparatus, which increases the volumetric efficiency by being mounted in an air filter case and compressing or pressurizing air to increase the air density and flow rate and thus supplying air volume flow corresponding to the characteristics of an internal combustion engine and a vehicle, improves the response characteristics of a vehicle by increasing a torque in a low-speed driving region and a transient section and thus shortening the spool-up time, cools generated heat with external air flowing therein, absorbs noise to reduce driving sound, reduces the mounting space to facilitate the mounting in a vehicle, and particularly, secures the mounting space with respect to an existing vehicle in which the arrangement of parts of the internal combustion engine mounting chamber is determined.

The present invention also provides an air charging apparatus in a natural aspirated vehicle and a motor cycle, which supplies air volume flow corresponding to the characteristics of the natural aspirated vehicle and the motor cycle by compressing air or pressurizing air and thus increasing the air density and flow rate within an error correction range of the driving system and the control system while maintaining the advantages of the natural aspirated vehicle and the motor cycle, increases the volumetric efficiency, deals with the carbon emission regulation by reducing the fuel consumption of the internal combustion engine, and improves the acceleration force in the transient section. Thus, without giving a load to the vehicle and the internal combustion engine, the driving loss and driving noise are lower, and the durability is better. Also, the air supply device uses low power or does not need the driving cost, and can be easily installed without limitations of a specific location and a mounting direction.

The present invention also provides an air charging apparatus, which supplies air volume flow necessary for a fuel cell of a fuel cell driving device by receiving power in a fuel cell vehicle and compressing air in accordance with the instruction of a vehicle, and is better in driving loss, driving noise, and durability. Also, the air charging apparatus is operated at lower power compared to an electric air compressor.

Embodiments of the present invention provide air charging apparatuses driven by a rotating magnetic field and compressing or pressurizing and transferring air, the apparatus including: at least one impeller sucking air and giving kinetic energy to intake air; an impeller case leading external air inhaled by the impeller into the impeller and converting velocity energy of air out of the impeller into air having pressure energy to discharge air; and a rotating body accelerator equipped with the impeller and the impeller case and driving the impeller, wherein the rotating body accelerator drives the impeller by generating a torque by interaction with an intake negative pressure, by generating a torque by interaction with the intake negative pressure and using supplied power, or by generating a torque using supplied power.

The rotating body accelerator may be equipped with a complex rotating body in a frame. The magnetic flux of the complex rotating body may be disposed in the axial direction of the frame. The complex rotating body may be fixed by a fixture such as a snap ring or a lock nut. Also, a front driver and a rear driver and a rear driver of the fixing support may be disposed in a circumferential direction around the complex rotating body at a certain interval in the axial direction of the complex rotating body and the frame such that the direction of the magnetic flux is disposed in the axial diameter direction of the frame.

Specifically, the rotating body accelerator may include the complex rotating body, the magnetic flux of which is disposed toward the axial direction of the frame, the front driver, the rear driver and the rear driver of the fixing support disposed in a circumferential direction around the complex rotating body at a certain interval in the axial direction of the complex rotating body and the frame such that the direction of the magnetic flux faces the axial diameter direction of the frame, the frame equipped with the drivers and supporting the rotation of the complex rotating body, and the fixture for fixing the complex rotating body to the frame.

In this configuration, the frame may have permanent magnet holes formed in the circumferential axial direction around the complex rotating body at a uniform interval in alignment with a front reference point and a rear reference point on the front surface and the rear surface based on the axis of the circular-shaped body. Also, the frame may have a mounting space of the complex rotating body inside the inner circumferential surface thereof and a bearing cooling space of a concentric shape formed in the front direction on the circumferential axial of the rear surface thereof. Also, the frame may have a protrusion formed on the outer circumferential surface of the body such that a mounting surface of the impeller case, fixing seating surfaces, bolt holes for fixing the rear driver of the fixing support, and installation supports are provided. Also, the bearing cooling space and the mounting space of the complex rotating body may be formed such that any one of a grease lubrication type bearing, an oil lubrication type bearing, an air cooling type bearing and a magnetic bearing can be mounted therein.

Specifically, the frame may have 2n (n is an integer equal to or greater than 4) permanent magnet holes formed in the circumferential axial direction around the complex rotating body at a uniform interval in alignment with a front reference point and a rear reference point on the front surface and the rear surface based on the axis of the circular-shaped body. Also, the frame may have a mounting space of the complex rotating body inside the inner circumferential surface thereof and a bearing cooling space of a concentric shape formed in the front direction on the circumferential axial of the rear surface thereof, such that any one of a grease lubrication type bearing, an oil lubrication type bearing, an air cooling type bearing and a magnetic bearing can be mounted therein. Also, the frame may have a protrusion formed on the outer circumferential surface of the body such that a mounting surface of the impeller case, fixing seating surfaces, bolt holes for fixing the rear driver of the fixing support, and installation supports are provided.

In the complex rotating body, the bearing module may be mounted in the bearing mounting space of the frame, and may be fixed with the fixture such as the snap ring or the lock nut. The impeller and a front rotator, the direction of the magnetic flux of which is disposed toward the axial direction of the frame, may be together mounted in the bearing module at the front side of the frame, and may be fixed with a lock nut to be disposed in an orthogonal direction to the front driver at a certain gap. Also, a rear rotator, the direction of the magnetic flux of which is disposed toward the axial direction of the frame, may be mounted in the bearing module at the rear side of the frame, and may be fixed with the lock nut to be disposed in an orthogonal direction to the rear driver and the rear driver of the fixing support at a certain gap.

Specifically, the complex rotating body may include the front rotator disposed in an orthogonal direction at a certain gap in the axial direction of the front driver and the frame and thus the direction of the magnetic flux is disposed toward the axial direction of the frame, the rear rotator disposed in an orthogonal direction at a certain gap in the axial direction of the rear driver, the rear driver of the fixing support and the frame and thus the direction of the magnetic flux is disposed toward the axial direction of the frame, the bearing module supporting the rotation of the impeller, the front rotator, and the rear rotator, and the lock nuts for fixing the front rotator, the rear rotator, and the bearing module.

In this configuration, the bearing module may have a bearing mounting surface, a bearing fixing step, a key groove for fixing the status of the front rotator and the rear rotator on the outer circumferential surface of the body of a round rod shape. The bearing module may be mounted with a bearing for supporting the rotation of a rotational shaft having a screw thread on which the lock nut is mounted at both ends thereof, and keys for the status may be mounted in the key groove.

Also, the bearing module may include any one bearing of a grease lubrication type bearing, an oil lubrication type bearing, an air cooling type bearing and a magnetic bearing, which does not exceed the tolerance limit ensuring the durability life in accordance with the maximum RPM of the complex rotating body.

Specifically, the bearing module may include the rotational shaft having the bearing mounting surface, the bearing fixing step, and the key groove formed on the outer circumferential surface of the body of a round bar shape and having the screw thread at both ends thereof, the bearing including any one of a grease lubrication type bearing, an oil lubrication type bearing, an air cooling type bearing and a magnetic bearing, and keys for fixing the status.

The front rotator may include a cylindrical protrusion protruding from the center of the body having a disc shape in a backward direction. The cylindrical protrusion may have a key groove formed in the inner circumferential surface thereof and fixing the status. Permanent magnet holes may be formed in the rear surface of the body in alignment with the key groove and may be formed at a uniform interval on the axial line of the circumference. Permanent magnets may be buried in the permanent magnet holes of a front rotational plate on which a mounting surface of the impeller and blades are radially formed at a uniform interval such that N-pole and S-pole are alternately disposed in alignment with the key groove.

Specifically, the front rotator may include the front rotational plate having the cylindrical protrusion protruding from the center of the body having a disc shape in a backward direction, having the key groove formed in the inner circumferential surface thereof and fixing the status, having 2n (hereinafter, n is an integer equal to or greater than 2) permanent magnet holes formed in the rear surface of the body in alignment with the key groove and formed at a uniform interval on the axial line of the circumference, and having a shape in which the permanent magnets are buried in the permanent magnet holes of the front rotational plate on which the mounting surface of the impeller and the blades are radially formed at a uniform interval, and 2n permanent magnets disposed such that N-pole and S-pole are alternately buried in the permanent magnet holes of the front rotational plate in alignment with the key groove and the magnetic flux is disposed toward the axial direction of the frame.

The rear rotator may include a cylindrical protrusion protruding from the center of the body having a disc shape in forward and backward directions. The cylindrical protrusion may have a key groove formed in the inner circumferential surface thereof. Permanent magnet holes may be formed in alignment with the key groove and may be formed at a uniform interval on the axial line of the circumference of the body. Permanent magnets may be buried in the permanent magnet holes of a rear rotational plate such that N-pole and S-pole are alternately disposed in alignment with the key groove.

Specifically, the rear rotator may include the rear rotational plate having the cylindrical protrusion protruding from the center of the body having a disc shape in forward and backward directions, having the key groove formed in the inner circumferential surface thereof and fixing the status, and having 2n (hereinafter, n is an integer equal to or greater than 2) permanent magnet holes formed in alignment with the key groove and formed at a uniform interval on the axial line of the circumference of the body, and 2n permanent magnets disposed such that N-pole and S-pole are alternately buried in the permanent magnet holes of the rear rotational plate in alignment with the key groove and the magnetic flux is disposed toward the axial direction of the frame.

The front driver may be configured to include permanent magnets. The permanent magnet may be buried in the permanent magnet holes in the front surface of the frame such that N-pole and S-pole are alternately disposed in alignment with the front reference point of the frame.

Specifically, the front driver may include 2n (n is an integer equal to or greater than 4) permanent magnets which are buried in the permanent magnet holes in the front surface of the frame such that N-pole and S-pole are alternately disposed in alignment with the front reference point of the frame and the magnetic flux is disposed toward the axial diameter direction of the frame.

The rear driver may be configured to include permanent magnets. The permanent magnet may be buried in the permanent magnet holes in the rear surface of the frame such that N-pole and S-pole are alternately disposed in alignment with the rear reference point of the frame.

Specifically, the rear driver may include 2n (n is an integer equal to or greater than 4) permanent magnets which are buried in the permanent magnet holes in the rear surface of the frame such that N-pole and S-pole are alternately disposed in alignment with the rear reference point of the frame and the magnetic flux is disposed toward an axial diameter direction of the frame.

The rear driver of the fixing support may include a fixing support having a cylindrical body, one side surface of which is closed and the inner circumferential surface of which has permanent magnet holes formed at a uniform interval in alignment with a reference point in a circumferential axial direction around the rear rotator. The fixing support may include a protrusion in the outer circumferential surface of the body to form bolt holes for fixing to the frame. The permanent magnets may be buried in the permanent magnet holes of the fixing support such that N-pole and S-pole are alternately disposed in alignment with the reference point. The rear driver of the fixing support may be fixed to the frame by bolts.

Specifically, the rear driver of the fixing support may include the fixing support having a cylindrical body, one side surface of which is closed and the inner circumferential surface of which has 2n (hereinafter, n is an integer equal to or greater than 4) permanent magnet holes formed at a uniform interval in alignment with the reference point in a circumferential axial direction around the rear rotator and having a protrusion in the outer circumferential surface of the body to form the bolt holes for fixing to the frame, 2n permanent magnets buried in the permanent magnet holes of the fixing support such that N-pole and S-pole are alternately disposed in alignment with the reference point and the magnetic flux is disposed toward the axial diameter direction of the frame, and the bolts fixed to the frame.

The impeller case may include an air inlet leading intake air to the impeller, a diffuser space forming adiabatic expansion air from the impeller together with the front rotator and the frame, an air outlet converting velocity energy into pressure energy by decelerating the speed in a snail shell-shaped scroll in which the outflow cross-sectional area gradually widens and collecting air flowing in a radius direction into one place to discharge air, and a mounting surface mounted onto the rotating body accelerator.

In the impeller, the blade may have a centrifugal shape.

Specifically, the impeller may have a penetration hole on the center of the body having a circumferential shape, and may include a circular plate on the outer circumferential surface based on the rotation axis at a rear side thereof. The blades may be radially disposed on the outer circumferential surface of the body. The blades may be bent to the opposite direction to the rotation direction from the axial direction to the axial radius direction of the body, and thus the flow field may be gradually broadened, which is called a backward impeller shape. Also, the blades may be bent to the rotation direction, allowing the flow field to be gradually broadened.

In a vehicle having durability to supercharging, the rotating body accelerator may be mounted between the air filter and the inlet pipe of the internal combustion engine, and may form a magnetic torque by interaction with the intake negative pressure varying with the load of the internal combustion engine, thereby operating the impeller and thus compressing air to supply air to the inlet pipe of the internal combustion engine.

In the above configuration, the rotating body accelerator may be equipped with the impeller and the impeller case. The front rotator of the complex rotator may face the front driver in an orthogonal direction at a certain gap in an axial diameter direction of the frame, and the rear rotator may face the rear driver and the rear driver of the fixing support in an orthogonal direction. Also, external air may flow into the air inlet of the impeller case through an air passage. The air passage may be connected to the air outlet through the impeller, the diffuser of the impeller case, and the scroll.

When a vehicle starts up, external air may flow into the air inlet of the impeller case by the intake negative pressure, and then may pass the impeller and the diffuser and the scroll of the impeller case, leading to the air outlet of the impeller case and drawn into the intake pipe of the internal combustion engine. Thus, a rotational moment according to the intake negative pressure obtained by multiplying a distance from the impeller to the air outlet of the impeller case may occur in the impeller directly connected to the complex rotating body, allowing the impeller and the complex rotating body to operate and rotate at the same time.

Thus, in the rotating body accelerator, the rotational moment applied to the impeller may allow the front rotator and the rear rotator of the complex rotating body. The front rotator may react with the front driver to generate a magnetic torque, and the rear rotator may react with the rear driver and the rear driver of the fixing support to generator a magnetic torque. Due to the rotational torque, the impeller directly connected to the complex rotating body may be accelerated and rotated.

Here, the permanent magnets of the front rotator and the rear rotator may be disposed such that the direction of the magnetic field faces the axial direction of the frame and N-pole and S-pole are alternately disposed, and the permanent magnets of the rear driver and the rear driver of the fixing support may be disposed such that the direction of the magnetic field faces the axial diameter direction of the frame and N-pole and S-pole are alternately disposed. Thus, the front driver and the rear driver and the rear driver of the fixing support may face the front rotator and the rear rotator at a certain gap in an orthogonal direction, and the magnetic flux of the permanent magnets of the front rotator and the rear rotator which are rotated by the intake negative pressure in a magnetic field formed therearound may form a virtual magnetic field rotational moment axis, reacting with the permanent magnets of the front driver and the rear diver and the rear driver of the fixing support by an interaction of an attractive force and a repulsive force of the magnetic flux and thus generating a magnetic torque.

Accordingly, the complex rotating body and the impeller may acceleratively rotate by interaction with the intake negative pressure varying with the load of the internal combustion engine due to a resultant force of the rotational moment according to the intake negative pressure applied to the impeller and the rotation moment according to the magnetic torque of the front rotator and the rear rotator of the complex rotating body. Thus, the impeller may inhale external air to give kinetic energy to intake air, and the impeller case may lead air inhaled by the impeller to the impeller, adiabatically compressing air and allowing air to flow to the diffuser space and the scroll of the impeller case in a radius direction. Thus, the velocity of flow may be reduced in the diffuser and the scroll of the impeller case, and thus speed energy of air flowing out of the impeller may be converted into air having pressure energy to be collected into one place, supplying compressed air increased in air density and air volume flow and thus improving the volumetric efficiency without giving a load to a vehicle or an internal combustion engine.

Also, since the front rotator forms the diffuser space together with the impeller case and the frame and rotates together with the impeller, the friction loss of air discharged from the impeller to the diffuser may be reduced, improving the conversion efficiency of velocity energy into pressure energy. Since the blades formed on the front surface of the front rotator has an effect of increasing the outer diameter of the air outlet of the impeller, the air volume flow discharged out of the impeller may increase.

Also, when the pressure of compressed air that is supplied is higher than a preset pressure or a pressure between a throttle valve and the air outlet of the impeller case become higher than a preset pressure due to rapid close of the throttle valve of the internal combustion engine during the load variation, a mechanical or electromagnetic pressure regulator may be installed to discharge compressed air to the atmosphere so as not to give a load to the impeller.

Also, compressed air supplied into the inlet pipe of the internal combustion engine after adiabatic compression in the impeller may increase in temperature due to pressure ratio and thus may decrease in air density. Accordingly, when compressed air is supplied at a high pressure ratio, a cooling device may be installed to increase the air density by lowering the temperature of compressed air between the air outlet of the impeller case and the inlet pipe of the internal combustion engine to increase the volumetric efficiency.

The maximum air volume flow that can be supplied into the intake pipe of the internal combustion engine may be determined by RPM of the complex rotating body rotating in proportion to the intake negative pressure of the internal combustion engine in the rotating body accelerator, output power obtained by the product of the rotational moment resultant force of the impeller, the front rotator and the rear rotator, and air volume flow supplied in a surge region and a choke region according to the impeller performance of the air volume flow and the pressure ratio of the impeller having a certain outer diameter size. The maximum air volume flow may be determined by the maximum torque obtained by adjusting the magnetic density of the permanent magnets of the rotating body accelerator, the contact area of the magnetic field, the mounting diameter pitch of the permanent magnets, and a gap between permanent magnets facing each other at a right angle, the length of the blade of the front rotator, and the specification of the impeller according to the supply capacity of air volume flow.

Thus, actual air volume flow supplied into the inlet pipe of the internal combustion engine may be adjusted by the operation intake negative pressure of the internal combustion engine, and the adjustment of the intake negative pressure may be managed by the fuel amount or the open degree of the throttle valve according to the open degree of an accelerator pedal operated by a driver in accordance with the vehicle driving state.

The surge region of the impeller may be a region in which due to a small air volume flow passing the blade in a low rotation region, the air flow is exfoliated on the surface of the blade and thus a back flow phenomenon occurs. The choke region may be a region in which due to an increasing air volume flow of the impeller in a high rotation region, the speed of air flowing into an inducer becomes relatively higher closely to the sound speed, allowing air not to further flow around the inlet of the inducer. Accordingly, the torque of the rotating body accelerator may be determined so as not to enter the surge region and the choke region of the impeller having the pressure ratio and volume flow impeller performance according to the displacement volume. Also, the area of the air outlet of the impeller case, the distance from the center of the impeller, the width of the diffuser, and the trim ratio of the outer diameter of the inducer that is the air inlet of the impeller and the reducer that is the air outlet may be set to be used in accordance with the characteristics of the internal combustion engine and a vehicle.

Also, since the torque of the rotating body accelerator can be preset to control the maximum air volume flow supplied into the internal combustion engine, the impeller having a larger flow chart may be applied to comfortably use air volume flow necessary even for high RPM of the internal combustion engine than the impeller supplying air volume flow according to displacement volume is applied.

In this case, since the pressure ratio can be reduced and compressed air having relatively low temperature can be supplied, knocking and volumetric efficiency can be improved, and the driving noise can be reduced. Also, sufficient air volume flow for the maximum RPM of the internal combustion engine can be supplied, increasing the maximum speed of a vehicle.

Also, since the rotating body accelerator forms a certain magnitude of rotational moment even in a rotation region of low intake negative pressure by the characteristics of the permanent magnets of the drivers and the rotators of the complex rotating body, the impeller may supply air volume flow with high pressure ratio and air volume flow at an output power according to the product of the rotational moment and the RPM, thereby shortening spool-up time in the low speed driving region and the dynamic region of a vehicle and thus quickly responding to the variation of the load of a vehicle.

Also, the internal combustion engine having high specific power in accordance with the carbon emission regulation and the downsizing trend of a vehicle may be achieved by reducing the fuel consumption consumed in the internal combustion engine in order to increase a deficient super pressure supplied by an existing supercharger in a low-speed driving area and reducing the load of the internal combustion engine operated in order to maintain the super pressure in a high-speed driving area.

Also, since the impeller is driven by the magnetic torque, the driving loss is low, reducing the temperature of compressed air supplied into the inlet pipe of the internal combustion engine. Accordingly, compared to an existing supercharger, the temperature of compressed air may be low, and high-density air can be supplied.

Furthermore, since the impeller is driven by a torque generated from an interaction of an attractive force and a repulsive force of the permanent magnets by interaction with the intake negative pressure, noise may scarcely occur due to high driving efficiency, and the durability may be good and the driving cost may not occur. Also, since there is no limitation in interaction with other surrounding parts, installation may be easy without being limited by a specific location or mounting direction.

Also, since the maximum RPM of the complex rotating body is controlled by adjusting the intensity of the magnetic field in accordance with the characteristics of the internal combustion engine and the vehicle, for the securement of durability, any one bearing of the grease lubrication type bearing, the oil lubrication type bearing, the air cooling type bearing and the magnetic bearing may be selected so as not to exceed the tolerance limit ensuring the durability life due to the high-speed rotation.

Also, the present invention may be configured to include one or more axial flow-type impellers, the impeller case, and the rotating body accelerator.

In this configuration, the impeller case may include a diffuser space forming adiabatic expansion air pressurized from the impeller together with the front rotator and the frame, an air outlet converting velocity energy into pressure energy by decelerating the speed in a snail shell-shaped scroll in which the outflow cross-sectional area gradually widens and collecting air flowing in a radius direction into one place to discharge air, and a mounting surface mounted onto the rotating body accelerator.

In the impeller, the blade may have an axial flow-type shape.

Specifically, the impeller may have a penetration hole on the center of the body having a circumferential shape, and may include blades radially disposed at a uniform interval on the outer circumferential surface of the body in the axial direction based on the rotation axis.

In a vehicle having durability to supercharging, the rotating body accelerator may be mounted between the air filter and the inlet pipe of the internal combustion engine, and may form a magnetic torque by interaction with the intake negative pressure varying with the load of the internal combustion engine, thereby operating the impeller and thus pressurizing air to supply air to the inlet pipe of the internal combustion engine.

In the above configuration, external air flowing into the air inlet of the impeller case due to the air flow by the intake negative pressure may be pressurized in the impeller, and then may be allowed to flow to the rear side of the axial direction of the impeller, thereby flowing into the diffuser space of the impeller case by turning to the diffuser of the impeller case that is an orthogonal direction to the air flow by the rotation of the front rotator. Thus, speed energy of air flowing out of the impeller may be converted into air having pressure energy in the diffuser of the impeller case, thereby supplying compressed air increased in air density and air volume flow through the air outlet and thus improving the volumetric efficiency without giving a load to a vehicle or an internal combustion engine.

In this case, a large amount of pressurized air can be produced, and thus air volume flow corresponding to the characteristics of the internal combustion engine and the vehicle can be supplied. Also, the air volume flow can be easily controlled by adjusting the number of the impellers, and the manufacturing cost can be reduced due to the simple shape of the impeller.

Also, the present invention may include a rear driver of the fixing support including permanents magnets and coils or coils. The rear driver of the fixing support may include a fixing support having a cylindrical body, one side surface of which is closed and the inner circumferential surface and the outer circumferential surface of which have permanent magnet and coil holes formed at a uniform interval in alignment with a reference point in a circumferential axial direction and circumferential axial diameter direction around the rear rotator. The fixing support may include a protrusion on the outer circumferential surface of the body to form bolt holes for fixing to the frame. The permanent magnets and driver coils or the driver coils may be buried in the permanent magnet and coil holes of the fixing support such that N-pole and S-pole are alternately disposed in alignment with the reference point. The rear driver of the fixing support may be fixed to the frame by bolts.

Specifically, in the rotating body accelerator, the rear driver of the fixing support may include the fixing support having a cylindrical body, one side surface of which is closed and the inner circumferential surface and the outer circumferential surface of which has 2n (hereinafter, n is an integer equal to or greater than 4) permanent magnet and coil holes formed at a uniform interval in alignment with the reference point in a circumferential axial direction and circumferential axial diameter direction around the rear rotator and having a protrusion in the outer circumferential surface of the body to form the bolt holes for fixing to the frame, 2n permanent magnets (n is an integer equal to or greater than 4) and driver coils formed by solidifying a coil assembly wound around a coil former with resin, the magnetic flux of which is disposed in an axial diameter direction of the frame, or driver coils buried in the permanent magnet and coil holes of the fixing support such that at least in (n is an integer equal to or greater than 2) coils are disposed in the permanent magnet and coil holes, N-pole and S-pole are alternately disposed in alignment with the reference point and the magnetic flux is disposed toward the axial diameter direction of the frame, and the bolts fixed to the frame.

In a vehicle having durability to supercharging, the rotating body accelerator may be mounted between the air filter and the inlet pipe of the internal combustion engine, and may form a magnetic torque by interaction with the intake negative pressure varying with the load of the internal combustion engine and using power supplied from a power supply unit of the vehicle, thereby operating the impeller and thus compressing or pressurizing air to supply air to the inlet pipe of the internal combustion engine.

In the rotating body accelerator, the impeller and the complex rotating body may rotate by interaction with the intake negative pressure varying with the load of the internal combustion engine, and a magnetic field may be generated in the driving coils of the rear driver of the fixing support using power supplied from the power supply unit in accordance with the instruction of a vehicle, allowing the permanent magnets and the driver coils of the rear driver of the fixing support or the driver coils to face each other. Thus, the magnetic flux of the permanent magnets of the rear rotator rotating by the absorption negative force in the magnetic field formed around the rear rotator may form a virtual magnetic field rotational moment, allowing the rear driver and the rear driver of the fixing support to react with the permanent magnets of the rear driver and the permanent magnets and the driver coils or the driver coils of the rear driver of the fixing support by an interaction of an attractive force and a repulsive force of the magnetic flux and thus generating a magnetic torque and operating the impeller.

In this case, in a designated driving region according to the indication of a vehicle, when the power supply unit increases and supplies the amount of power and thus the intensity of magnetic field of the driver coils of the rear driver of the fixing support increases, the torque of the rear rotator may increase and thus the torque of the complex rotating body may increase, thereby increasing the pressure ratio in a specific driving region and increasing and supplying air volume flow. Thus, the volumetric efficiency may increase.

The power supply unit may supply direct current power to the rear driver of the fixing support including the permanent magnets and the driver coils, generating a magnetic field and thus causing an interaction with the rear rotator, or may supply direct current power to the rear driver of the fixing support including the driver coils, or may supply three-phase alternating current power through 3-phase connection, allowing the driver coils to generate a magnetic field at a phase angle of about 120 degrees and interact.

As described above, since the rotating body accelerator is fixed in output power by the rotation speed of the complex rotating body rotating in proportion to the intake negative pressure, the air volume flow may not be additionally supplied. Accordingly, in a middle-speed and high-speed driving region of a vehicle, the amount of power of a vehicle may be increased in a designated driving region in order to additionally increase the air volume flow. Thus, the intensity of magnetic field of the driver coils of the rear driver of the fixing support may be increased with the supplied power, increasing the torque of the rotating body accelerator, changing the pressure ratio and the air flow rate of the centrifugal impeller, and thus controlling the air volume flow of the compressed air. Accordingly, in a specific driving region, the volumetric efficiency can be additionally improved by supplying the air volume flow corresponding to the characteristics of an internal combustion engine and a vehicle.

Also, the blade of the impeller may be formed into an axial flow-type to pressurize and supply air, and in a specific driving region, the pressurization ratio and the air flow rate may be changed to increase and supply the air volume flow, thereby additionally increasing the volumetric efficiency.

For this, when a vehicle starts up, the power supply unit, the supply power source of which is a storage battery of the vehicle, may recognize the startup of the vehicle, and may supply certain DC power or three-phase AC power to the rotating body accelerator and receive a signal of the vehicle. Thus, the amount of power according to a designated driving region may be increased and supplied by a pre-inputted operation formula.

Specifically, in the rotating body accelerator, the magnetic flux of the rear rotator of the complex rotating body may be disposed toward an axial diameter direction of the frame, and the magnetic fluxes of the rear driver and the rear driver of the fixing support may be disposed toward an axial direction of the frame.

In the above configuration, the rear rotator of the complex rotating body may include a cylindrical protrusion protruding in forward and backward directions from the center of the body having a cylindrical shape, one side of which is closed. The cylindrical protrusion may have a key groove formed in the inner circumferential surface thereof. Permanent magnet holes may be formed in alignment with the key groove and may be formed at a uniform interval in an axial direction of the frame. Permanent magnets may be buried in the permanent magnet holes of a rear rotational plate such that N-pole and S-pole are alternately disposed in alignment with the key groove.

Specifically, the rear rotator of the complex rotating body may include the rear rotational plate having the cylindrical protrusion protruding in forward and backward directions from the center of the body having a cylindrical shape, one side of which is closed, having the key groove formed in the inner circumferential surface thereof and fixing the status, and having 2n (hereinafter, n is an integer equal to or greater than 2) permanent magnet holes formed in alignment with the key groove and formed at a uniform interval in an axial direction of the frame, and 2n permanent magnets disposed such that N-pole and S-pole are alternately buried in the permanent magnet holes of the rear rotational plate in alignment with the key groove and the magnetic flux is disposed toward the axial diameter direction of the frame.

The rear driver of the fixing support may include a fixing support having a cylindrical body, one side surface of which is closed, and having permanent magnet holes formed at a uniform interval in the closed surface of the body in alignment with a reference point in a circumferential axial direction around the rear rotator. The fixing support may include a protrusion in the outer circumferential surface of the body to form bolt holes for fixing to the frame. The permanent magnets may be buried in the permanent magnet holes of the fixing support such that N-pole and S-pole are alternately disposed in alignment with the reference point. The rear driver of the fixing support may be fixed to the frame by bolts.

Specifically, the rear driver of the fixing support may include the fixing support having a cylindrical body, one side surface of which is closed and the inner surface of which has 2n (hereinafter, n is an integer equal to or greater than 4) permanent magnet holes formed at a uniform interval in alignment with the reference point in a circumferential axial direction around the rear rotator and having a protrusion in the outer circumferential surface of the body to form the bolt holes for fixing to the frame, 2n permanent magnets buried in the permanent magnet holes of the fixing support such that N-pole and S-pole are alternately disposed in alignment with the reference point and the magnetic flux is disposed toward the axial direction of the frame, and the bolts fixed to the frame.

The rear driver may be configured to include permanent magnets. The permanent magnet may be buried in the permanent magnet holes in the rear surface of the frame such that N-pole and S-pole are alternately disposed in alignment with the rear reference point of the frame.

Specifically, the rear driver may include 2n (n is an integer equal to or greater than 4) permanent magnets which are buried in the permanent magnet holes in the rear surface of the frame such that N-pole and S-pole are alternately disposed in alignment with the rear reference point of the frame and the magnetic flux is disposed toward an axial direction of the frame.

In a vehicle having durability to supercharging, the rotating body accelerator may be mounted between the air filter and the inlet pipe of the internal combustion engine, and may form a magnetic torque by interaction with the intake negative pressure varying with the load of the internal combustion engine, thereby operating the impeller and thus compressing or pressurizing air to supply air to the inlet pipe of the internal combustion engine.

In the rotating body accelerator, the permanent magnets of the rear rotator of the complex rotating body may be disposed such that the direction of the magnetic field faces the axial diameter direction of the frame and N-pole and S-pole are alternately disposed, and the permanent magnets of the rear driver and the rear driver of the fixing support may be disposed such that the direction of the magnetic field faces the axial direction of the frame and N-pole and S-pole are alternately disposed. Thus, the rear driver and the rear driver of the fixing support may face the rear rotator at a certain gap in an orthogonal direction, and the magnetic flux of the permanent magnets of the rear rotator which are rotated by the intake negative pressure in a magnetic field formed therearound may form a virtual magnetic field rotational moment axis, reacting with the permanent magnets of the rear diver and the rear driver of the fixing support by an interaction of an attractive force and a repulsive force of the magnetic flux and thus generating a magnetic torque and driving the impeller.

Accordingly, the interaction contact area of the permanent magnet of the rear rotator and the permanent magnet of the rear driver and the rear driver of the fixing support can be broadened. Thus, the torque of the complex rotating body and the impeller can be increased, compressing and pressurizing air and thus increasing the air density and the flow rate. Accordingly, air volume flow corresponding to the characteristics of the internal combustion engine and the vehicle can be supplied, increasing the volumetric efficiency.

Also, instead of the impeller, the front rotator of the complex rotating body including the permanent magnets, and the frame equipped with the front driver such that the permanent magnet holes are formed on the front surface thereof in the circumferential axial direction around the front rotator, in this embodiment, the impeller may have the permanent magnet holes formed on the axial line of the circumference at a uniform interval in alignment with the reference point on the rear surface of the circular plate of the body. The permanent magnets may be buried in the permanent magnet holes such that N-pole and S-pole are alternately disposed in alignment with the reference point, or the magnet coatings may be disposed at a uniform interval in alignment with the reference point on the rear surface of the circular plate of the body such that N-pole and S-pole are alternately disposed on the axial line of the circumference. In the rotating body accelerator, the complex rotating body may use the front rotator as the spacer, and the frame may have the permanent magnet holes formed at a uniform interval on the front surface thereof and formed in a circumferential axial direction around the impeller.

Specifically, the impeller may have 2n (hereinafter, n is an integer equal to or greater than 2) permanent magnet holes formed on the axial line of the circumference at a uniform interval in alignment with a reference point on the rear surface of a circular plate of the body. 2n permanent magnets may be buried in the permanent magnet holes such that N-pole and S-pole are alternately disposed in the reference point in an axial direction of the frame, or 2n magnet coatings may be disposed at a uniform interval in alignment with the reference point on the rear surface of the circular plate such that N-pole and S-pole are alternately disposed on the axial line of the circumference. In the rotating body accelerator, the complex rotating body may use the front rotator as a spacer, and the frame may have 2n (n is an integer equal to or greater than 4) permanent magnet holes formed at a uniform interval on the front surface thereof and formed in a circumferential axial direction around the impeller.

In a vehicle having durability to supercharging, the rotating body accelerator may be mounted between the air filter and the inlet pipe of the internal combustion engine, and may form a magnetic torque by interaction with the intake negative pressure varying with the load of the internal combustion engine, thereby operating the impeller and thus compressing air to supply air to the inlet pipe of the internal combustion engine.

In the above configuration, an accelerating rotation function which the front rotator performs may be assigned to the impeller, and the inertia moment of the complex rotating body may be reduced, relatively increasing the responsibility to the load variation and thus increasing the torque. Thus, the impeller may be driven to compress air and increase the air density and the flow rate, supplying air volume flow corresponding to the characteristics of the internal combustion engine and the vehicle and thus increasing the volumetric efficiency.

In one embodiment, a front driving device may be added to a rotating body accelerator. The front driving device may include a front fixing support having permanent magnet holes formed at a uniform interval in one side surface of the body in alignment with a reference point on the same axial line of the circumference as the permanent magnet holes in the front surface of the frame and having an impeller case mounting surface and bolt holes for fixing to the frame formed in the other side surface of the body. The permanent magnets may be buried in the permanent magnet holes of the front fixing support such that N-pole and S-pole are alternately disposed in alignment with the reference point. The front driving device may be fixed to the frame by bolts.

Specifically, the rotating body accelerator may include the front fixing support having a cylindrical body, having 2n (hereinafter, n is an integer equal to or greater than 4) permanent magnet holes formed at a uniform interval in alignment with the reference point in one side surface of the body on the same axial line of the circumference as the permanent magnet holes in the front surface of the frame, and having the impeller case mounting surface and the bolt holes for fixing to the frame in the other side surface of the body, 2n permanent magnets buried in the permanent magnet holes of the front fixing support such that N-pole and S-pole are alternately disposed in alignment with the reference point and the magnetic flux is disposed toward the axial diameter direction of the frame, and the bolts fixed to the frame.

Here, the frame may have bolt holes for fixing the front driving device formed in the front surface thereof. The blade formed in the front surface of the front rotator of the complex rotating body may be removed. The front rotator of the complex rotating body may include a cylindrical protrusion onto which the impeller is mounted.

In a vehicle having durability to supercharging, the rotating body accelerator may be mounted between the air filter and the inlet pipe of the internal combustion engine, and may form a magnetic torque by interaction with the intake negative pressure varying with the load of the internal combustion engine, thereby operating the impeller and thus compressing or pressurizing air to supply air to the inlet pipe of the internal combustion engine.

In the above configuration, the contact area of the permanent magnets of the rotating body accelerator may be broadened. Thus, the permanent magnets of the front rotator of the complex rotating body may react with the permanent magnets of the front driving device and the permanent magnet of the front driver by an interaction of an attractive force and a repulsive force of the magnetic flux. Thus, the torque of the complex rotating body and the impeller can be increased, sucking air and producing expanded air or accelerated air and thus increasing the air density and the flow rate. Accordingly, air volume flow corresponding to the characteristics of the internal combustion engine and the vehicle can be supplied, increasing the volumetric efficiency.

Also, in one embodiment, a rotating body accelerator may produce power with a rear driver of the fixing support including coils instead of the rear driver of the fixing support including the permanent magnets. AC power produced by the rear driver of the fixing support may be converted into DC power to be transmitted to a storage battery by a relay module.

Specifically, the rotating body accelerator may be added with the relay module. The rear driver of the fixing support may produce three-phase AC power, and three-phase AC power produced by the rear driver of the fixing support may be converted into DC power to be transmitted to the storage battery by the relay module.

In the above configuration, the rear driver of the fixing support may include a fixing support having a cylindrical body, the inner surface of which is closed, and having coil holes formed on the same circumferential axial line as the permanent magnet holes of the front magnet holes at a uniform interval in the closed surface of the body in alignment with a reference point in an axial direction of the circumference of the front rotator. The fixing support may include a protrusion in the outer circumferential surface of the body to form bolt holes for fixing to the frame. The armature coils may be buried in three-phase arrangement in the coil holes of the fixing support in alignment with the reference point, and then the rear driver of the fixing support may be fixed to the frame by bolts.

Specifically, the rear driver of the fixing support may include the fixing support having a cylindrical body, one side surface of which is closed and the inner surface of which has 3n (hereinafter, n is an integer equal to or greater than 2) coil holes formed at a uniform interval in alignment with the reference point on the same axial line of the circumference as the permanent magnet holes and having a protrusion in the outer circumferential surface of the body to form the bolt holes for fixing to the frame, 3n armature coils buried in a three-phase arrangement in the coil holes of the fixing support in alignment with the reference point and formed by solidifying a coil assembly wound around a three-phase connected coil former with resin such that the magnetic flux is disposed toward the axial direction of the frame, and the bolts fixed to the frame.

The relay module may convert three-phase AC power produced by the rear driver of the fixing support into DC power, and relays may transmit power necessary for charging of the storage battery. Other power may be consumed in load dummy.

Specifically, the relay module may include a rectifier converting three-phase AC power into DC power, a relay outputting power when an output voltage reaches a certain voltage effective for charging of the storage battery and thus the contact is closed, a relay connected to an output side of the relay to transmit generation power to the storage battery and preventing the storage battery from being overcharged by transmitting generation power to the load dummy when the output voltage reaches a voltage effective for charge of the storage battery and the contact is opened, the load dummy consuming generation power received from the relays, and a reverse current preventing device for preventing a reversal of a current from the storage battery, fuses, an installation member mounted with the fuses, and a case.

In a vehicle having durability to supercharging, the rotating body accelerator may be mounted between the air filter and the inlet pipe of the internal combustion engine, and may form a magnetic torque by interaction with the intake negative pressure varying with the load of the internal combustion engine, thereby operating the impeller and thus compressing or pressurizing air to supply air to the inlet pipe of the internal combustion engine and producing and supplying power to the storage battery.

In the rotating body accelerator, the front rotator and the rear rotator of the complex rotating body may rotate in response to the front driver and the rear driver to drive the impeller. The magnetic flux may be intermitted to the armature coils of the rear driver of the fixing support disposed at a phase angle of about 120 degrees facing the rear rotator of the complex rotating body at a certain gap, generating an induced electromotive force and thus producing three-phase AC power. The relays of the relay module may operate when a vehicle starts up and the power supply is connected. Three-phase AC power produced by the rear driver of the fixing support may be converted into DC power by the rectifier and thus generation power within an effective voltage range may be transmitted for charging of the storage battery. Other generation power may be consumed in the load dummy and generated heat may be cooled by head wind during the driving.

Accordingly, air may be compressed or pressurized to be supplied to the intake pipe of the internal combustion engine, and power produced by the rear driver of the fixing support may be supplied within an effective voltage range for charging of the storage battery. Thus, the charging state of the storage battery may be maintained good, minimizing the power generation load for charging the storage battery of a vehicle and thus reducing the fuel consumption for power generation. Also, power may be separately supplied to the storage battery, allowing external power consuming devices to operate and thus saving the power generation cost without giving a power generation load to the internal combustion engine.

In one embodiment, a rotating body accelerator may include a complex rotating body including one of the front rotator and the rear driver instead of the complex rotating body including the front rotator and the rear driver.

Here, the frame may be mounted with one of the front driver and the rear driver, and the bearing module of the complex rotating body may be mounted with a key for fixing the status of one of the front rotator and the rear rotator.

Specifically, the rotating body accelerator may include the complex rotating body including one of the front rotator and the rear rotator.

In a vehicle having durability to supercharging, the rotating body accelerator may be mounted between the air filter and the inlet pipe of the internal combustion engine, and may form a magnetic torque by interaction with the intake negative pressure varying with the load of the internal combustion engine, thereby operating the impeller and thus compressing or pressurizing air to supply air to the inlet pipe of the internal combustion engine.

In the above configuration, the rotating body accelerator may operate the impeller to compress or pressurize air to increase the air density and the flow rate. Thus, various kinds of air supply devices for supplying air volume flow corresponding to the internal combustion engine and the vehicle can be manufactured to deal with the characteristics of various internal combustion engines and the vehicles.

In one embodiment, the present invention may be added with an integral air filter case including an air filter upper case, a connection tube, an air filter, and an air filter lower case, and may be embedded with the rotating body accelerator equipped with the impeller and the impeller case.

Specifically, the rotating body accelerator equipped with the impeller and the impeller case may be embedded, and the integral air filter case including the air filter upper case, the connection tube, the air filter, and the air filter lower case may be added.

In a vehicle having durability to supercharging, the rotating body accelerator may be mounted onto the inlet pipe of the internal combustion engine, and may form a magnetic torque by interaction with the intake negative pressure varying with the load of the internal combustion engine, thereby operating the impeller and thus compressing or pressurizing air to supply air to the inlet pipe of the internal combustion engine.

In the above configuration, heat and noise emitted from the impeller case can be cooled and absorbed by external air flowing into the integral air filter case. Also, the mounting space can be reduced, thereby facilitating the installation and particularly securing a larger mounting space with respect to an existing vehicle in which the arrangement of the parts of the internal combustion engine mounting chamber is determined.

Also, in a natural aspirated vehicle and a motor cycle, the rotating body accelerator may be mounted between the air filter and the inlet pipe of the internal combustion engine, and may form a magnetic torque by interaction with the intake negative pressure varying with the load of the internal combustion engine, thereby operating the impeller and thus compressing or pressurizing air to supply air to the inlet pipe of the internal combustion engine.

Thus, the air density and flow rate may be increased within an error correction range of the driving system and the control system of the natural aspirated vehicle and the motor cycle, and thus air volume flow may be supplied corresponding to the characteristics of the internal combustion engine and the vehicle. Accordingly, while maintaining the advantages of the natural aspirated vehicle and the motor cycle and the characteristics of natural intake having good responsibility upon load variation, the volumetric efficiency may be increased, and the carbon emission regulation may be dealt with by reducing the fuel consumption of the internal combustion engine. Thus, without giving a load to the vehicle and the internal combustion engine, the driving loss and driving noise may become lower, and the durability may become better. Also, the air supply device may use low power or may not need the driving cost, and can be easily installed without limitations of a specific location and a mounting direction.

Also, it may be selectable whether to increase the output by adjusting the amount of fuel or improve the fuel efficiency by reducing the fuel consumption as much as the volumetric efficiency of the internal combustion engine increases.

Also, in a fuel cell vehicle configured, the rotating body accelerator may be mounted between the air filter and the fuel cell of the fuel cell driving device, and may form a magnetic torque with power supplied from the power supply unit of the vehicle in according with the instruction of the vehicle, thereby operating the impeller and thus compressing air to supply air to the fuel cell of the fuel cell driving device.

Thus, the rotating body accelerator may generate a torque from an interaction of the rear rotator and the permanent magnets and the driver coils of the rear driver of the fixing support or the driver coils using power supplied from the power supply unit of a vehicle. Thus, the rotating body accelerator may operate the complex rotating body and the impeller to compress air and thus increase the air density and flow rate, and thus may supply necessary air volume flow. Also, the rotating body accelerator may increase the amount of power from the power supply unit in accordance with the instruction of a vehicle, and may increase the intensity of the magnetic field of the driver coils of the rear driver of the fixing support using supplied power, thereby increasing the torque of the rotating body accelerator and thus supplying more air volume flow. Accordingly, without giving a load to a vehicle, the driving loss and the driving noise may become lower, and the durability may become better. Also, power consumption may be reduced compared to the electric air compressor.

The power supply unit may supply direct current power to the rear driver of the fixing support including the permanent magnets and the driver coils, generating a magnetic field and thus causing an interaction with the rear rotator, or may supply direct current power to the rear driver of the fixing support including the driver coils, or may supply three-phase alternating current power through 3-phase connection, allowing the driver coils to generate a magnetic field at a phase angle of about 120 degrees and interact.

In order to supply a large amount of compressed air to an air supply system of the fuel cell driving device, a driving force necessary therefor may be needed. Accordingly, permanent magnets may be applied to the rotating body accelerator to increase the driving capacity, or the contact area of the magnetic field of permanent magnets and the mounting diameter pitch of permanent magnets may be increased to enhance the driving force. Also, the gap between permanent magnets may be adjusted, or the present invention may be applied in plurality to sequentially supply air volume flow in accordance with the power generation amount of the fuel cell driving device.

For this, when a vehicle starts up, the power supply unit, the supply power source of which is a power source of the vehicle, may recognize the startup of the vehicle, and may supply DC power or three-phase AC power to the rotating body accelerator to maintain the driving state and receive a signal of the vehicle. Thus, the amount of power according to a designated driving region may be increased and supplied by a pre-inputted operation formula.

DETAILED DESCRIPTION OF PREFERRED EMBODIMENTS

Preferred embodiments of the present invention will be described below in more detail with reference to the accompanying drawings. The present invention may, however, be embodied in different forms and should not be constructed as limited to the embodiments set forth herein. Rather, these embodiments are provided so that this disclosure will be thorough and complete, and will fully convey the scope of the present invention to those skilled in the art.

Hereinafter, it will be described about an exemplary embodiment of the present invention in conjunction with the accompanying drawings.

Hereinafter, components, and combination structures, actions and operations thereof according to a first embodiment will be described.

First, the components will be described with reference to the accompanying drawings.

Figure 1:
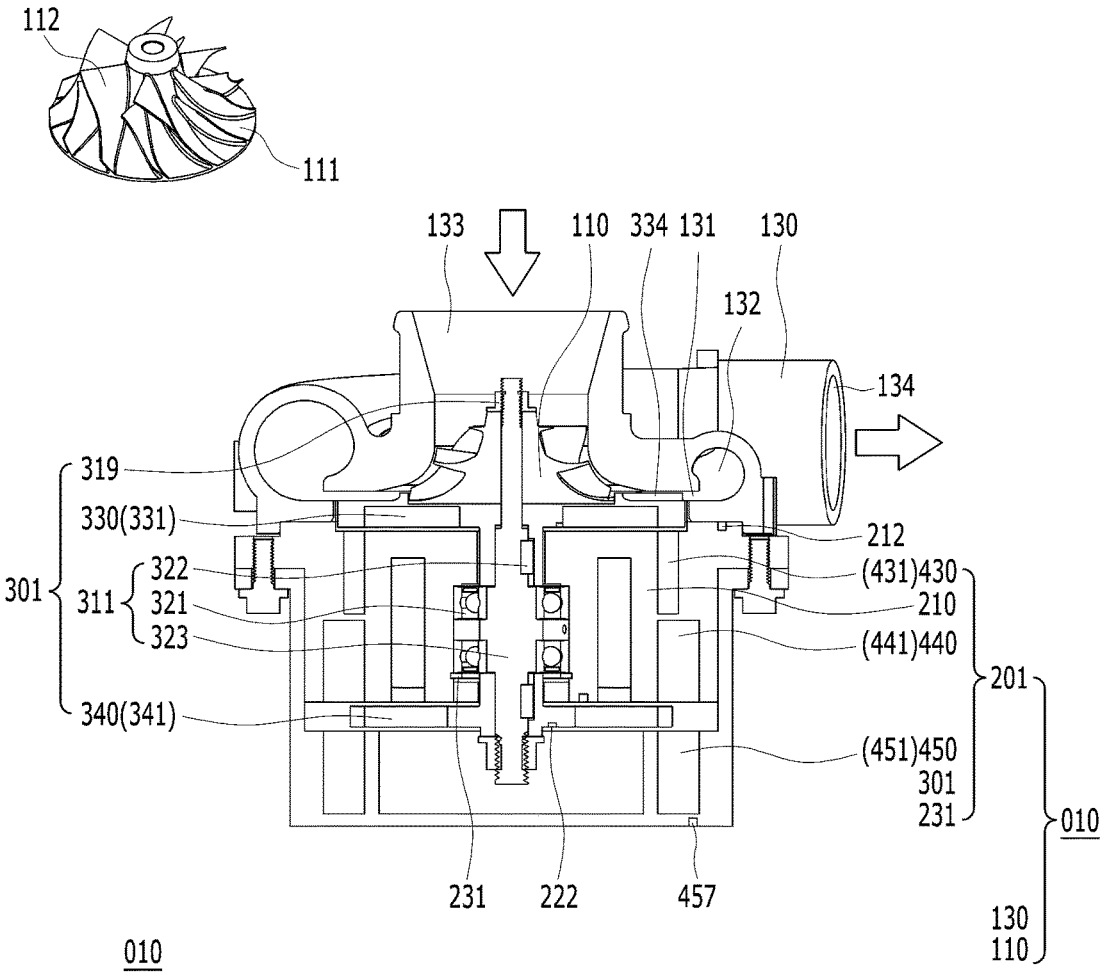
FIG. 1 is a perspective view illustrating an air charging apparatus (010) according to a first embodiment of the present invention.
Figure 22:
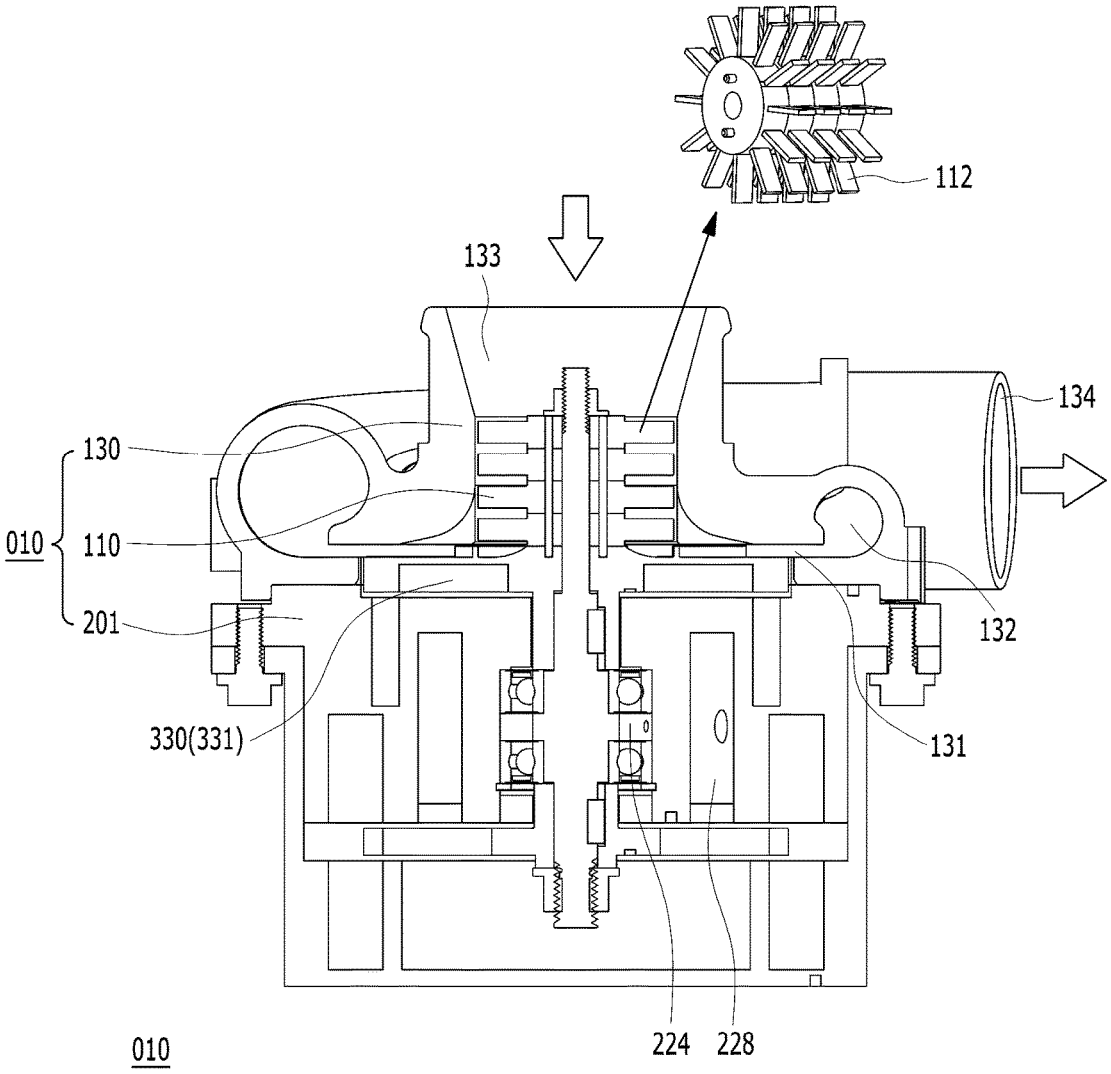
FIG. 22 is a perspective view illustrating an air charging apparatus (010) equipped with an axial flow-type impeller according to a first embodiment of the present invention.

As shown in FIGS. 1 and 22, an air charging apparatus 010 of compressing or pressurizing and transferring air may include an impeller 110 sucking air and giving kinetic energy to intake air, an impeller case 130 leading external air inhaled by the impeller 110 into the impeller 110 and converting velocity energy of air out of the impeller 110 into pressure energy to discharge air, and a rotating body accelerator 201 equipped with the impeller 110 and the impeller case and driving the impeller 110. Hereinafter, each component will be described in detail.

Figure 23:
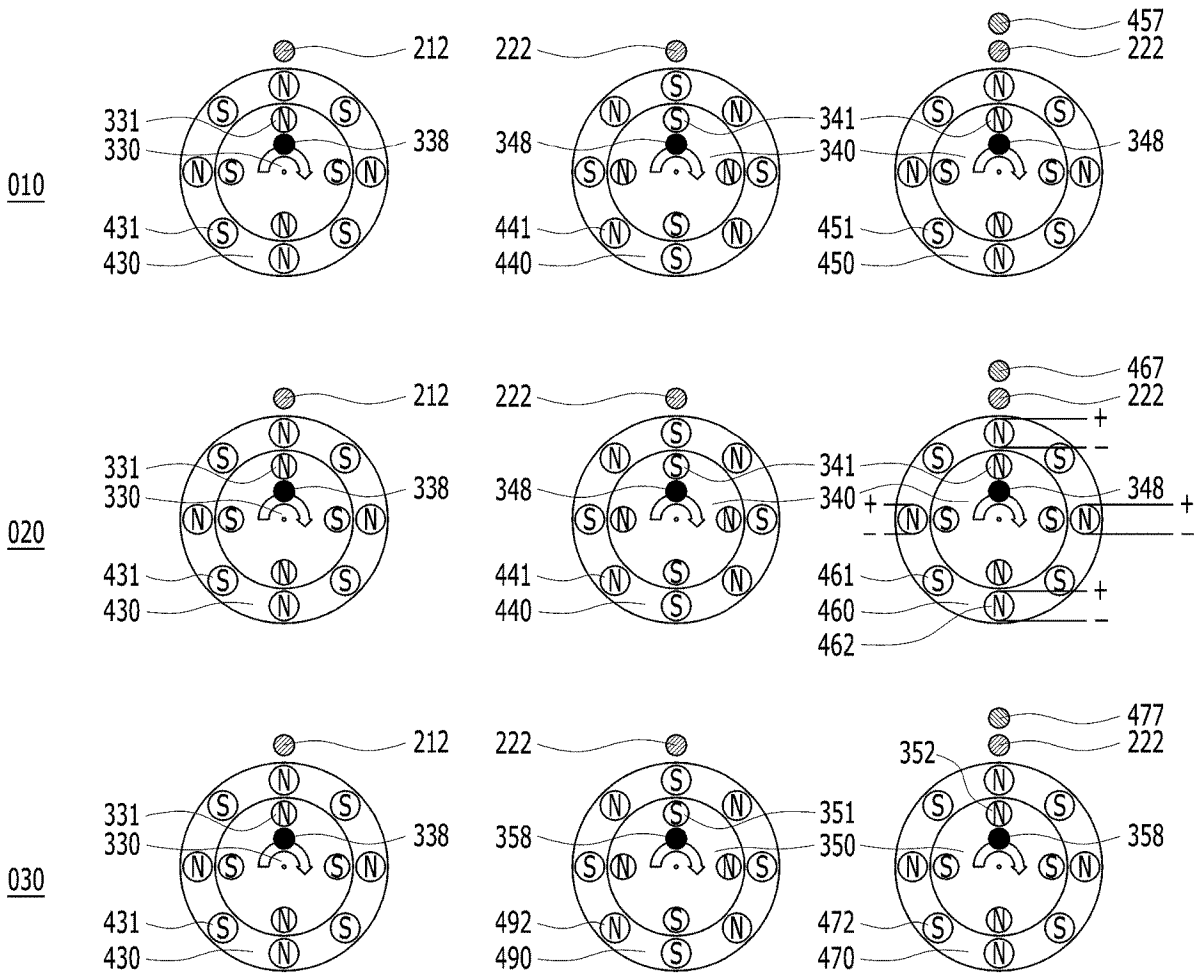
FIGS. 23 and 24 are permanent magnet layout views illustrating an operation of a rotating body accelerator according to embodiments of the present invention.

As shown in FIGS. 1, 22, and 23, the rotating body accelerator 201 may be equipped with a complex rotating body 301 in a frame 210. The magnetic flux of the complex rotating body 301 may be disposed in the axial direction of the frame 210. The complex rotating body 301 may be fixed by a fixture 231 such as a snap ring or a lock nut. Also, a front driver 430 and a rear driver 440 and a rear driver of the fixing support 450 may be disposed in a circumferential direction around the complex rotating body 301 at a certain interval in the axial direction of the complex rotating body 301 and the frame 210 such that the direction of the magnetic flux is disposed in the axial diameter direction of the frame 210.

Specifically, the rotating body accelerator 201 may include the complex rotating body 301, the magnetic flux of which is disposed toward the axial direction of the frame 210, the front driver 430, the rear driver 440 and the rear driver 450 of the fixing support disposed in a circumferential direction around the complex rotating body 301 at a certain interval in the axial direction of the complex rotating body 301 and the frame 210 such that the direction of the magnetic flux faces the axial diameter direction of the frame 210, the frame 210 equipped with the drivers 430, 440 and 450 and supporting the rotation of the complex rotating body 301, and the fixture 231 for fixing the complex rotating body 310 to the frame 210.

Figure 2:
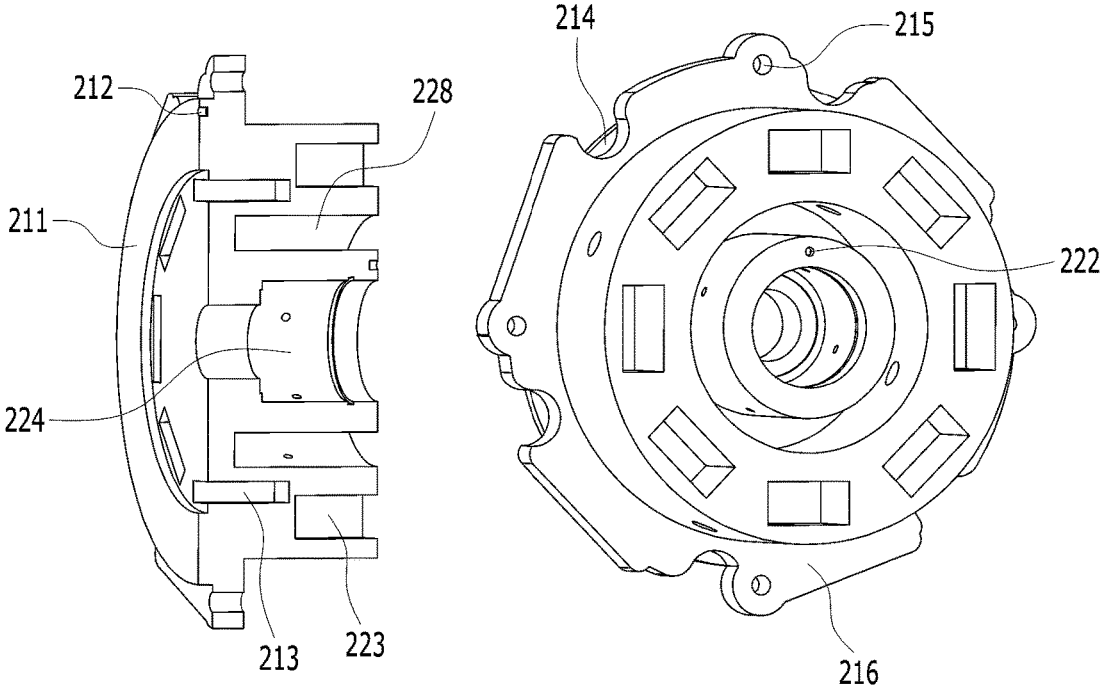
FIG. 2 is a perspective view illustrating a frame according to a first embodiment of the present invention.

In this configuration, the frame 210, as shown in FIGS. 1 and 2, may have permanent magnet holes 213 and 223 formed in the circumferential axial direction around the complex rotating body 301 at a uniform interval in alignment with a front reference point 212 and a rear reference point 222 on the front surface and the rear surface based on the axis of the circular-shaped body. Also, the frame 210 may have a mounting space 224 of the complex rotating body 301 inside the inner circumferential surface thereof and a bearing cooling space 228 of a concentric shape formed in the front direction on the circumferential axial of the rear surface thereof. Also, the frame may have a protrusion formed on the outer circumferential surface of the body such that a mounting surface 211 of the impeller case 130, bolt seating surfaces 214, bolt holes 215 for fixing the rear driver 450 of the fixing support, and installation supports 216 are provided. Also, the bearing cooling space 228 and the mounting space 224 of the complex rotating body 301 may be formed such that any one of a grease lubrication type bearing, an oil lubrication type bearing, an air cooling type bearing and a magnetic bearing can be mounted therein.

Specifically, the frame 210 may have 2n (n is an integer equal to or greater than 4) permanent magnet holes 213 and 223 formed in the circumferential axial direction around the complex rotating body 301 at a uniform interval in alignment with a front reference point 212 and a rear reference point 222 on the front surface and the rear surface based on the axis of the circular-shaped body. Also, the frame 210 may have a mounting space 224 of the complex rotating body 301 inside the inner circumferential surface thereof and a bearing cooling space 228 of a concentric shape formed in the front direction on the circumferential axial of the rear surface thereof, such that any one of a grease lubrication type bearing, an oil lubrication type bearing, an air cooling type bearing and a magnetic bearing can be mounted therein. Also, the frame may have a protrusion formed on the outer circumferential surface of the body such that a mounting surface 211 of the impeller case 130, fixing seating surfaces 214, bolt holes 215 for fixing the rear driver 450 of the fixing support, and installation supports 216 are provided.

Figure 3:
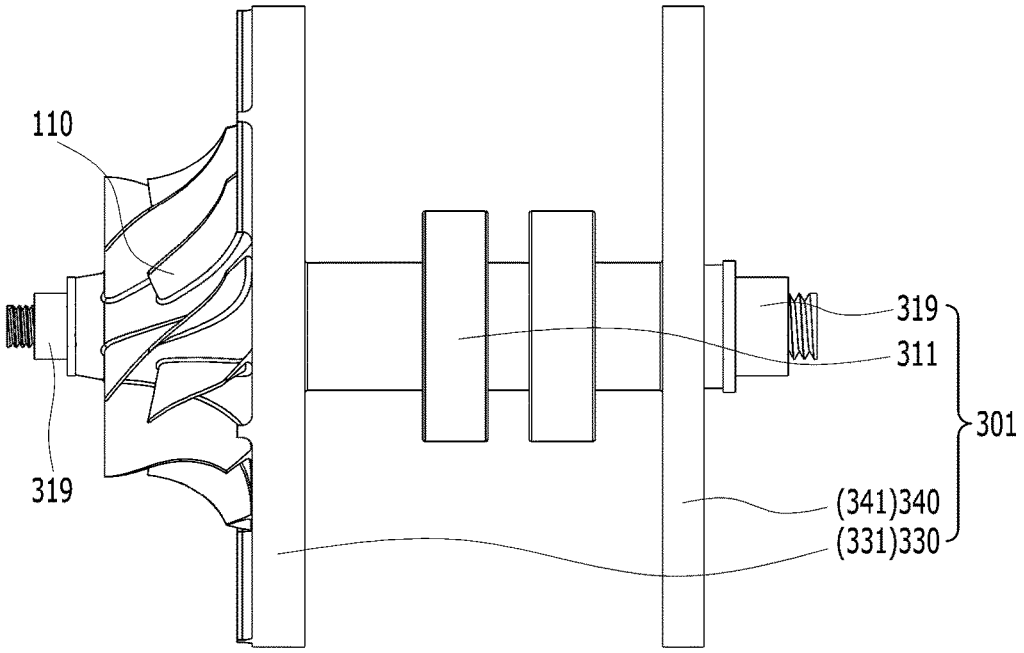
FIG. 3 is a perspective view illustrating a complex rotating body according to a first embodiment of the present invention.

As shown in FIGS. 1, 3, and 23, in the complex rotating body 301, the bearing module 311 may be mounted in the bearing mounting space 224 of the frame 210, and may be fixed with the fixture 231 such as the snap ring or the lock nut. The impeller 110 and a front rotator 330, the direction of the magnetic flux of which is disposed toward the axial direction of the frame 210, may be together mounted in the bearing module 311 at the front side of the frame 210, and may be fixed with a lock nut 319 to be disposed in an orthogonal direction to the front driver 430 at a certain gap. Also, a rear rotator 340, the direction of the magnetic flux of which is disposed toward the axial direction of the frame 210, may be mounted in the bearing module 311 at the rear side of the frame 210, and may be fixed with the lock nut 319 to be disposed in an orthogonal direction to the rear driver 440 and the rear driver 450 of the fixing support at a certain gap.

Specifically, the complex rotating body 301 may include the front rotator 330 disposed in an orthogonal direction at a certain gap in the axial direction of the front driver 430 and the frame 210 and thus the direction of the magnetic flux is disposed toward the axial direction of the frame 210, the rear rotator 340 disposed in an orthogonal direction at a certain gap in the axial direction of the rear driver 440, the rear driver 450 of the fixing support and the frame 210 and thus the direction of the magnetic flux is disposed toward the axial direction of the frame 210, the bearing module 311 supporting the rotation of the impeller 110, the front rotator 330, and the rear rotator 340, and the lock nuts 319 for fixing the front rotator 330, the rear rotator 340, and the bearing module 311.

Figure 4:
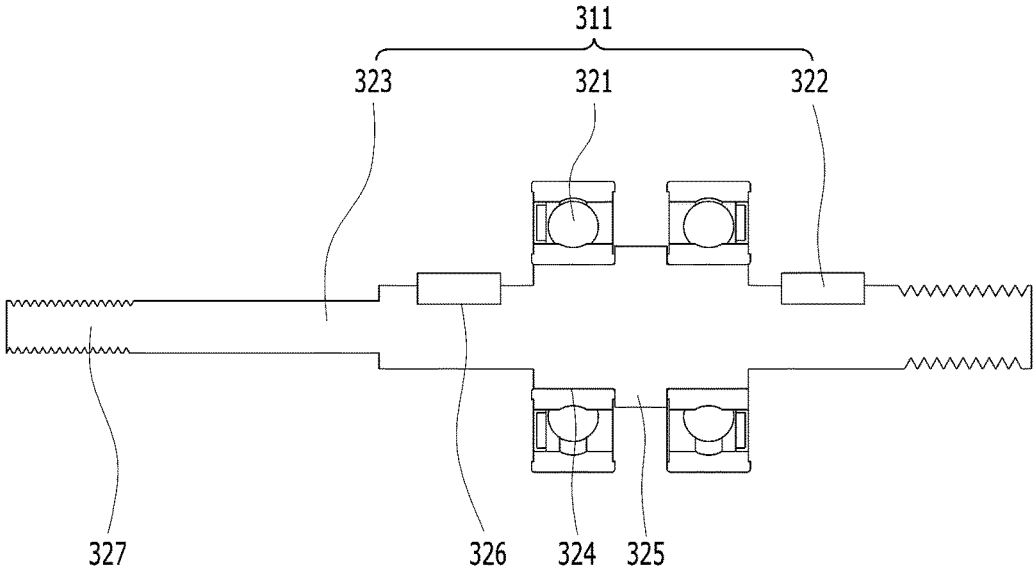
FIG. 4 is a perspective view illustrating a bearing module according to a first embodiment of the present invention.

In this configuration, the bearing module 311, as shown in FIGS. 1 and 4, may have a bearing mounting surface 324, a bearing fixing step 325, a key groove 326 for fixing the status of the front rotator 330 and the rear rotator 340 on the outer circumferential surface of the body of a round rod shape. The bearing module 311 may be mounted with a bearing 321 for supporting the rotation of a rotational shaft 323 having a screw thread 327 on which the lock nut 319 is mounted at both ends thereof, and keys 322 for the status may be mounted in the key groove 326.

Also, the bearing module 311 may include any one bearing 321 of a grease lubrication type bearing, an oil lubrication type bearing, an air cooling type bearing and a magnetic bearing, which does not exceed the tolerance limit ensuring the durability life in accordance with the maximum RPM of the complex rotating body 301.

Specifically, the bearing module 311 may include the rotational shaft 323 having the bearing mounting surface 324, the bearing fixing step 325, and the key groove 326 formed on the outer circumferential surface of the body of a round bar shape and having the screw thread 327 at both ends thereof, the bearing 321 including any one of a grease lubrication type bearing, an oil lubrication type bearing, an air cooling type bearing and a magnetic bearing, and keys 322 for fixing the status.

Figure 5:
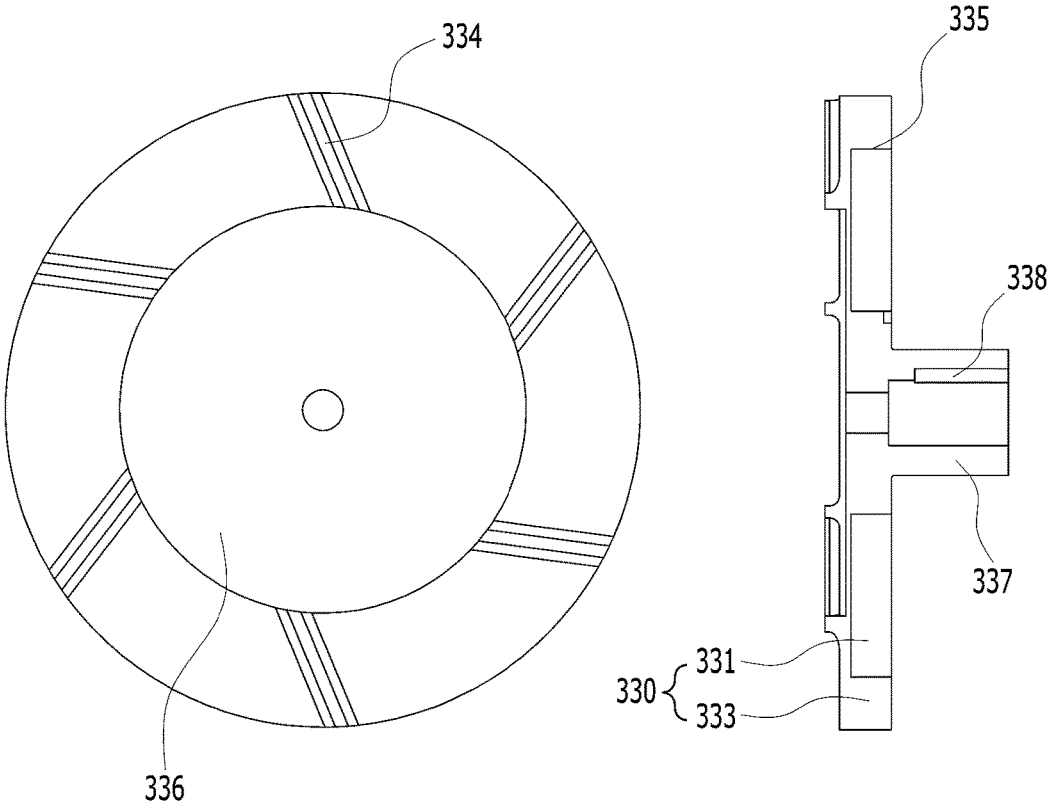
FIG. 5 is a perspective view illustrating a front rotator according to a first embodiment of the present invention.

The front rotator 330, as shown in FIGS. 1, 5 and 23, may include a cylindrical protrusion 337 protruding from the center of the body having a disc shape in a backward direction. The cylindrical protrusion 337 may have a key groove 338 formed in the inner circumferential surface thereof and fixing the status. Permanent magnet holes 335 may be formed in the rear surface of the body in alignment with the key groove 338 and may be formed at a uniform interval on the axial line of the circumference. Permanent magnets may be buried in the permanent magnet holes 335 of a front rotational plate 333 on which a mounting surface 336 of the impeller 110 and blades 334 are radially formed at a uniform interval such that N-pole and S-pole are alternately disposed in alignment with the key groove 338.

Specifically, the front rotator 330 may include the front rotational plate 333 having the cylindrical protrusion 337 protruding from the center of the body having a disc shape in a backward direction, having the key groove 338 formed in the inner circumferential surface thereof and fixing the status, having 2n (hereinafter, n is an integer equal to or greater than 2) permanent magnet holes 335 formed in the rear surface of the body in alignment with the key groove 338 and formed at a uniform interval on the axial line of the circumference, and having a shape in which the permanent magnets are buried in the permanent magnet holes 335 of the front rotational plate 333 on which the mounting surface 336 of the impeller 110 and the blades 334 are radially formed at a uniform interval, and 2n permanent magnets 331 disposed such that N-pole and S-pole are alternately buried in the permanent magnet holes 335 of the front rotational plate 333 in alignment with the key groove 338 and the magnetic flux is disposed toward the axial direction of the frame 210.

Figure 6:
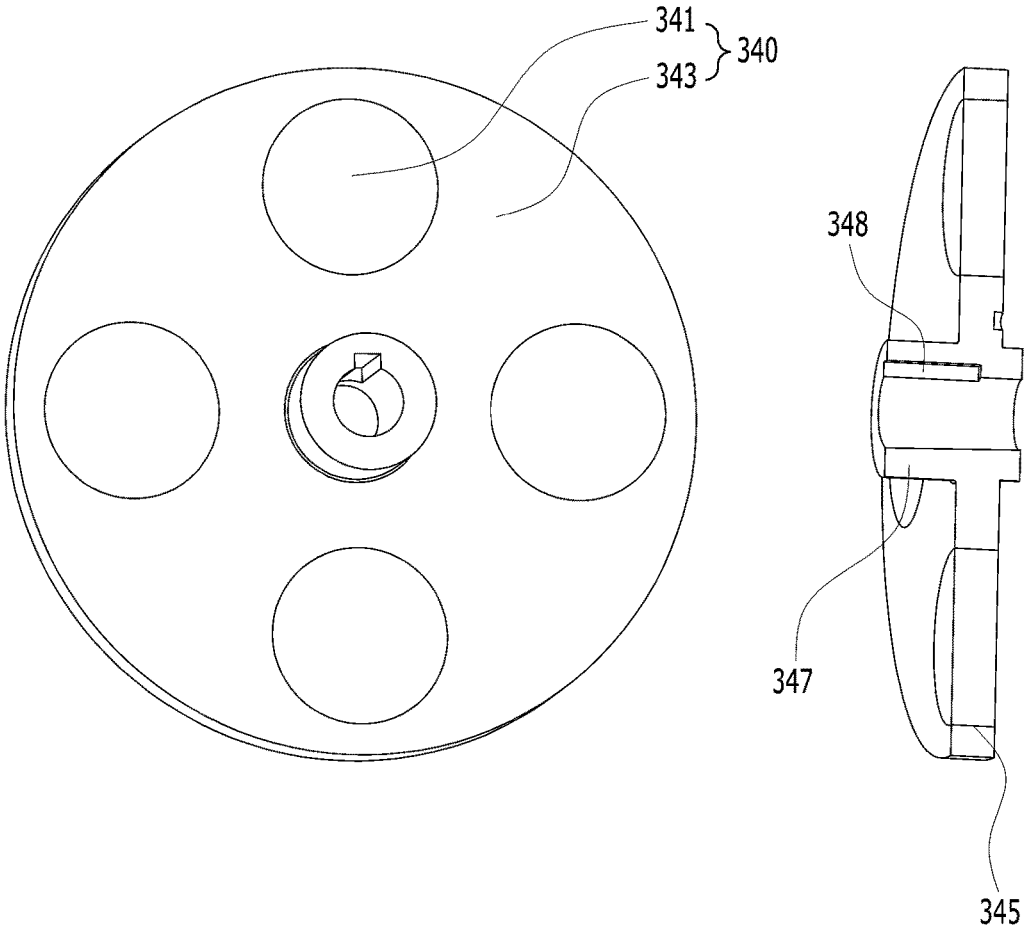
FIG. 6 is a perspective view illustrating a rear rotator according to a first embodiment of the present invention.

The rear rotator 340, as shown in FIGS. 1, 6 and 23, may include a cylindrical protrusion 347 protruding from the center of the body having a disc shape in forward and backward directions. The cylindrical protrusion 347 may have a key groove 348 formed in the inner circumferential surface thereof. Permanent magnet holes 345 may be formed in alignment with the key groove 348 and may be formed at a uniform interval on the axial line of the circumference of the body. Permanent magnets may be buried in the permanent magnet holes 345 of a rear rotational plate 343 such that N-pole and S-pole are alternately disposed in alignment with the key groove 348.

Specifically, the rear rotator 340 may include the rear rotational plate 343 having the cylindrical protrusion 347 protruding from the center of the body having a disc shape in forward and backward directions, having the key groove 348 formed in the inner circumferential surface thereof and fixing the status, and having 2n (hereinafter, n is an integer equal to or greater than 2) permanent magnet holes 345 formed in alignment with the key groove 348 and formed at a uniform interval on the axial line of the circumference of the body, and 2n permanent magnets 341 disposed such that N-pole and S-pole are alternately buried in the permanent magnet holes 345 of the rear rotational plate 343 in alignment with the key groove 348 and the magnetic flux is disposed toward the axial direction of the frame 210.

Figure 7:
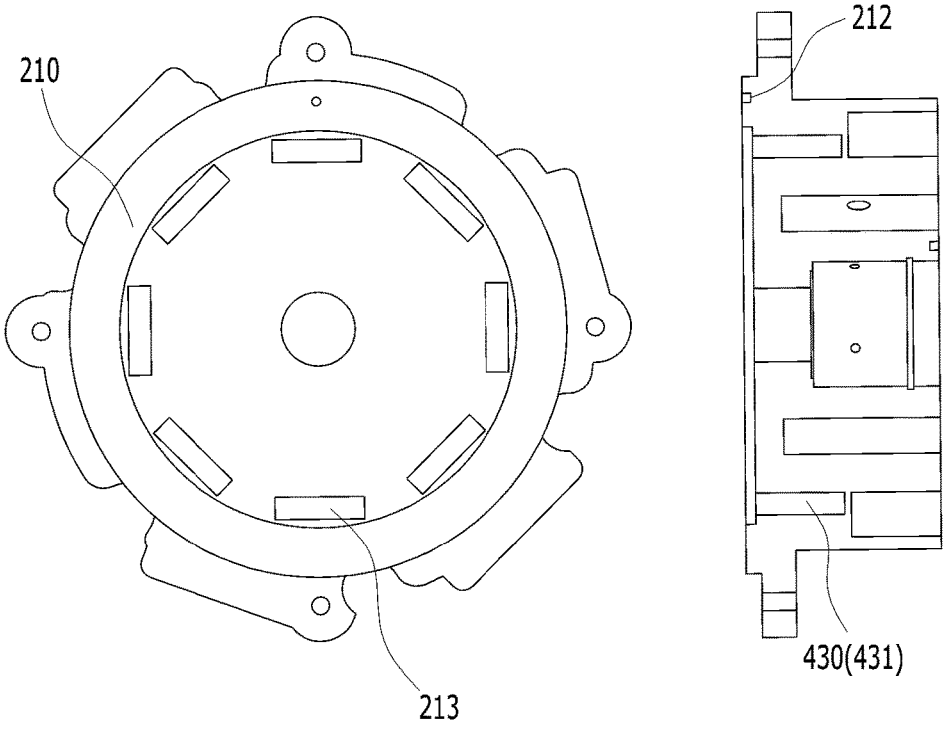
FIG. 7 is a perspective view illustrating a front driver according to a first embodiment of the present invention.
Figure 8:
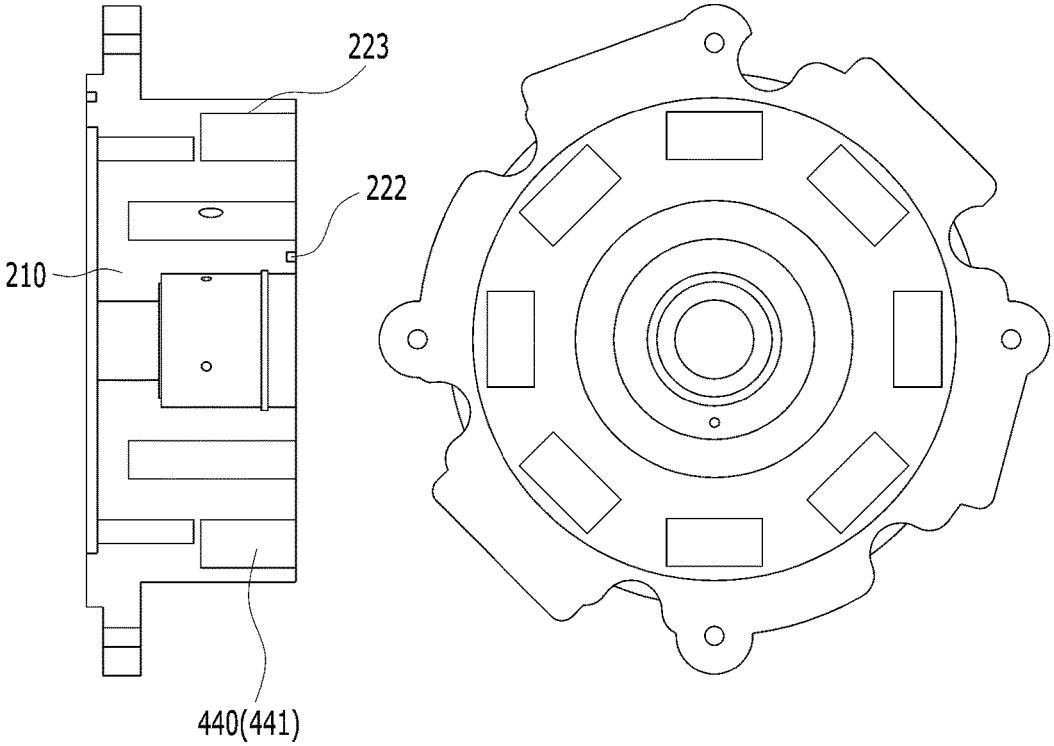
FIG. 8 is a perspective view illustrating a rear driver according to a first embodiment of the present invention.

The front driver 430, as shown in FIGS. 1, 7 and 23, may be configured to include permanent magnets 431. The permanent magnet 431 may be buried in the permanent magnet holes 213 in the front surface of the frame 210 such that N-pole and S-pole are alternately disposed in alignment with the front reference point 212 of the frame 210.

Specifically, the front driver 430 may include 2n (n is an integer equal to or greater than 4) permanent magnets 431 which are buried in the permanent magnet holes 213 in the front surface of the frame 210 such that N-pole and S-pole are alternately disposed in alignment with the front reference point 212 of the frame 210 and the magnetic flux is disposed toward the axial diameter direction of the frame 210.

The rear driver 440, as shown in FIGS. 1, 7 and 23, may be configured to include permanent magnets 441. The permanent magnet 441 may be buried in the permanent magnet holes 223 in the rear surface of the frame 210 such that N-pole and S-pole are alternately disposed in alignment with the rear reference point 222 of the frame 210.

Specifically, the rear driver 440 may include 2n (n is an integer equal to or larger than 4) permanent magnets 441 which are buried in the permanent magnet holes 223 in the rear surface of the frame 210 such that N-pole and S-pole are alternately disposed in alignment with the rear reference point 222 of the frame 210 and the magnetic flux is disposed toward the axial diameter direction of the frame 210.

Figure 9:
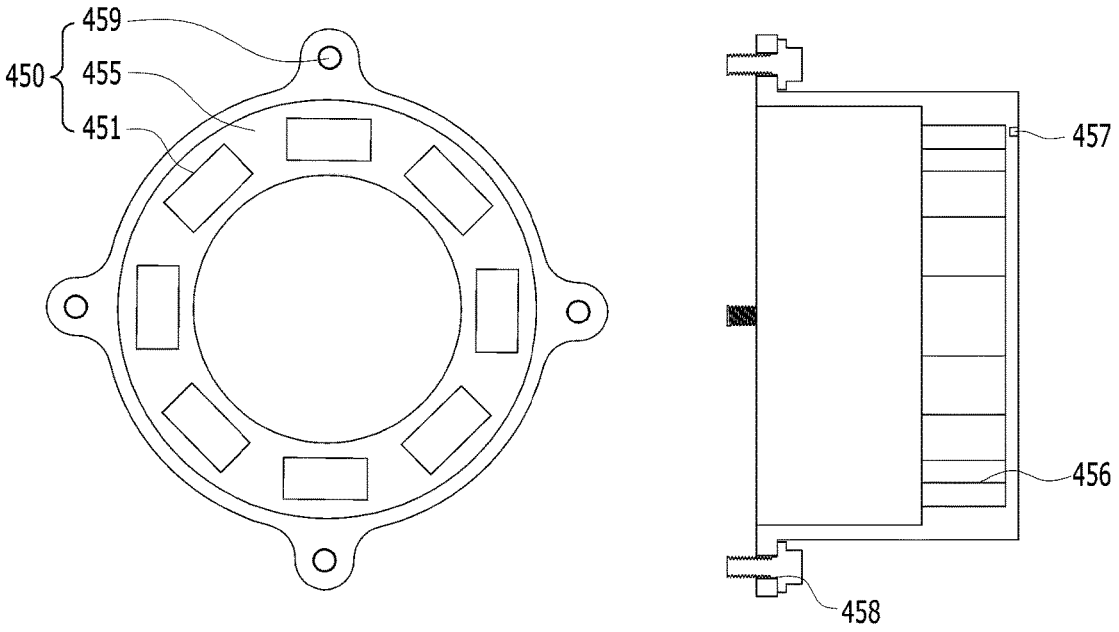
FIG. 9 is a perspective view illustrating a rear driver of the fixing support according to a first embodiment of the present invention.

The rear driver 450 of the fixing support, as shown in FIGS. 1, 9 and 23, may include a fixing support 455 having a cylindrical body, one side surface of which is closed and the inner circumferential surface of which has permanent magnet holes 456 formed at a uniform interval in alignment with a reference point 457 in a circumferential axial direction around the rear rotator 340. The fixing support may include a protrusion in the outer circumferential surface of the body to form bolt holes 458 for fixing to the frame 210. The permanent magnets 451 may be buried in the permanent magnet holes 456 of the fixing support 455 such that N-pole and S-pole are alternately disposed in alignment with the reference point 457. The rear driver 450 of the fixing support may be fixed to the frame 210 by bolts 459.

Specifically, the rear driver 450 of the fixing support may include the fixing support 455 having a cylindrical body, one side surface of which is closed and the inner circumferential surface of which has 2n (hereinafter, n is an integer equal to or greater than 4) permanent magnet holes 456 formed at a uniform interval in alignment with the reference point 457 in a circumferential axial direction around the rear rotator 340 and having a protrusion in the outer circumferential surface of the body to form the bolt holes 458 for fixing to the frame 210, 2n permanent magnets 451 buried in the permanent magnet holes 456 of the fixing support 455 such that N-pole and S-pole are alternately disposed in alignment with the reference point 457 and the magnetic flux is disposed toward the axial diameter direction of the frame 210, and the bolts 459 fixed to the frame 210.

The impeller case 130, as shown in FIG. 1, may include an air inlet 133 leading intake air to the impeller 110, a diffuser 131 space forming adiabatic expansion air from the impeller 110 together with the front rotator 330 and the frame 210, an air outlet 134 converting velocity energy into pressure energy by decelerating the speed in a snail shell-shaped scroll 132 in which the outflow cross-sectional area gradually widens and collecting air flowing in a radius direction into one place to discharge air, and a mounting surface mounted onto the rotating body accelerator 201.

As shown in FIG. 1, in the impeller 110, the blade 112 may have a centrifugal shape.

Specifically, the impeller 110 may have a penetration hole on the center of the body having a circumferential shape, and may include a circular plate 111 on the outer circumferential surface based on the rotation axis at a rear side thereof. The blades 112 may be radially disposed on the outer circumferential surface of the body. The blades 112 may be bent to the opposite direction to the rotation direction from the axial direction to the axial radius direction of the body, and thus the flow field may be gradually broadened, which is called a backward impeller shape. Also, the blades 112 may be bent to the rotation direction, allowing the flow field to be gradually broadened.

As shown in FIG. 22, the present invention 010 may be configured to include one or more axial flow-type impellers 110, the impeller case 130, and the rotating body accelerator 201.

In this configuration, the impeller case 130 may include a diffuser 131 space forming adiabatic expansion air pressurized from the impeller 110 together with the front rotator 330 and the frame 210, an air outlet 134 converting velocity energy into pressure energy by decelerating the speed in a snail shell-shaped scroll 132 in which the outflow cross-sectional area gradually widens and collecting air flowing in a radius direction into one place to discharge air, and a mounting surface mounted onto the rotating body accelerator 201.

In the impeller 110, the blade 112 may have an axial flow-type shape.

Specifically, the impeller 110 may have a penetration hole on the center of the body having a circumferential shape, and may include blades 112 radially disposed at a uniform interval on the outer circumferential surface of the body in the axial direction based on the rotation axis.

Hereinafter, the combination structure of the components will be described in detail.

The frame 210 mounted with the front driver 430 and the rear driver 440, the bearing module 311, the fixture 231 such as a snap ring or a lock nut, the rear rotator 340, the lock nut 319, and the rear driver 450 of the fixing support may be provided.

Also, the bearing module 311 may be applied with any one bearing 321 of a grease lubrication type bearing, an oil lubrication type bearing, an air cooling type bearing and a magnetic bearing.

That is, the bearing module 311 may include the bearing 321 seated in the bearing mounting space 224 of the frame 210 in accordance with the options of the bearings 321, and may allow the bearing 321 to be fixed by the fixture 231 such as the snap ring or the lock nut. Also, the rear rotator 340 may be mounted onto the rotation axis 323 of the bearing module 311 at the rear side of the frame 210, and may be fixed by the lock nut 319. Thereafter, the rear driver 450 of the fixing support may be fixed to the frame 210 by the bolts 459 in alignment with the reference point 457 of the rear driver 450 of the fixing support and the rear reference point 222 of the frame 210. When the grease lubrication type bearing or the oil lubrication type bearing 321 is applied, a sealing cover or an oil seal may be mounted onto the rear surface of the frame 210.

Also, the front rotator 330, the impeller 110, the lock nut 319, the impeller case 130, and impeller case bolts 135 (not shown in FIG. 1) may be provided.

That is, the front rotator 330 and the impeller 110 may be mounted onto the rotation axis 323 of the bearing module 311 at the front side of the frame 210, and may be fixed by the lock nut 319. The impeller case 130 may be mounted onto the impeller case mounting surface 211 of the frame, and then may be fixed by the impeller case bolts 135.

Hereinafter, the action and the operation of the components will be described.

In a vehicle in which the blade 112 of the impeller 110 is configured to have a centrifugal shape and thus have durability to supercharging, the rotating body accelerator 201 may be mounted between the air filter and the inlet pipe of the internal combustion engine, and may form a magnetic torque by interaction with the intake negative pressure varying with the load of the internal combustion engine, thereby operating the impeller 110 and thus compressing air to supply air to the inlet pipe of the internal combustion engine.

As shown in FIG. 1, the rotating body accelerator 201 may be equipped with the impeller 110 and the impeller case 130. The front rotator 330 of the complex rotator 301 may face the front driver 430 in an orthogonal direction, and the rear rotator 340 may face the rear driver 440 and the rear driver 450 of the fixing support in an orthogonal direction. Also, external air may flow into the air inlet 133 of the impeller case 130 through an air passage. The air passage may be connected to the air outlet 134 through the impeller 110, the diffuser 131 of the impeller case 130, and the scroll 132.

When a vehicle starts up, external air may flow into the air inlet 133 of the impeller case 130 by the intake negative pressure, and then may pass the impeller 110 and the diffuser 131 and the scroll 132 of the impeller case 130, leading to the air outlet 134 of the impeller case 130 and drawn into the intake pipe of the internal combustion engine. Thus, a rotational moment according to the intake negative pressure obtained by multiplying a distance from the impeller 110 to the air outlet 134 of the impeller case 130 may occur in the impeller 110 directly connected to the complex rotating body 301, allowing the impeller 110 and the complex rotating body 301 to operate and rotate at the same time.

Thus, in the rotating body accelerator 201, the rotational moment applied to the impeller 110 may allow the front rotator 330 and the rear rotator 340 of the complex rotating body 301. The front rotator 330 may react with the front driver 430 to generate a magnetic torque, and the rear rotator 340 may react with the rear driver 440 and the rear driver 450 of the fixing support to generator a magnetic torque. Due to the rotational torque, the impeller 110 directly connected to the complex rotating body 301 may be accelerated and rotated.

Here, the permanent magnets 331 and 334 of the front rotator 330 and the rear rotator 340 may be disposed such that the direction of the magnetic field faces the axial direction of the frame 210 and N-pole and S-pole are alternately disposed, and the permanent magnets 431, 441 and 451 of the rear driver 440 and the rear driver 450 of the fixing support may be disposed such that the direction of the magnetic field faces the axial diameter direction of the frame 210 and N-pole and S-pole are alternately disposed. Thus, the front driver 430 and the rear driver 440 and the rear driver 450 of the fixing support may face the front rotator 330 and the rear rotator 340 at a certain gap in an orthogonal direction, and the magnetic flux of the permanent magnets 331 and 341 of the front rotator 330 and the rear rotator 340 which are rotated by the intake negative pressure in a magnetic field formed therearound may form a virtual magnetic field rotational moment axis, reacting with the permanent magnets 431, 441 and 451 of the front driver 430 and the rear diver 440 and the rear driver 450 of the fixing support by an interaction of an attractive force and a repulsive force of the magnetic flux and thus generating a magnetic torque.

Accordingly, the complex rotating body 301 and the impeller 110 may acceleratively rotate by interaction with the intake negative pressure varying with the load of the internal combustion engine due to a resultant force of the rotational moment according to the intake negative pressure applied to the impeller 110 and the rotation moment according to the magnetic torque of the front rotator 330 and the rear rotator 340 of the complex rotating body 301. Thus, the impeller 110 may inhale external air to give kinetic energy to intake air, and the impeller case 130 may lead air inhaled by the impeller 110 to the impeller 110, adiabatically compressing air and allowing air to flow to the diffuser 131 space and the scroll 132 of the impeller case 130 in a radius direction. Thus, the velocity of flow may be reduced in the diffuser 131 and the scroll 132 of the impeller case 130, and thus speed energy of air flowing out of the impeller 110 may be converted into air having pressure energy, supplying compressed air increased in air density and air volume flow and thus improving the volumetric efficiency without giving a load to a vehicle or an internal combustion engine.

Also, since the front rotator 330 forms the diffuser 131 space together with the impeller case 130 and the frame 210 and rotates together with the impeller 110, the friction loss of air discharged from the impeller 110 to the diffuser 131 may be reduced, improving the conversion efficiency of velocity energy into pressure energy. Since the blades 334 formed on the front surface of the front rotator 330 has an effect of increasing the outer diameter of the air outlet of the impeller 110, the air volume flow discharged out of the impeller 110 may increase.

Also, when the pressure of compressed air that is supplied is higher than a preset pressure or a pressure between a throttle valve and the air outlet 134 of the impeller case 130 become higher than a preset pressure due to rapid close of the throttle valve of the internal combustion engine during the load variation, a mechanical or electromagnetic pressure regulator may be installed to discharge compressed air to the atmosphere so as not to give a load to the impeller 110.

Also, compressed air supplied into the inlet pipe of the internal combustion engine after adiabatic compression in the impeller may increase in temperature due to pressure ratio and thus may decrease in air density. Accordingly, when compressed air is supplied at a high pressure ratio, a cooling device may be installed to increase the air density by lowering the temperature of compressed air between the air outlet 134 of the impeller case 130 and the inlet pipe of the internal combustion engine to increase the volumetric efficiency.

The maximum air volume flow that can be supplied into the intake pipe of the internal combustion engine may be determined by RPM of the complex rotating body 301 rotating in proportion to the intake negative pressure of the internal combustion engine in the rotating body accelerator 201, output power obtained by the product of the rotational moment resultant force of the impeller 110, the front rotator 330 and the rear rotator 340, and air volume flow supplied in a surge region and a choke region according to the impeller performance of the air volume flow flow and the pressure ratio of the impeller 110 having a certain outer diameter size. The maximum air volume flow may be determined by the maximum torque obtained by adjusting the magnetic density of the permanent magnets of the rotating body accelerator 201, the contact area of the magnetic field, the mounting diameter pitch of the permanent magnets, and a gap between permanent magnets facing each other at a right angle, the length of the blade 334 of the front rotator 330, and the specification of the impeller 110 according to the supply capacity of air volume flow.

Thus, actual air volume flow supplied into the inlet pipe of the internal combustion engine may be adjusted by the operation intake negative pressure of the internal combustion engine, and the adjustment of the intake negative pressure may be managed by the fuel amount or the open degree of the throttle valve according to the open degree of an accelerator pedal operated by a driver in accordance with the vehicle driving state.

The surge region of the impeller 110 may be a region in which due to a small air volume flow passing the blade 112 in a low rotation region, the air flow is exfoliated on the surface of the blade 112 and thus a back flow phenomenon occurs. The choke region may be a region in which due to an increasing air volume flow of the impeller 110 in a high rotation region, the speed of air flowing into an inducer becomes relatively higher closely to the sound speed, allowing air not to further flow around the inlet of the inducer. Accordingly, the torque of the rotating body accelerator 201 may be determined so as not to enter the surge region and the choke region of the impeller 110 having the pressure ratio and volume flow impeller performance according to the displacement volume. Also, the area of the air outlet of the impeller case 130, the distance from the center of the impeller 110, the width of the diffuser 131, and the trim ratio of the outer diameter of the inducer that is the air inlet of the impeller 110 and the reducer that is the air outlet may be set to be used in accordance with the characteristics of the internal combustion engine and a vehicle.

Also, since the torque of the rotating body accelerator 201 can be preset to control the maximum air volume flow supplied into the internal combustion engine, the impeller 110 having a larger flow chart may be applied to comfortably use air volume flow necessary even for high RPM of the internal combustion engine than the impeller 110 supplying air volume flow according to displacement volume is applied.

In this case, since the pressure ratio can be reduced and compressed air having relatively low temperature can be supplied, knocking and volumetric efficiency can be improved, and the driving noise can be reduced. Also, sufficient air volume flow for the maximum RPM of the internal combustion engine can be supplied, increasing the maximum speed of a vehicle.

Also, since the rotating body accelerator 201 forms a certain magnitude of rotational moment even in a rotation region of low intake negative pressure by the characteristics of the permanent magnets of the drivers 430, 440 and 450 and the rotators 330 and 340 of the complex rotating body 301, the impeller 110 may supply air volume flow with high pressure ratio and air volume flow at an output power according to the product of the rotational moment and the RPM, thereby shortening spool-up time in the low speed driving region and the dynamic region of a vehicle and thus quickly responding to the variation of the load of a vehicle.

Also, the internal combustion engine having high specific power in accordance with the carbon emission regulation and the downsizing trend of a vehicle may be achieved by reducing the fuel consumption consumed in the internal combustion engine in order to increase a deficient super pressure supplied by an existing supercharger in a low-speed driving area and reducing the load of the internal combustion engine operated in order to maintain the super pressure in a high-speed driving area.

Also, since the impeller 110 is driven by the magnetic torque, the driving loss is low, reducing the temperature of compressed air supplied into the inlet pipe of the internal combustion engine. Accordingly, compared to an existing supercharger, the temperature of compressed air may be low, and high-density air can be supplied.

Furthermore, since the impeller 110 is driven by a torque generated from an interaction of an attractive force and a repulsive force of the permanent magnets by interaction with the intake negative pressure, noise may scarcely occur due to high driving efficiency, and the durability may be good and the driving cost may not occur. Also, since there is no limitation in interaction with other surrounding parts, installation may be easy without being limited by a specific location or mounting direction.

Also, since the maximum RPM of the complex rotating body 301 is controlled by adjusting the intensity of the magnetic field in accordance with the characteristics of the internal combustion engine and the vehicle, for the securement of durability, any one bearing 321 of the grease lubrication type bearing, the oil lubrication type bearing, the air cooling type bearing and the magnetic bearing may be selected so as not to exceed the tolerance limit ensuring the durability life due to the high-speed rotation.

Also, in a vehicle in which the blade 112 of the impeller 110 is configured to have an axial flow-type shape and thus have durability to supercharging, the rotating body accelerator 201 may be mounted between the air filter and the inlet pipe of the internal combustion engine, and may form a magnetic torque by interaction with the intake negative pressure varying with the load of the internal combustion engine, thereby operating the impeller 110 and thus pressurizing air to supply air to the inlet pipe of the internal combustion engine.

In the above configuration, external air flowing into the air inlet 133 of the impeller case 130 due to the air flow by the intake negative pressure may be pressurized in the impeller 110, and then may be allowed to flow to the rear side of the axial direction of the impeller 110, thereby flowing into the diffuser 131 space of the impeller case 130 by turning to the diffuser 131 of the impeller case 130 that is an orthogonal direction to the air flow by the rotation of the front rotator 330. Thus, speed energy of air flowing out of the impeller 110 may be converted into air having pressure energy in the diffuser 131 of the impeller case 130, thereby supplying compressed air increased in air density and air volume flow through the air outlet 134 and thus improving the volumetric efficiency without giving a load to a vehicle or an internal combustion engine.

In this case, a large amount of pressurized air can be produced, and thus air volume flow corresponding to the characteristics of the internal combustion engine and the vehicle can be supplied. Also, the air volume flow can be easily controlled by adjusting the number of the impellers 110, and the manufacturing cost can be reduced due to the simple shape of the impeller 110.

Embodiments for Implementing the Present Invention

Hereinafter, components, and combination structures, actions and operations thereof according to a second embodiment will be described.

First, the components will be described with reference to the accompanying drawings.

Compared to the first embodiment, a rotating body accelerator 202 according to the second embodiment of the present invention 020 may include a rear driver of the fixing support 460 including permanents magnets and coils or coils. The rear driver 460 of the fixing support may include a fixing support 465 having a cylindrical body, one side surface of which is closed and the inner circumferential surface and the outer circumferential surface of which have permanent magnet and coil holes 466 formed at a uniform interval in alignment with a reference point 467 in a circumferential axial direction and circumferential axial diameter direction around the rear rotator 340. The fixing support 465 may include a protrusion on the outer circumferential surface of the body to form bolt holes 468 for fixing to the frame 210. The permanent magnets 461 and driver coils 462 or the driver coils 462 may be buried in the permanent magnet and coil holes 466 of the fixing support 465 such that N-pole and S-pole are alternately disposed in alignment with the reference point 467. The rear driver 450 of the fixing support may be fixed to the frame 210 by bolts 469.

Also, since other configurations are similar to those of the first embodiment, a detailed description thereof will be omitted by referring to the same reference numbers of FIGS. 1 and 22.

Specifically, in the rotating body accelerator 202, the rear driver 460 of the fixing support may include the fixing support 465 having a cylindrical body, one side surface of which is closed and the inner circumferential surface and the outer circumferential surface of which has 2n (hereinafter, n is an integer equal to or greater than 4) permanent magnet and coil holes 466 formed at a uniform interval in alignment with the reference point 467 in a circumferential axial direction and circumferential axial diameter direction around the rear rotator 340 and having a protrusion in the outer circumferential surface of the body to form the bolt holes 468 for fixing to the frame 210, 2n permanent magnets (n is an integer equal to or greater than 4) 461 and driver coils 462 formed by solidifying a coil assembly 464 wound around a coil former 463 with resin, the magnetic flux of which is disposed in an axial diameter direction of the frame 210, or driver coils 462 buried in the permanent magnet and coil holes 466 of the fixing support 465 such that at least 1n (n is an integer equal to or greater than 2) coils are disposed in the permanent magnet and coil holes 466, N-pole and S-pole are alternately disposed in alignment with the reference point 467 and the magnetic flux is disposed toward the axial diameter direction of the frame 210, and the bolts 469 fixed to the frame 210.

Hereinafter, the combination structure of the components will be described in detail.

Instead of the rear driver 450 of the fixing support including the permanent magnets 451 among the components of the first embodiment, the rear driver 460 of the fixing support including permanent magnets 461 and driver coils 462 or driver coils 462 may be provided.

That is, while implemented in the same process as the first embodiment, the rear driver 460 of the fixing support may be fixed to the frame 210 by bolts 469 in alignment with the reference point 467 of the rear driver 460 of the fixing support and the rear reference point 222 of the frame 210. Hereinafter, the process may be implemented and finished similarly to the first embodiment.

Hereinafter, the action and the operation of the components will be described.

In a vehicle having durability to supercharging, the rotating body accelerator 202 may be mounted between the air filter and the inlet pipe of the internal combustion engine, and may form a magnetic torque by interaction with the intake negative pressure varying with the load of the internal combustion engine and using power supplied from a power supply unit of the vehicle, thereby operating the impeller 110 and thus compressing or pressurizing air to supply air to the inlet pipe of the internal combustion engine.

In the rotating body accelerator 202, the impeller 110 and the complex rotating body 301 may rotate by interaction with the intake negative pressure varying with the load of the internal combustion engine, and a magnetic field may be generated in the driving coils 462 of the rear driver 460 of the fixing support using power supplied from the power supply unit in accordance with the instruction of a vehicle, allowing the permanent magnets 461 and the driver coils 462 of the rear driver 460 of the fixing support or the driver coils 462 to face each other. Thus, the magnetic flux of the permanent magnets 341 of the rear rotator 340 rotating by the absorption negative force in the magnetic field formed around the rear rotator 340 may form a virtual magnetic field rotational moment, allowing the rear driver 440 and the rear driver 460 of the fixing support to react with the permanent magnets 441 of the rear driver 440 and the permanent magnets 461 and the driver coils 462 or the driver coils 462 of the rear driver 460 of the fixing support by an interaction of an attractive force and a repulsive force of the magnetic flux and thus generating a magnetic torque and operating the impeller 110.

In this case, in a designated driving region according to the indication of a vehicle, when the power supply unit increases and supplies the amount of power and thus the intensity of magnetic field of the driver coils 462 of the rear driver 460 of the fixing support increases, the torque of the rear rotator 340 may increase and thus the torque of the complex rotating body 301 may increase, thereby increasing the pressure ratio in a specific driving region and increasing and supplying air volume flow. Thus, the volumetric efficiency may increase.

The power supply unit may supply direct current power to the rear driver 460 of the fixing support including the permanent magnets 461 and the driver coils 462, generating a magnetic field and thus causing an interaction with the rear rotator 340, or may supply direct current power to the rear driver 460 of the fixing support including the driver coils 462, or may supply three-phase alternating current power through 3-phase connection, allowing the driver coils 462 to generate a magnetic field at a phase angle of about 120 degrees and interact.

As described in the first embodiment, since the rotating body accelerator 202 is fixed in output power by the rotation speed of the complex rotating body 301 rotating in proportion to the intake negative pressure, the air volume flow may not be additionally supplied. Accordingly, in a middle-speed and high-speed driving region of a vehicle, the amount of power of a vehicle may be increased in a designated driving region in order to additionally increase the air volume flow. Thus, the intensity of magnetic field of the driver coils 462 of the rear driver of the fixing support 460 may be increased with the supplied power, increasing the torque of the rotating body accelerator 202, changing the pressure ratio and the air flow rate of the centrifugal impeller 110, and thus controlling the air volume flow of the compressed air. Accordingly, in a specific driving region, the volumetric efficiency can be additionally improved by supplying the air volume flow corresponding to the characteristics of an internal combustion engine and a vehicle.

Also, the blade 112 of the impeller 110 may be formed into an axial flow-type to pressurize and supply air, and in a specific driving region, the pressurization ratio and the air flow rate may be changed to increase and supply the air volume flow, thereby additionally increasing the volumetric efficiency.

For this, when a vehicle starts up, the power supply unit, the supply power source of which is a storage battery of the vehicle, may recognize the startup of the vehicle, and may supply certain DC power or three-phase AC power to the rotating body accelerator 202 and receive a signal of the vehicle. Thus, the amount of power according to a designated driving region may be increased and supplied by a pre-inputted operation formula.

Hereinafter, components, and combination structures, actions and operations thereof according to a third embodiment will be described.

First, the components will be described with reference to the accompanying drawings.

Compared to the first embodiment, as shown in FIGS. 13 to 15, and 23, in a rotating body accelerator 203 according to the third embodiment 030 of the present invention, the direction of the magnetic flux of the complex rotating body 301 may include a rear rotator 350 of a complex rotating body 303, the magnetic flux of which is disposed toward an axial diameter direction of the frame 210, and a rear driver 490 and a rear driver of the fixing support 470, the magnetic fluxes of which are disposed toward an axial direction of the frame 210, instead of the rear rotator 340 of the complex rotating body 301, the magnetic flux of which is disposed toward an axial direction of the frame 210, and the rear driver 440 and the rear driver 450 of the fixing support, the magnetic fluxes of which are disposed toward an axial diameter direction of the frame 210.

Also, since other configurations are similar to those of the first embodiment, a detailed description thereof will be omitted by referring to the same reference numbers of FIGS. 1 and 22.

Specifically, in the rotating body accelerator 203, the magnetic flux of the rear rotator 350 of the complex rotating body 303 may be disposed toward an axial diameter direction of the frame 210, and the magnetic fluxes of the rear driver 490 and the rear driver 470 of the fixing support may be disposed toward an axial direction of the frame 210.

Figure 13:
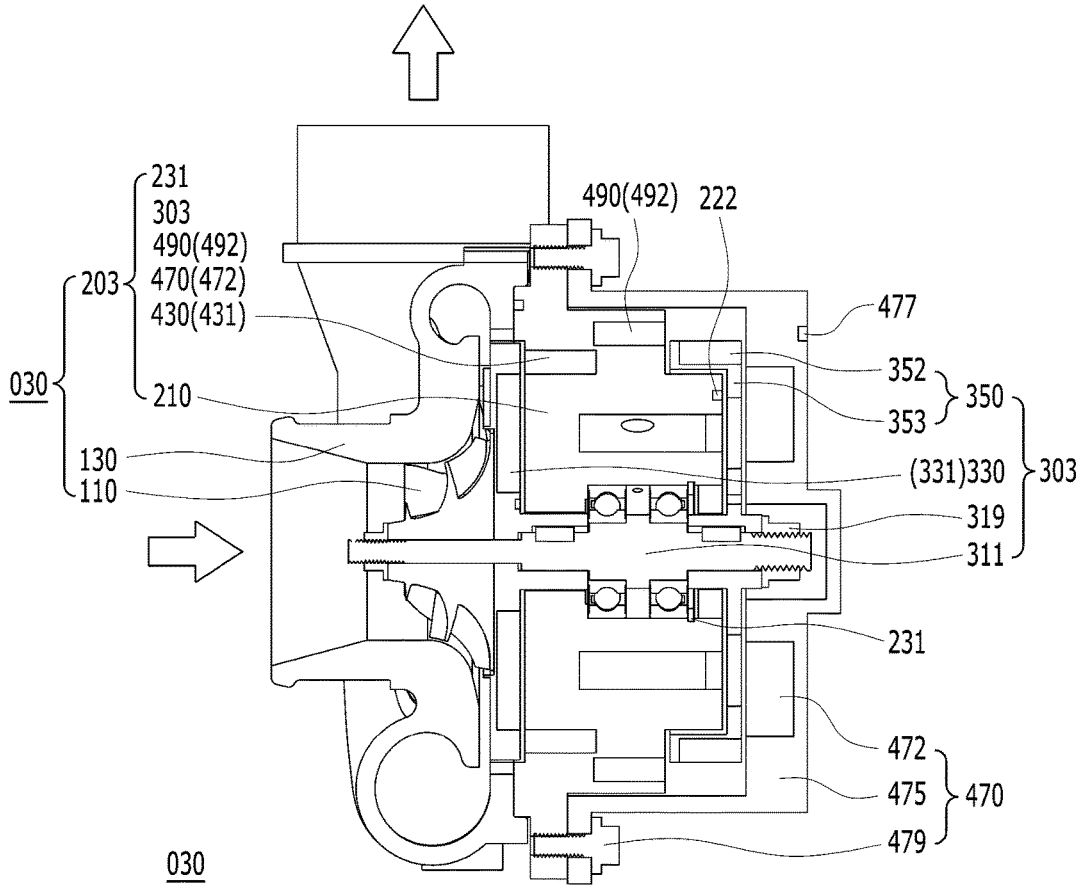
FIG. 13 is a perspective view illustrating an air charging apparatus (030) increasing a driving force by increasing a contact area of a magnetic field according to a third embodiment of the present invention.
Figure 14:
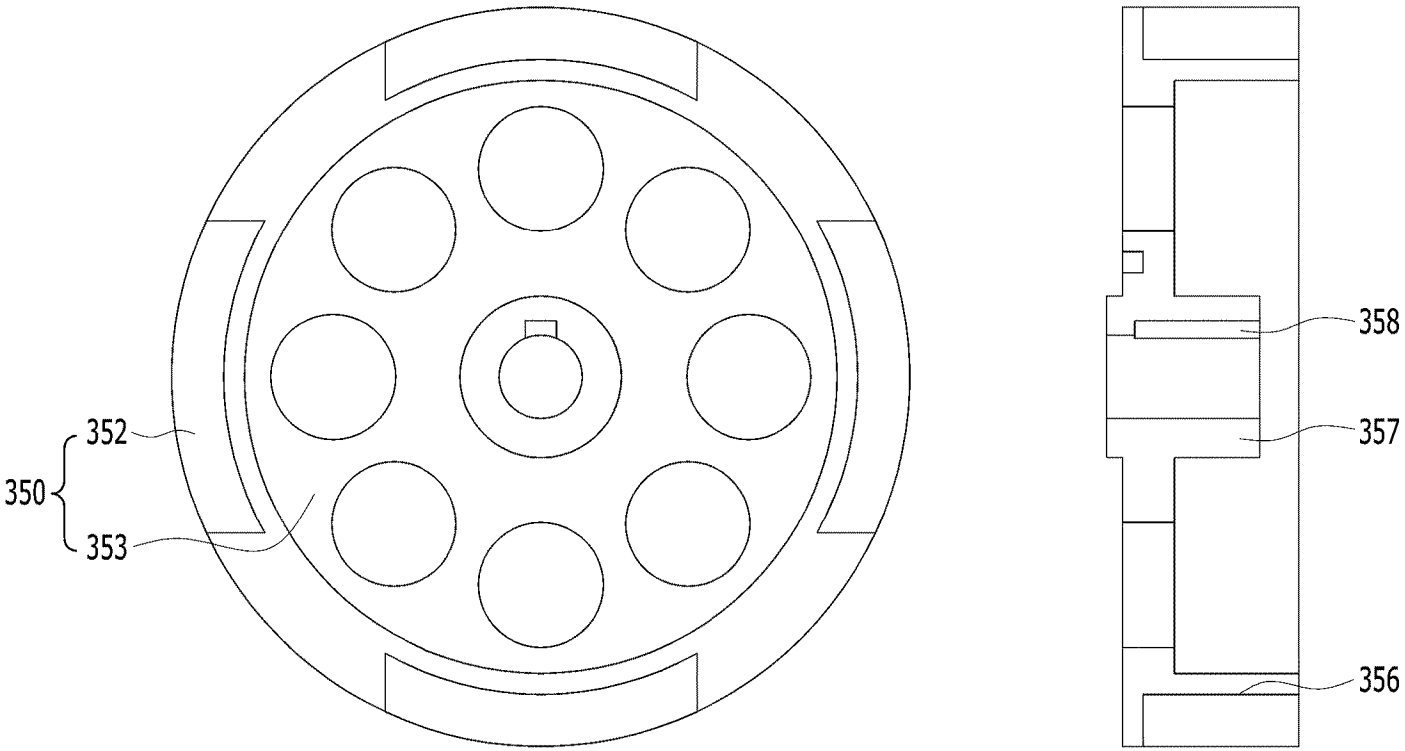
FIG. 14 is a perspective view illustrating a rear rotator according to a third embodiment of the present invention.

In the above configuration, the rear rotator 350 of the complex rotating body 303, as shown in FIGS. 13 and 14, may include a cylindrical protrusion 357 protruding in forward and backward directions from the center of the body having a cylindrical shape, one side of which is closed. The cylindrical protrusion 357 may have a key groove 358 formed in the inner circumferential surface thereof. Permanent magnet holes 356 may be formed in alignment with the key groove 358 and may be formed at a uniform interval in an axial direction of the frame 210. Permanent magnets 352 may be buried in the permanent magnet holes 356 of a rear rotational plate 353 such that N-pole and S-pole are alternately disposed in alignment with the key groove 358.

Specifically, the rear rotator 350 of the complex rotating body 303 may include the rear rotational plate 353 having the cylindrical protrusion 357 protruding in forward and backward directions from the center of the body having a cylindrical shape, one side of which is closed, having the key groove 358 formed in the inner circumferential surface thereof and fixing the status, and having 2n (hereinafter, n is an integer equal to or greater than 2) permanent magnet holes 356 formed in alignment with the key groove 358 and formed at a uniform interval in an axial direction of the frame 210, and 2n permanent magnets 352 disposed such that N-pole and S-pole are alternately buried in the permanent magnet holes 356 of the rear rotational plate 353 in alignment with the key groove 358 and the magnetic flux is disposed toward the axial diameter direction of the frame 210.

Figure 15:
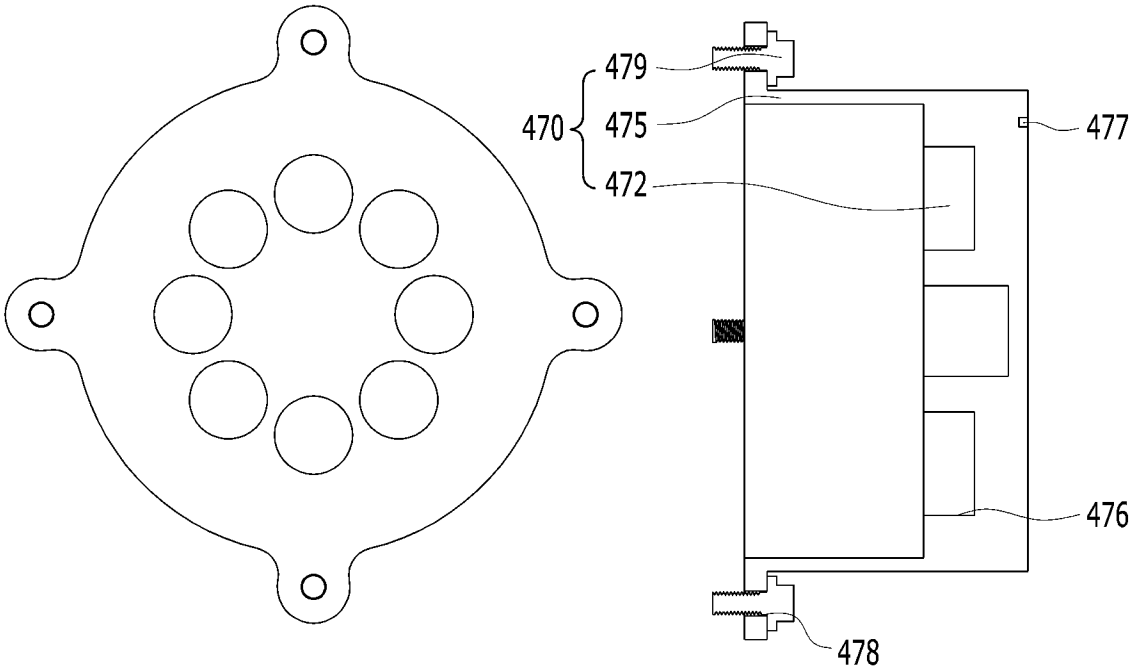
FIG. 15 is a perspective view illustrating a rear driver of the fixing support according to a third embodiment of the present invention.

The rear driver 470 of the fixing support, as shown in FIGS. 13 and 15, may include a fixing support 475 having a cylindrical body, one side surface of which is closed, and having permanent magnet holes 476 formed at a uniform interval in the closed surface of the body in alignment with a reference point 477 in a circumferential axial direction around the rear rotator 350. The fixing support may include a protrusion in the outer circumferential surface of the body to form bolt holes 478 for fixing to the frame 210. The permanent magnets 472 may be buried in the permanent magnet holes 476 of the fixing support 475 such that N-pole and S-pole are alternately disposed in alignment with the reference point 477. The rear driver 470 of the fixing support may be fixed to the frame 210 by bolts 479.

Specifically, the rear driver 470 of the fixing support may include the fixing support 475 having a cylindrical body, one side surface of which is closed and the inner surface of which has 2n (hereinafter, n is an integer equal to or greater than 4) permanent magnet holes 476 formed at a uniform interval in alignment with the reference point 477 in a circumferential axial direction around the rear rotator 350 and having a protrusion in the outer circumferential surface of the body to form the bolt holes 478 for fixing to the frame 210, 2n permanent magnets 472 buried in the permanent magnet holes 476 of the fixing support 475 such that N-pole and S-pole are alternately disposed in alignment with the reference point 477 and the magnetic flux is disposed toward the axial direction of the frame 210, and the bolts 479 fixed to the frame 210.

The rear driver 490, as shown in FIG. 13, may be configured to include permanent magnets 492. The permanent magnet 492 may be buried in the permanent magnet holes 223 in the rear surface of the frame 210 such that N-pole and S-pole are alternately disposed in alignment with the rear reference point 222 of the frame 210.

Specifically, the rear driver 490 may include 2n (n is an integer equal to or greater than 4) permanent magnets 492 which are buried in the permanent magnet holes 223 in the rear surface of the frame 210 such that N-pole and S-pole are alternately disposed in alignment with the rear reference point 222 of the frame 210 and the magnetic flux is disposed toward an axial direction of the frame 210.

Hereinafter, the combination structure of the components will be described in detail.

Instead of the rear rotator 340, the frame 210 mounted with the front driver 430 and the rear driver 440, and the rear driver 450 of the fixing support among the components of the first embodiment, the rear rotator 350 having a magnetic flux direction toward an axial diameter direction of the frame 210, the frame 210 mounted with the front driver 430 and the rear driver 490 having a magnetic flux direction toward the axial direction of the frame 210, and the rear driver of the fixing support having a magnetic flux toward an axial direction of the frame 210 may be provided.

That is, similarly to the first embodiment, the rear rotator 350 may be mounted onto the rotation axis 323 of the bearing module 311 of the complex rotating body 323, and may be fixed by the lock nut 319. Thereafter, the rear driver 470 of the fixing support may be fixed to the frame 210 by the bolts 479 in alignment with the reference point 477 of the rear driver 470 of the fixing support and the rear reference point 222 of the frame 210. Hereinafter, the process may be implemented and finished similarly to the first embodiment.

Hereinafter, the action and the operation of the components will be described.

In a vehicle having durability to supercharging, the rotating body accelerator 203 may be mounted between the air filter and the inlet pipe of the internal combustion engine, and may form a magnetic torque by interaction with the intake negative pressure varying with the load of the internal combustion engine, thereby operating the impeller 110 and thus compressing or pressurizing air to supply air to the inlet pipe of the internal combustion engine.

In the rotating body accelerator 203, the permanent magnets 352 of the rear rotator 350 of the complex rotating body 303 may be disposed such that the direction of the magnetic field faces the axial diameter direction of the frame 210 and N-pole and S-pole are alternately disposed, and the permanent magnets 492 and 472 of the rear driver 490 and the rear driver 470 of the fixing support may be disposed such that the direction of the magnetic field faces the axial direction of the frame 210 and N-pole and S-pole are alternately disposed. Thus, the rear driver 490 and the rear driver 470 of the fixing support may face the rear rotator 350 at a certain gap in an orthogonal direction, and the magnetic flux of the permanent magnets 352 of the rear rotator 350 which are rotated by the intake negative pressure in a magnetic field formed therearound may form a virtual magnetic field rotational moment axis, reacting with the permanent magnets 492 and 472 of the rear diver 490 and the rear driver 470 of the fixing support by an interaction of an attractive force and a repulsive force of the magnetic flux and thus generating a magnetic torque and driving the impeller 110.

Accordingly, the interaction contact area of the permanent magnet 352 of the rear rotator 350 and the permanent magnet 492 and 472 of the rear driver 490 and the rear driver 470 of the fixing support can be broadened. Thus, the torque of the complex rotating body 303 and the impeller 110 can be increased, compressing and pressurizing air and thus increasing the air density and the flow rate. Accordingly, air volume flow corresponding to the characteristics of the internal combustion engine and the vehicle can be supplied, increasing the volumetric efficiency.

Hereinafter, components, and combination structures, actions and operations thereof according to a fourth embodiment will be described.

First, the components will be described with reference to the accompanying drawings.

Figure 16:
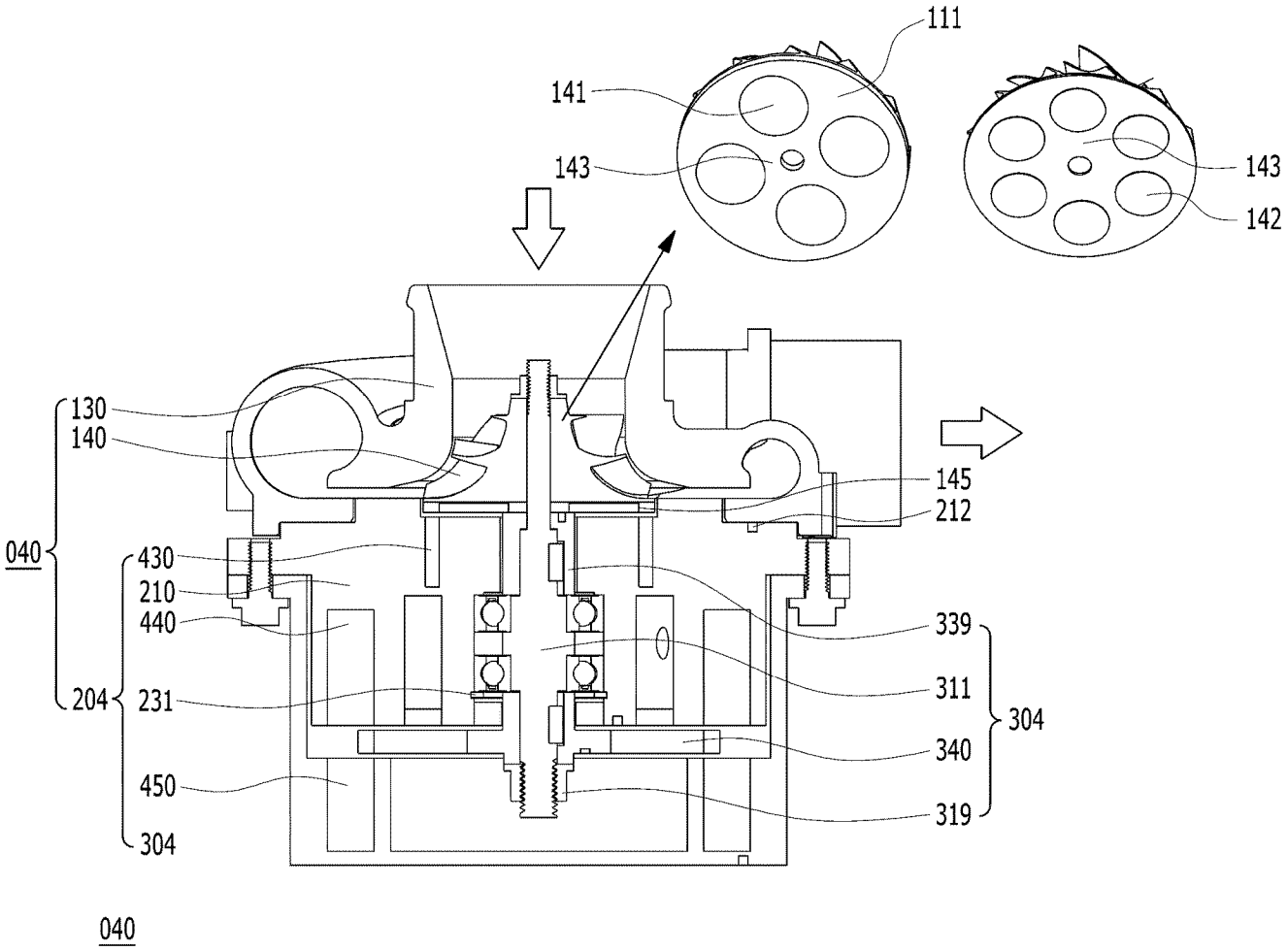
FIG. 16 is a perspective view illustrating an air charging apparatus (040) assigning a driving function to an impeller according to a fourth embodiment of the present invention.
Figure 24:
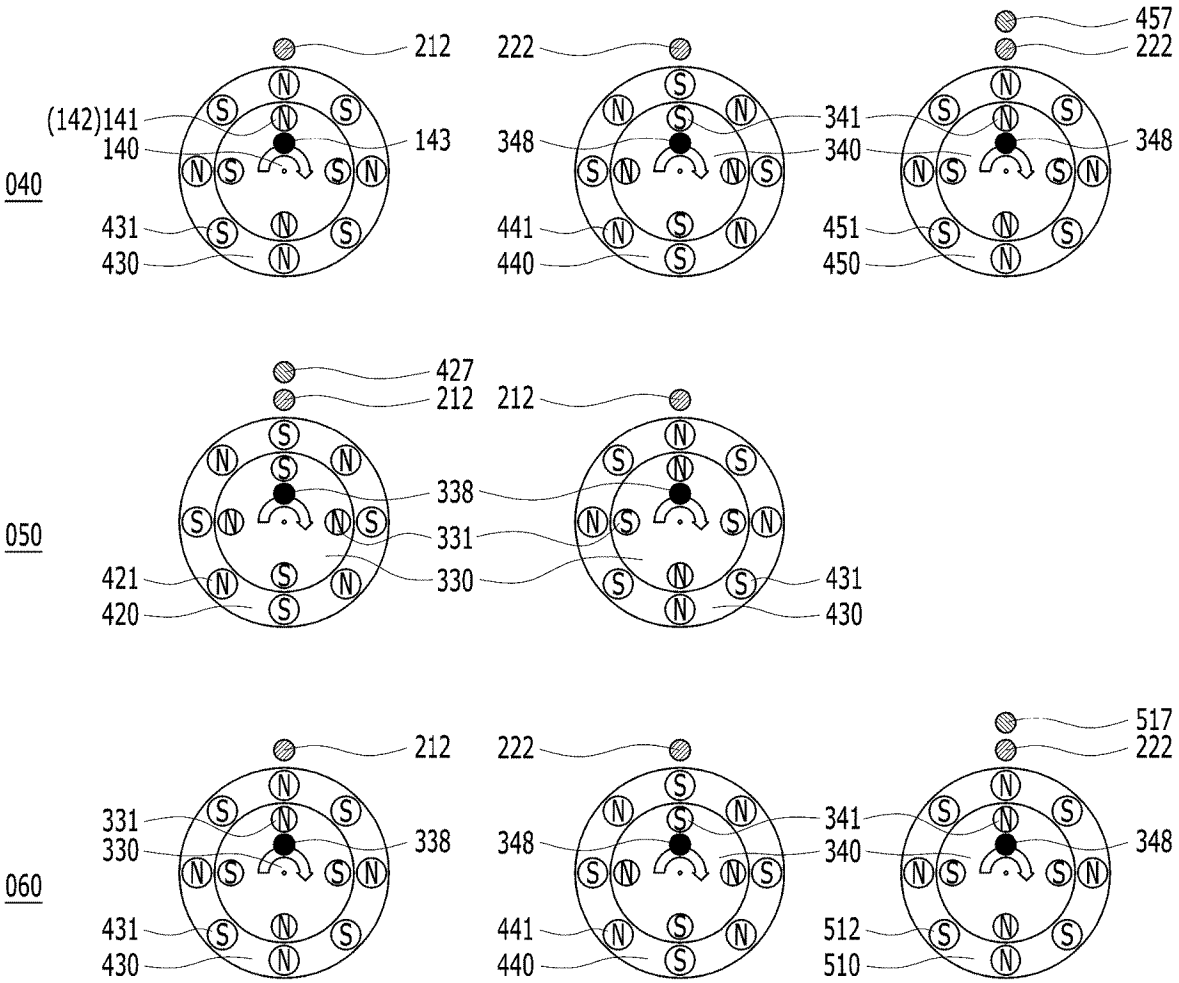

Compared to the first embodiment, as shown in FIGS. 16 and 24, instead of the impeller 110, the front rotator 330 of the complex rotating body 301 including the permanent magnets 331, and the frame 210 equipped with the front driver 430 such that the permanent magnet holes 213 are formed on the front surface thereof in the circumferential axial direction around the front rotator 330, in this embodiment 040, the impeller 140 may have the permanent magnet holes 145 formed on the axial line of the circumference at a uniform interval in alignment with the reference point 143 on the rear surface of the circular plate 111 of the body. The permanent magnets 141 may be buried in the permanent magnet holes 145 such that N-pole and S-pole are alternately disposed in alignment with the reference point 143, or the magnet coatings 142 may be disposed at a uniform interval in alignment with the reference point 143 on the rear surface of the circular plate 111 of the body such that N-pole and S-pole are alternately disposed on the axial line of the circumference. In the rotating body accelerator 204, the complex rotating body 304 may use the front rotator 330 as the spacer 339, and the frame 210 may have the permanent magnet holes 213 formed at a uniform interval on the front surface thereof and formed in a circumferential axial direction around the impeller 140.

Also, since other configurations are similar to those of the first embodiment, a detailed description thereof will be omitted by referring to the same reference numbers of FIGS. 1 and 22.

Specifically, the impeller 140 may have 2n (hereinafter, n is an integer equal to or greater than 2) permanent magnet holes 145 formed on the axial line of the circumference at a uniform interval in alignment with a reference point 143 on the rear surface of a circular plate 111 of the body. 2n permanent magnets 141 may be buried in the permanent magnet holes 145 such that N-pole and S-pole are alternately disposed in the reference point 143 in an axial direction of the frame, or 2n magnet coatings 142 may be disposed at a uniform interval in alignment with the reference point 143 on the rear surface of the circular plate 111 such that N-pole and S-pole are alternately disposed on the axial line of the circumference. In the rotating body accelerator 204, the complex rotating body 304 may use the front rotator 330 as a spacer 339, and the frame 210 may have 2n (n is an integer equal to or greater than 4) permanent magnet holes 213 formed at a uniform interval on the front surface thereof and formed in a circumferential axial direction around the impeller 140.

Hereinafter, the combination structure of the components will be described in detail.

Among the components of the first embodiment, instead of the impeller 110, the front rotator 330 of the complex rotating body 301 including the permanent magnets 331, and the frame 210 equipped with the front driver 430 having the permanent magnet holes 213 formed in a circumferential axial direction around the front rotator 330, the impeller 140 in which the permanent magnets 141 are buried in the rear surface of the circular plate 111 or the magnetic coating 142 is formed, the spacer 339 of the complex rotating body 304, and the frame 210 equipped with the front driver 430 having the permanent magnet holes 213 formed on the front surface thereof in a circumferential axial direction around the impeller 140 may be provided.

That is, similarly to the first embodiment, the spacer 339 and the impeller 140 may be together mounted onto the rotation axis 323 of the bearing module 311 at the front side of the frame 210, and may be fixed by the lock nut 319. Hereinafter, the process may be implemented and finished similarly to the first embodiment.

Hereinafter, the action and the operation of the components will be described.

In a vehicle having durability to supercharging, the rotating body accelerator 204 may be mounted between the air filter and the inlet pipe of the internal combustion engine, and may form a magnetic torque by interaction with the intake negative pressure varying with the load of the internal combustion engine, thereby operating the impeller 140 and thus compressing air to supply air to the inlet pipe of the internal combustion engine.

In the above configuration, an accelerating rotation function which the front rotator 330 performs may be assigned to the impeller 140, and the inertia moment of the complex rotating body 304 may be reduced, relatively increasing the responsibility to the load variation and thus increasing the torque. Thus, the impeller 140 may be driven to compress air and increase the air density and the flow rate, supplying air volume flow corresponding to the characteristics of the internal combustion engine and the vehicle and thus increasing the volumetric efficiency.

Hereinafter, components, and combination structures, actions and operations thereof according to a fifth embodiment will be described.

First, the components will be described with reference to the accompanying drawings.

Figure 17:
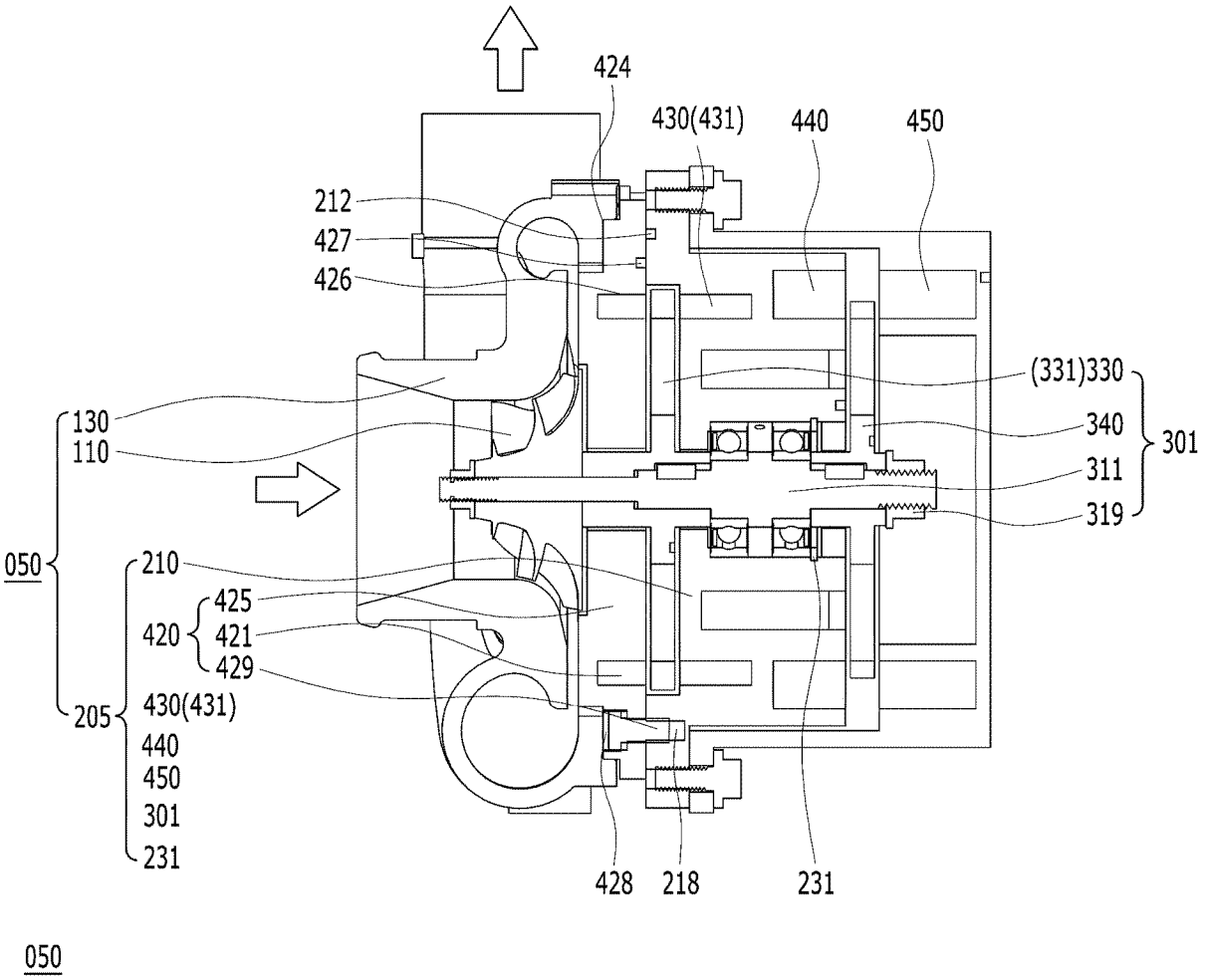
FIG. 17 is a perspective view illustrating an air charging apparatus (050) added with a front driving device according to a fifth embodiment of the present invention.

Compared to the first embodiment, as shown in FIGS. 17 and 24, in this embodiment 050, a front driving device 420 may be added to a rotating body accelerator 201. The front driving device 420 may include a front fixing support 425 having permanent magnet holes 426 formed at a uniform interval in one side surface of the body in alignment with a reference point 427 on the same axial line of the circumference as the permanent magnet holes 213 in the front surface of the frame 210 and having an impeller case mounting surface 424 and bolt holes 428 for fixing to the frame 210 formed in the other side surface of the body. The permanent magnets 421 may be buried in the permanent magnet holes 426 of the front fixing support 425 such that N-pole and S-pole are alternately disposed in alignment with the reference point 427. The front driving device 420 may be fixed to the frame 210 by bolts 429.

Also, since other configurations are similar to those of the first embodiment, a detailed description thereof will be omitted by referring to the same reference numbers of FIGS. 1 and 22.

Specifically, the rotating body accelerator 205 may include the front fixing support 425 having a cylindrical body, having 2n (hereinafter, n is an integer equal to or greater than 4) permanent magnet holes 426 formed at a uniform interval in alignment with the reference point 427 in one side surface of the body on the same axial line of the circumference as the permanent magnet holes 213 in the front surface of the frame 210, and having the impeller case mounting surface 424 and the bolt holes 428 for fixing to the frame 210 in the other side surface of the body, 2n permanent magnets 421 buried in the permanent magnet holes 426 of the front fixing support 425 such that N-pole and S-pole are alternately disposed in alignment with the reference point 427 and the magnetic flux is disposed toward the axial diameter direction of the frame 210, and the bolts 429 fixed to the frame 210.

Here, the frame 210 may have bolt holes 218 for fixing the front driving device 420 formed in the front surface thereof. The blade 334 formed in the front surface of the front rotator 330 of the complex rotating body 301 may be removed. The front rotator 330 of the complex rotating body may include a cylindrical protrusion onto which the impeller is mounted.

Hereinafter, the combination structure of the components will be described in detail.

In addition to the configuration of the first embodiment, the front driving device 420 may be provided.

That is, while implemented in the same process as the first embodiment, the front driving device 420 may be fixed to the frame 210 by bolts 429 in alignment with the reference point 427 of the front driving device 420 and the front reference point 212 of the frame 210 when the front rotator 330 is mounted. Also, the impeller case 130 may be mounted onto the impeller case mounting surface 424 of the front driving device 420, and may be fixed by the impeller case bolts 135. Hereinafter, the process may be implemented and finished similarly to the first embodiment.

Hereinafter, the action and the operation of the components will be described.

In a vehicle having durability to supercharging, the rotating body accelerator 205 may be mounted between the air filter and the inlet pipe of the internal combustion engine, and may form a magnetic torque by interaction with the intake negative pressure varying with the load of the internal combustion engine, thereby operating the impeller 110 and thus compressing or pressurizing air to supply air to the inlet pipe of the internal combustion engine.

In the above configuration, the contact area of the permanent magnets of the rotating body accelerator 205 may be broadened. Thus, the permanent magnets 331 of the front rotator 330 of the complex rotating body 301 may react with the permanent magnets 421 of the front driving device 420 and the permanent magnet 431 of the front driver 430 by an interaction of an attractive force and a repulsive force of the magnetic flux. Thus, the torque of the complex rotating body 301 and the impeller 110 can be increased, sucking air and producing expanded air or accelerated air and thus increasing the air density and the flow rate. Accordingly, air volume flow corresponding to the characteristics of the internal combustion engine and the vehicle can be supplied, increasing the volumetric efficiency.

Hereinafter, components, and combination structures, actions and operations thereof according to a sixth embodiment will be described.

First, the components will be described with reference to the accompanying drawings.

Compared to the first embodiment, as shown in FIGS. 18 to 21 and 24, in this embodiment 060, a rotating body accelerator 206 may produce power with a rear driver of the fixing support 510 including coils instead of the rear driver 450 of the fixing support including the permanent magnets 451. AC power produced by the rear driver 510 of the fixing support may be converted into DC power to be transmitted to a storage battery 550 by a relay module 530.

Also, since other configurations are similar to those of the first embodiment, a detailed description thereof will be omitted by referring to the same reference numbers of FIGS. 1 and 22.

Specifically, the rotating body accelerator 206 may be added with the relay module 530. The rear driver 510 of the fixing support may produce three-phase AC power, and three-phase AC power produced by the rear driver 510 of the fixing support may be converted into DC power to be transmitted to the storage battery 550 by the relay module 530.

Figure 18:
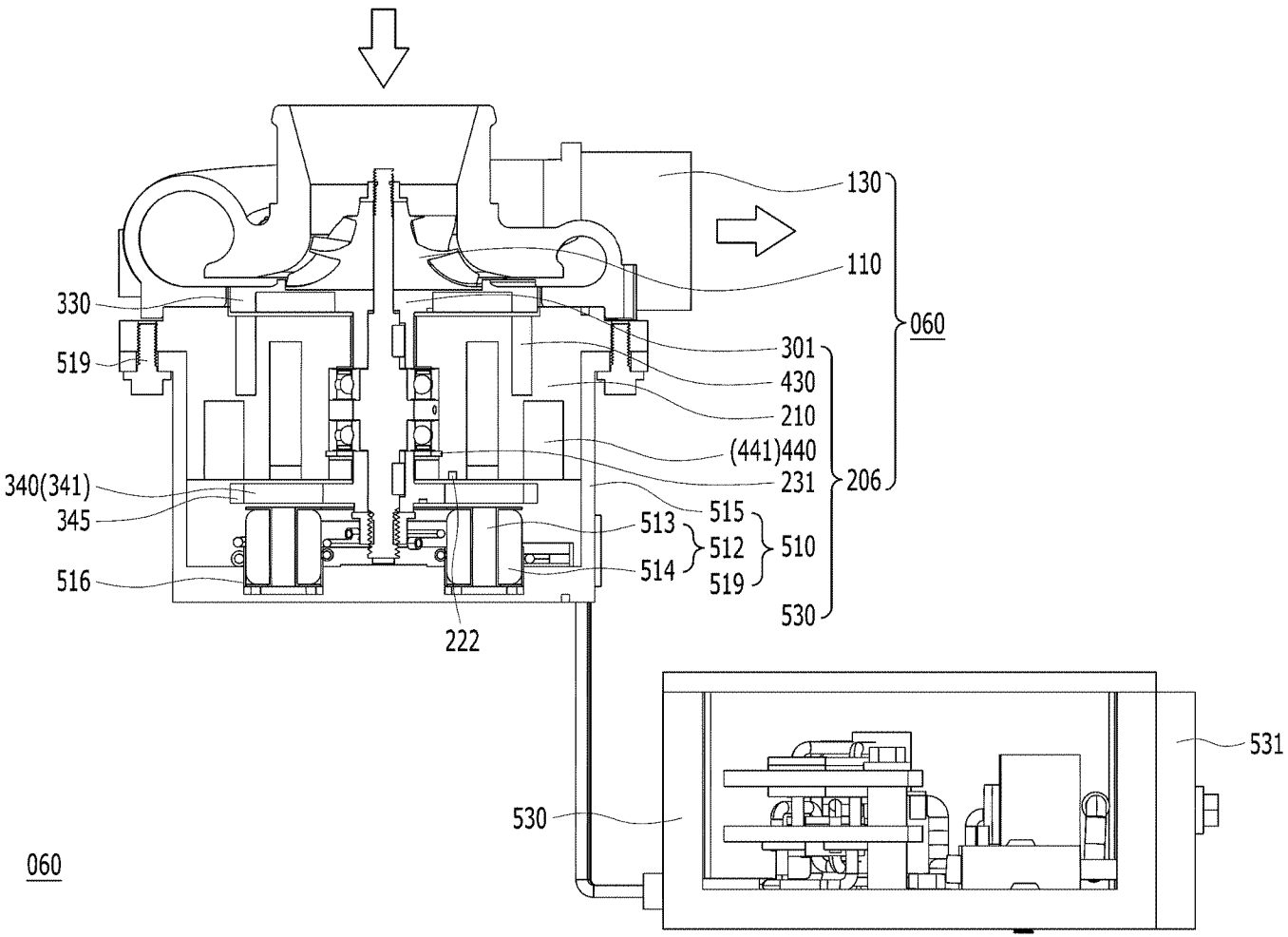
FIG. 18 is a perspective view illustrating an air charging apparatus (060) simultaneously performing air supply and generation according to a sixth embodiment of the present invention.
Figure 19:
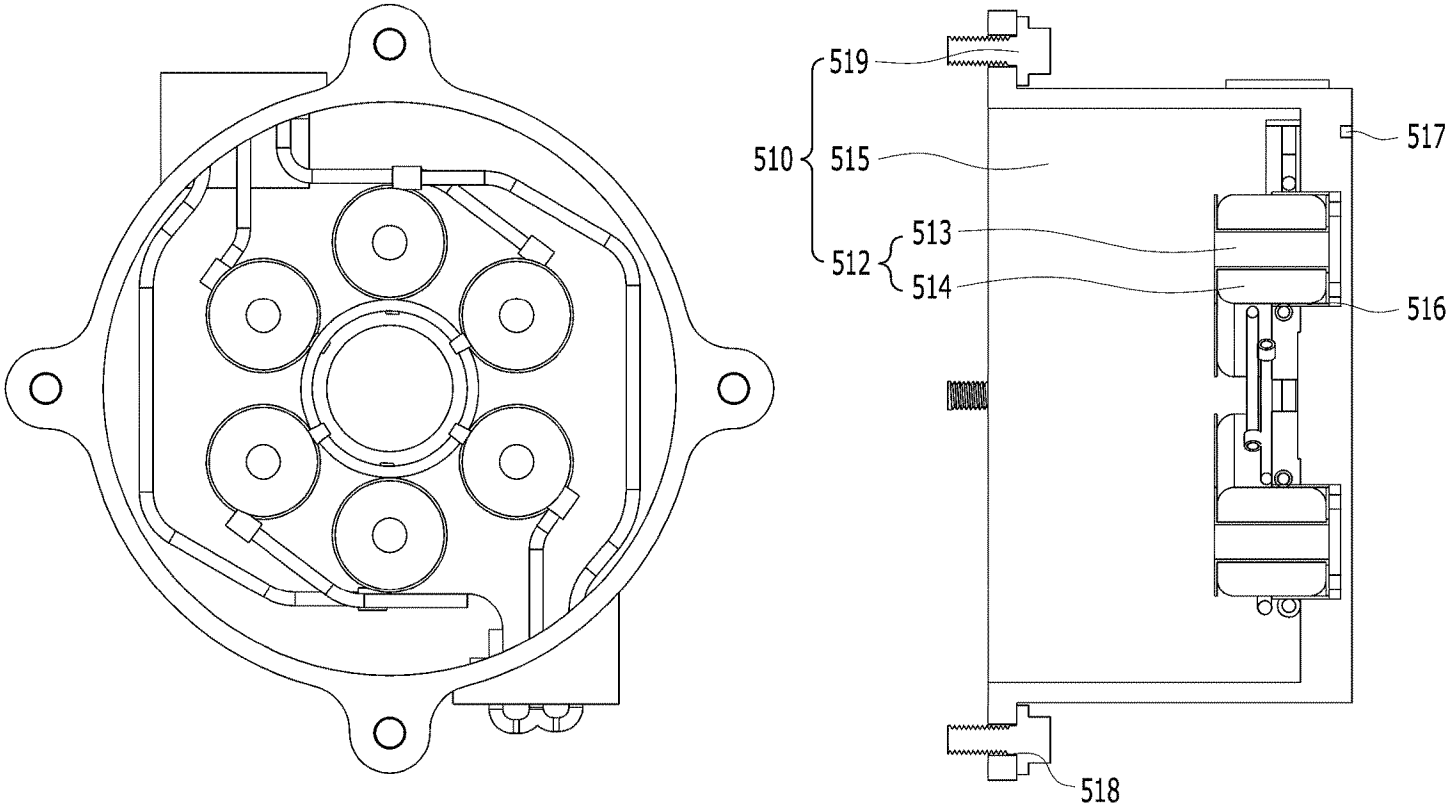
FIG. 19 is a perspective view illustrating a rear driver of the fixing support according to a sixth embodiment of the present invention.
Figure 20:
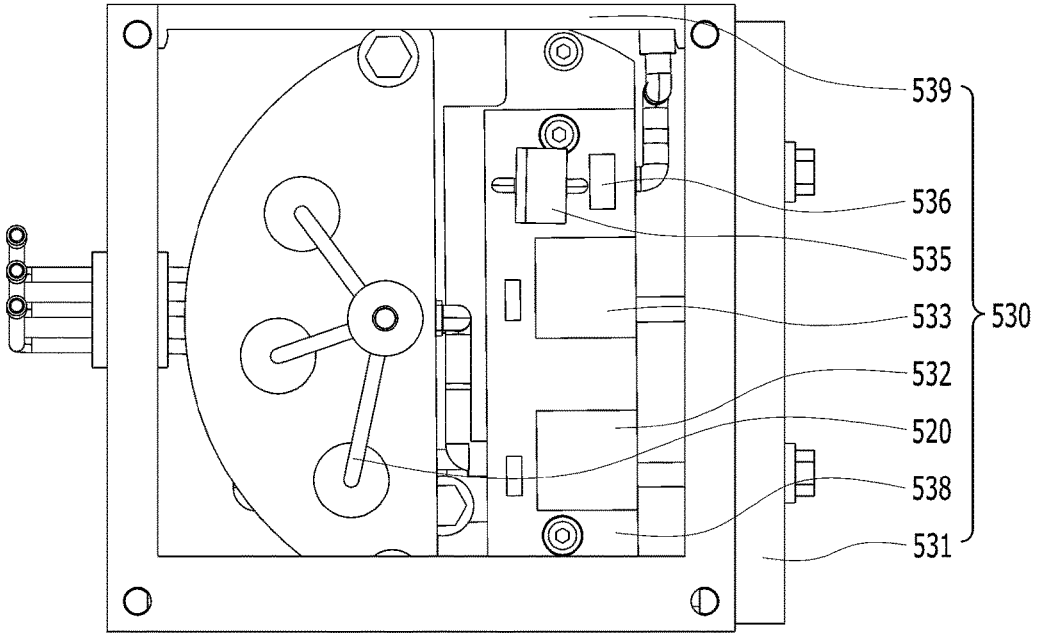
FIG. 20 is a perspective view illustrating a relay module according to a sixth embodiment of the present invention.
Figure 21:
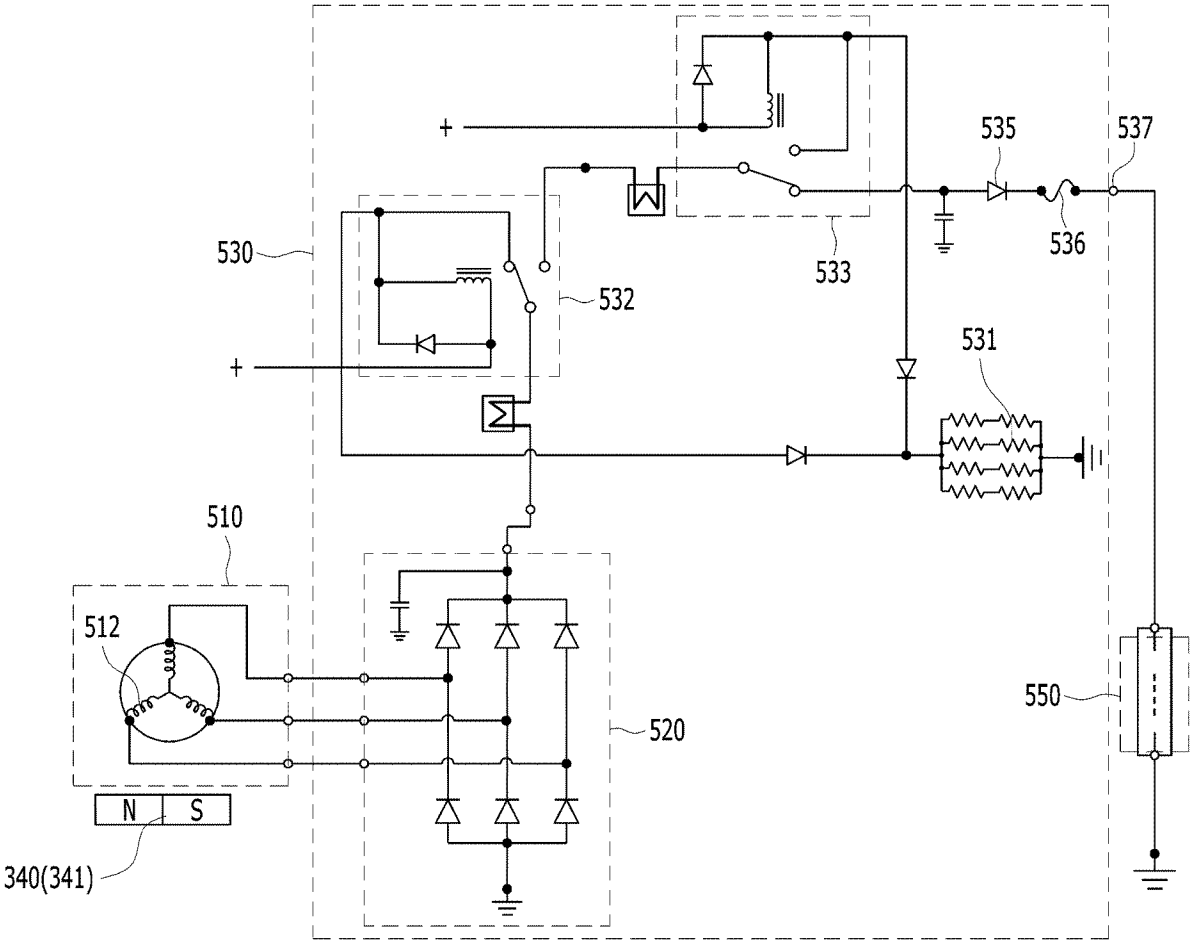
FIG. 21 is a circuit view illustrating a power generator according to a sixth embodiment of the present invention.

The relay module 530, as shown in FIGS. 18, 20 and 21, may convert three-phase AC power produced by the rear driver 510 of the fixing support into DC power, and relays 532 and 533 may transmit power necessary for charging of the storage battery 550. Other power may be consumed in load dummy 531.

Specifically, the relay module 530 may include a rectifier 520 converting three-phase AC power into DC power, a relay 532 outputting power when an output voltage reaches a certain voltage effective for charging of the storage battery 550 and thus the contact is closed, a relay 533 connected to an output side of the relay 532 to transmit generation power to the storage battery 550 and preventing the storage battery 550 from being overcharged by transmitting generation power to the load dummy 531 when the output voltage reaches a voltage effective for charge of the storage battery 550 and the contact is opened, the load dummy 531 consuming generation power received from the relays 532 and 533, and a reverse current preventing device 535 for preventing a reversal of a current from the storage battery 550, fuses 536, an installation member 538 mounted with the fuses 536, and a case 539.

Hereinafter, the combination structure of the components will be described in detail.

Instead of the rear driver 450 of the fixing support including the permanent magnets 451 among the components of the first embodiment, the rear driver 510 of the fixing support including armature coils 512 and the relay module 530 may be provided.

That is, while implemented in the same process as the first embodiment, the rear driver 510 of the fixing support may be fixed to the frame 210 by bolts 519 in alignment with the reference point 517 of the rear driver 510 of the fixing support and the rear reference point 222 of the frame 210, and the relay module 530 may be connected. Hereinafter, the process may be implemented and finished similarly to the first embodiment.

Hereinafter, the action and the operation of the components will be described.

In a vehicle having durability to supercharging, the rotating body accelerator 206 may be mounted between the air filter and the inlet pipe of the internal combustion engine, and may form a magnetic torque by interaction with the intake negative pressure varying with the load of the internal combustion engine, thereby operating the impeller 110 and thus compressing or pressurizing air to supply air to the inlet pipe of the internal combustion engine and producing and supplying power to the storage battery.

In the rotating body accelerator 206, the front rotator 330 and the rear rotator 340 of the complex rotating body 301 may rotate in response to the front driver 430 and the rear driver 440 to drive the impeller 110. The magnetic flux may be intermitted to the armature coils 512 of the rear driver 510 of the fixing support disposed at a phase angle of about 120 degrees facing the rear rotator 340 of the complex rotating body 301 at a certain gap, generating an induced electromotive force and thus producing three-phase AC power. The relays 532 and 533 of the relay module 530 may operate when a vehicle starts up and the power supply is connected. Three-phase AC power produced by the rear driver 510 of the fixing support may be converted into DC power by the rectifier 520 and thus generation power within an effective voltage range may be transmitted for charging of the storage battery 550. Other generation power may be consumed in the load dummy 531 and generated heat may be cooled by head wind during the driving.

Accordingly, air may be compressed or pressurized to be supplied to the intake pipe of the internal combustion engine, and power produced by the rear driver 510 of the fixing support may be supplied within an effective voltage range for charging of the storage battery. Thus, the charging state of the storage battery 550 may be maintained good, minimizing the power generation load for charging the storage battery 550 of a vehicle and thus reducing the fuel consumption for power generation. Also, power may be separately supplied to the storage battery 550, allowing external power consuming devices to operate and thus saving the power generation cost without giving a power generation load to the internal combustion engine.

Hereinafter, components, and combination structures, actions and operations thereof according to a seventh embodiment will be described.

First, the components will be described with reference to the accompanying drawings.

Figure 25:
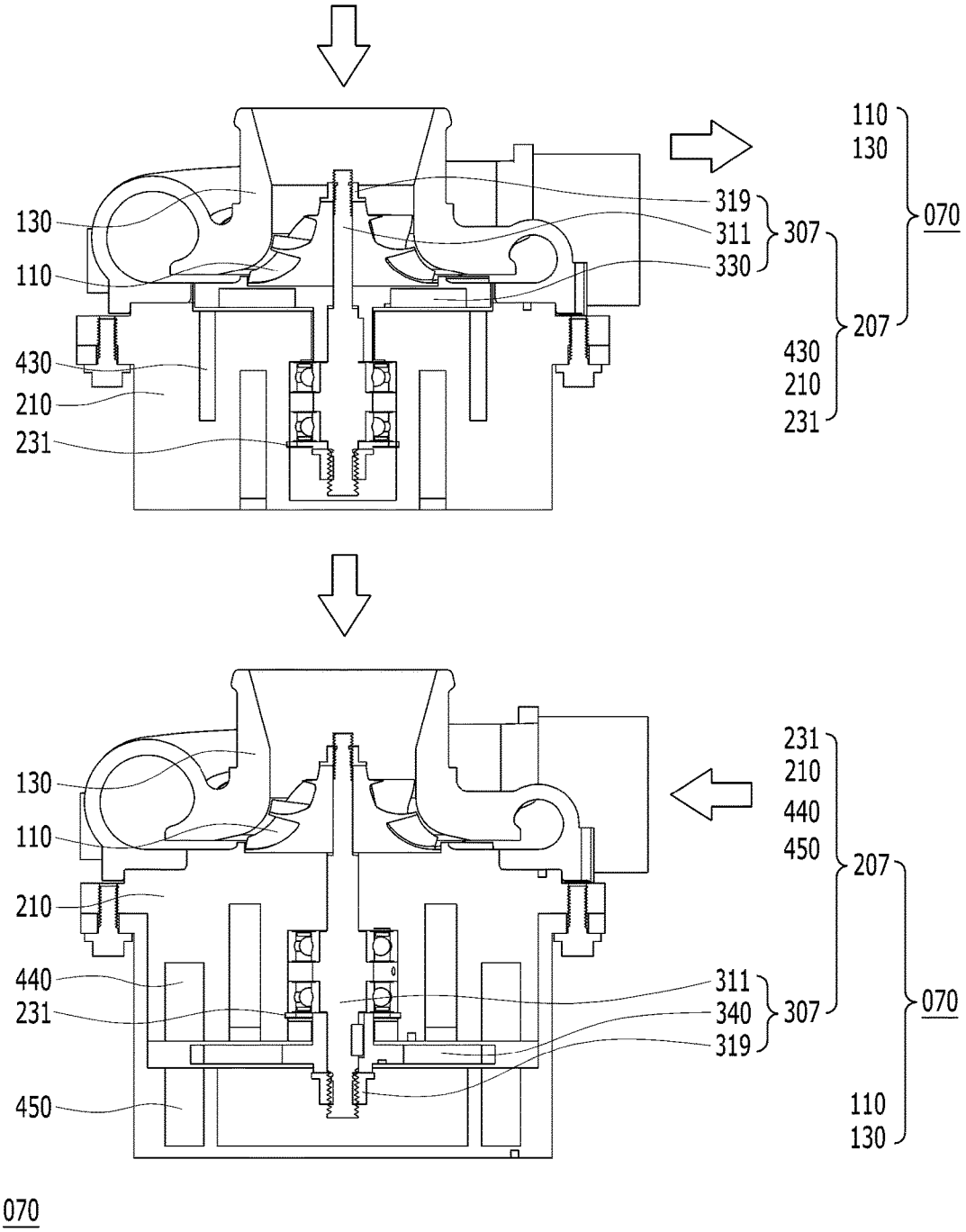
FIG. 25 is a perspective view illustrating an air charging apparatus (070) equipped with one rotator according to a seventh embodiment of the present invention.

Compared to the first embodiment, as shown in FIG. 25, this embodiment 070 may include a rotating body accelerator 207 including a complex rotating body 307 including one of the front rotator 330 and the rear rotator 340 instead of the complex rotating body 301 including the front rotator 330 and the rear rotator 340.

Also, since other configurations are similar to those of the first embodiment, a detailed description thereof will be omitted by referring to the same reference numbers of FIGS. 1 and 22.

Here, the frame 210 may be mounted with one of the front driver 430 and the rear driver 440, and the bearing module 311 of the complex rotating body 307 may be mounted with a key 322 for fixing the status of one of the front rotator 330 and the rear rotator 340.

Specifically, the rotating body accelerator 207 may include the complex rotating body 307 including one of the front rotator 330 and the rear rotator 340.

Hereinafter, the combination structure of the components will be described in detail.

Among the components of the first embodiment, the complex rotating body 307 including one of the front rotator 330 and the rear rotator 340 may be provided instead of the complex rotating body 301 including the front rotator 330 and the rear rotator 340.

That is, while being implemented in the same process as the first embodiment, the complex rotating body 307 including one of the front rotator 330 and the rear rotator 340 of the complex rotating body 301 may be fixed to the frame 210 by the fixture 231 such as the snap ring or the lock nut, and then may be implemented and finished similarly to the first embodiment.

Hereinafter, the action and the operation of the components will be described.

In a vehicle having durability to supercharging, the rotating body accelerator 207 may be mounted between the air filter and the inlet pipe of the internal combustion engine, and may form a magnetic torque by interaction with the intake negative pressure varying with the load of the internal combustion engine, thereby operating the impeller 110 and thus compressing or pressurizing air to supply air to the inlet pipe of the internal combustion engine.

In the above configuration, the rotating body accelerator 207 may operate the impeller 110 to compress or pressurize air to increase the air density and the flow rate. Thus, various kinds of air supply devices for supplying air volume flow corresponding to the internal combustion engine and the vehicle can be manufactured to deal with the characteristics of various internal combustion engines and the vehicles.

Hereinafter, components, and combination structures, actions and operations thereof according to an eighth embodiment will be described.

First, the components will be described with reference to the accompanying drawings.

Figure 26:
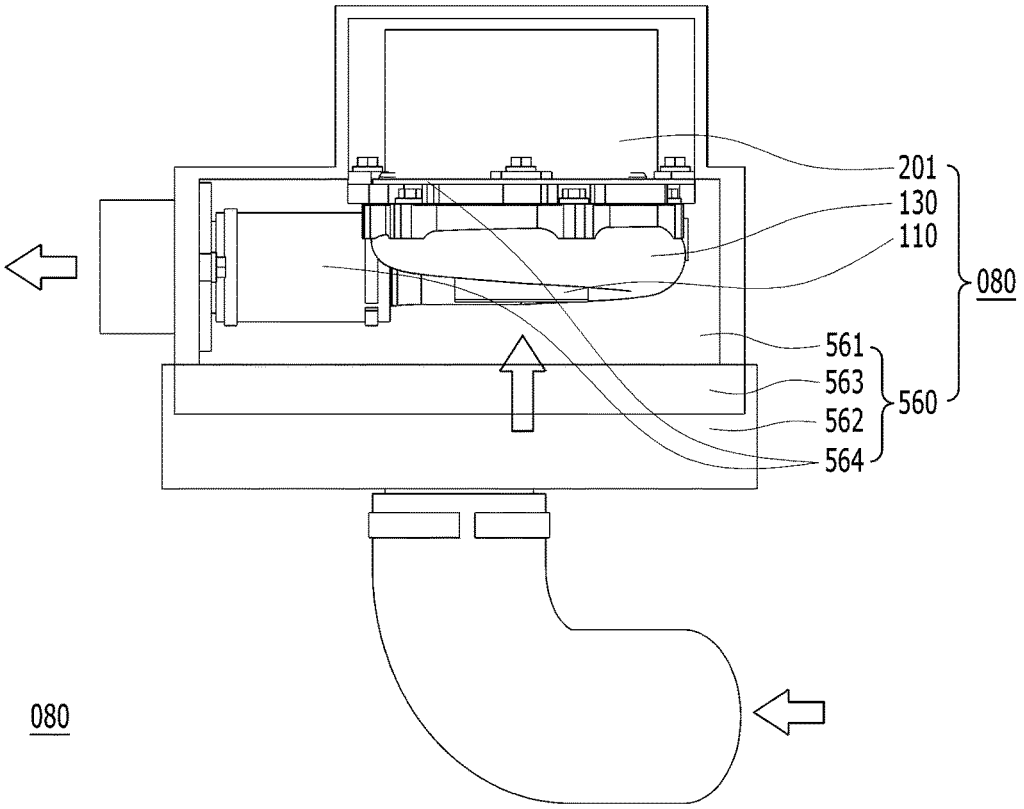
FIG. 26 is a perspective view illustrating an air charging apparatus (080) integrally added with an air filter case according to an eighth embodiment of the present invention.

Compared to the first embodiment, as shown in FIG. 26, this embodiment 080 may be added with an integral air filter case 560 including an air filter upper case 561, a connection tube 564, an air filter 563, and an air filter lower case 562, and may be embedded with the rotating body accelerator 201 equipped with the impeller 110 and the impeller case 130.

Also, since other configurations are similar to those of the first embodiment, a detailed description thereof will be omitted by referring to the same reference numbers of FIGS. 1 and 22.

Specifically, the rotating body accelerator 201 equipped with the impeller 110 and the impeller case 130 may be embedded, and the integral air filter case 560 including the air filter upper case 561, the connection tube 564, the air filter 563, and the air filter lower case 562 may be added.

Hereinafter, the combination structure of the components will be described in detail.

In addition to the components of the first embodiment, the integral air filter case 560 including the air filter upper case 561, the connection tube 564, the air filter 563, and the air filter lower case 562 may be provided.

That is, the connection tubes 564 may be mounted in the rotating body accelerator 201 equipped with the impeller 110 and the impeller case 130, and then may be mounted in the air filter upper case 561. Thereafter, the air filter 563 and the air filter lower case 562 may be mounted and finished.

Hereinafter, the action and the operation of the components will be described.

In a vehicle having durability to supercharging, the rotating body accelerator 201 may be mounted onto the inlet pipe of the internal combustion engine, and may form a magnetic torque by interaction with the intake negative pressure varying with the load of the internal combustion engine, thereby operating the impeller 110 and thus compressing or pressurizing air to supply air to the inlet pipe of the internal combustion engine.

In the above configuration, heat and noise emitted from the impeller case 130 can be cooled and absorbed by external air flowing into the integral air filter case 560. Also, the mounting space can be reduced, thereby facilitating the installation and particularly securing a larger mounting space with respect to an existing vehicle in which the arrangement of the parts of the internal combustion engine mounting chamber is determined.

Hereinafter, components, and actions and operations thereof according to a ninth embodiment will be described.

As shown in FIGS. 1, 22 and 23, in the natural aspirated vehicle and the motor cycle configured in accordance with the first embodiment 010, the rotating body accelerator 201 may be mounted between the air filter and the inlet pipe of the internal combustion engine, and may form a magnetic torque by interaction with the intake negative pressure varying with the load of the internal combustion engine, thereby operating the impeller 110 and thus compressing or pressurizing air to supply air to the inlet pipe of the internal combustion engine.

Thus, the air density and flow rate may be increased within an error correction range of the driving system and the control system of the natural aspirated vehicle and the motor cycle, and thus air volume flow may be supplied corresponding to the characteristics of the internal combustion engine and the vehicle. Accordingly, while maintaining the advantages of the natural aspirated vehicle and the motor cycle and the characteristics of natural intake having good responsibility upon load variation, the volumetric efficiency may be increased, and the carbon emission regulation may be dealt with by reducing the fuel consumption of the internal combustion engine. Thus, without giving a load to the vehicle and the internal combustion engine, the driving loss and driving noise may become lower, and the durability may become better. Also, the air supply device may use low power or may not need the driving cost, and can be easily installed without limitations of a specific location and a mounting direction.

Also, it may be selectable whether to increase the output by adjusting the amount of fuel or improve the fuel efficiency by reducing the fuel consumption as much as the volumetric efficiency of the internal combustion engine increases.

Hereinafter, components, and actions and operations thereof according to a tenth embodiment will be described.

Figure 10:
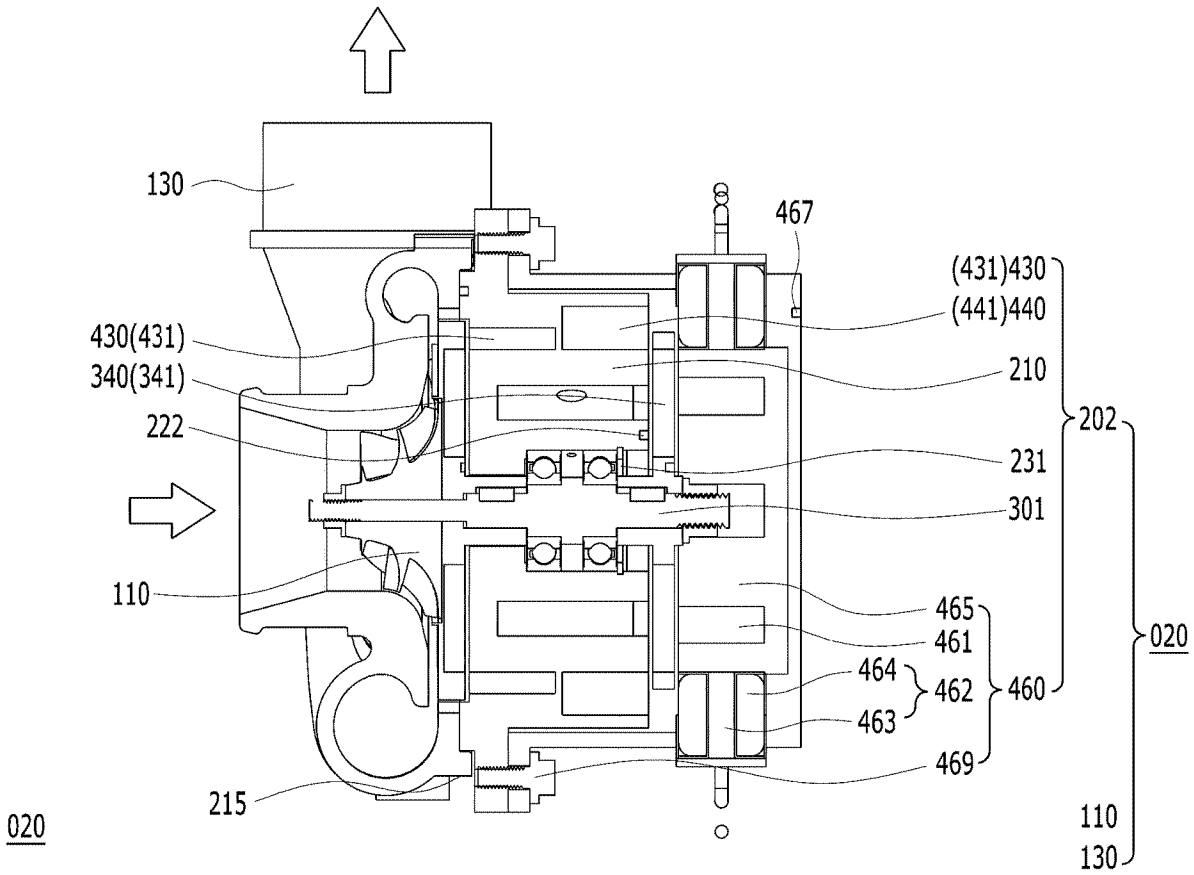
FIG. 10 is a perspective view illustrating an air charging apparatus (020) increasing and supplying air volume flow in a specific region according to a second embodiment of the present invention.
Figure 11:
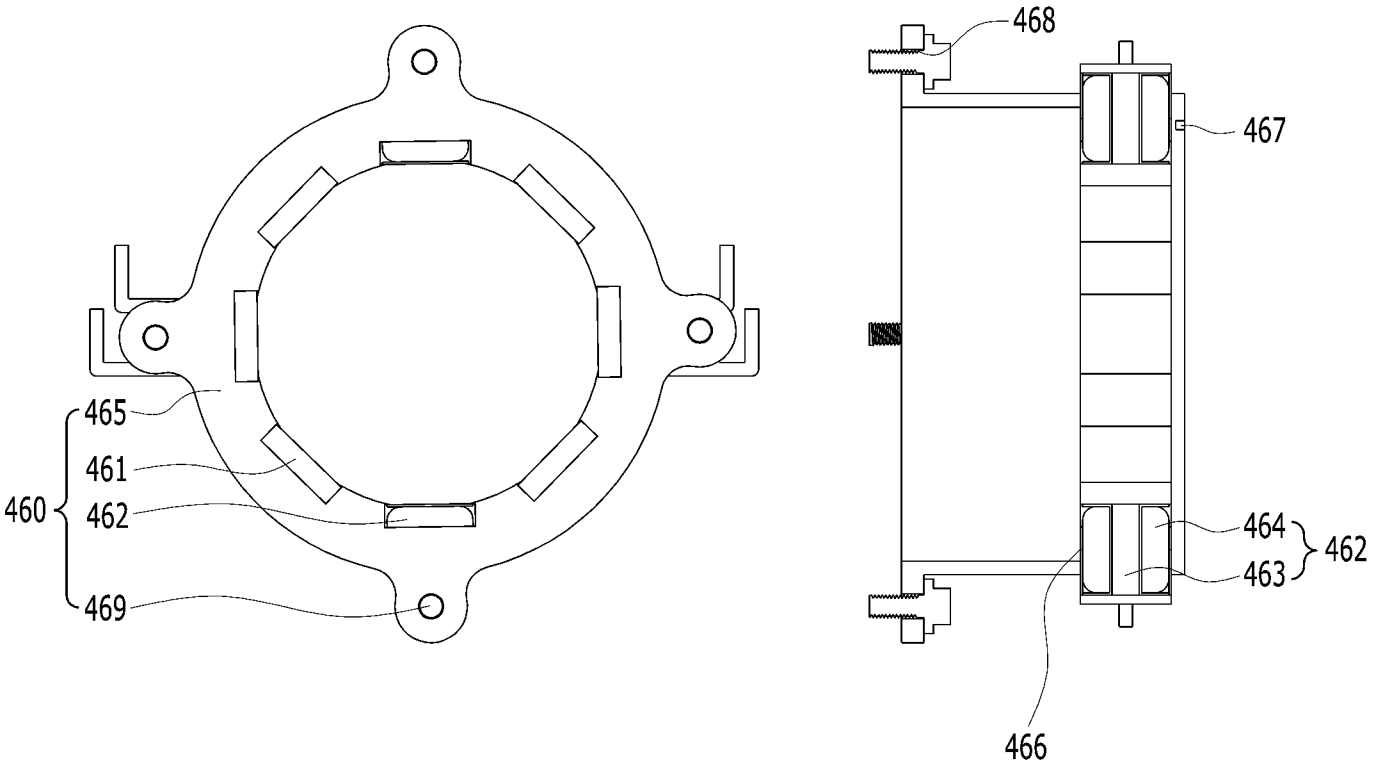
FIGS. 11 and 12 are perspective views illustrating a rear driver of the fixing support according to a second embodiment of the present invention.
Figure 12:
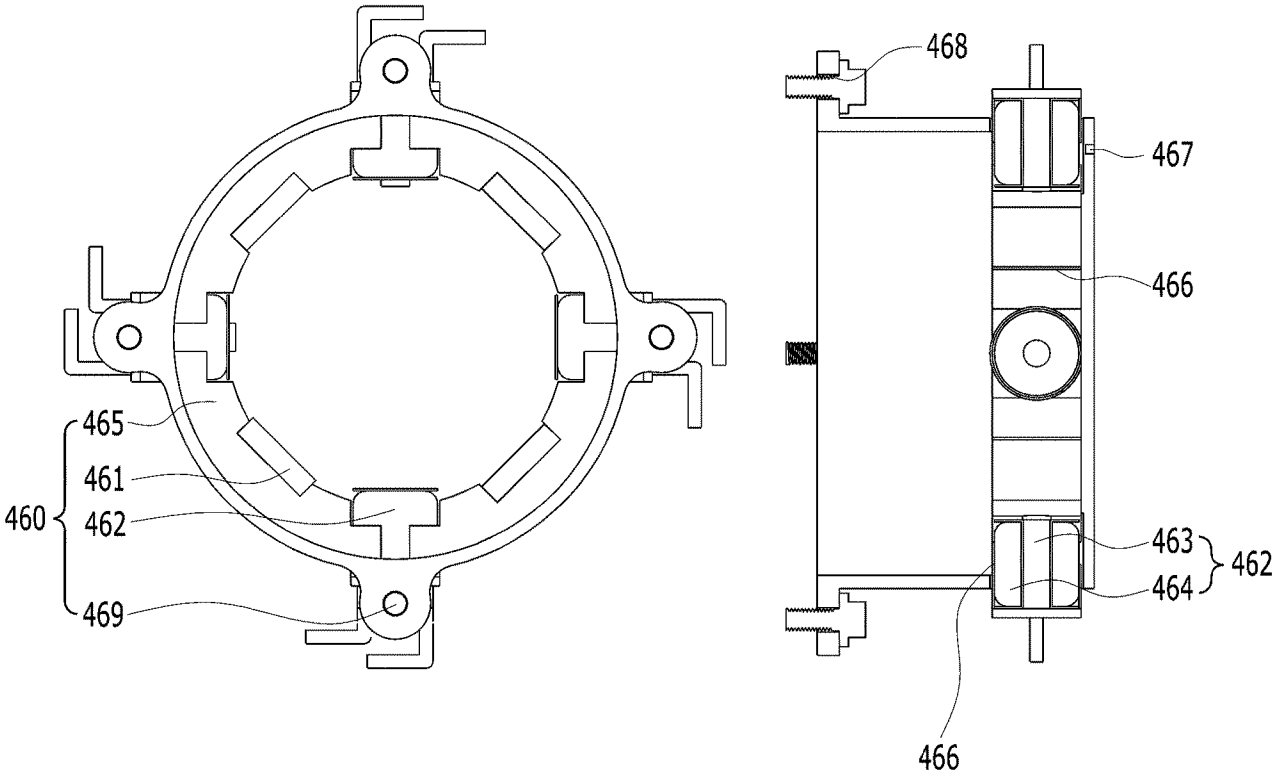

As shown in FIGS. 10 and 23, in a fuel cell vehicle configured in accordance with the second embodiment 020, the rotating body accelerator 202 may be mounted between the air filter and the fuel cell of the fuel cell driving device, and may form a magnetic torque with power supplied from the power supply unit of the vehicle in according with the instruction of the vehicle, thereby operating the impeller 110 and thus compressing air to supply air to the fuel cell of the fuel cell driving device.

Thus, the rotating body accelerator 202 may generate a torque from an interaction of the rear rotator 340 and the permanent magnets 461 and the driver coils 462 of the rear driver 460 of the fixing support or the driver coils 462 using power supplied from the power supply unit of a vehicle. Thus, the rotating body accelerator 202 may operate the complex rotating body 301 and the impeller 110 to compress air and thus increase the air density and flow rate, and thus may supply necessary air volume flow. Also, the rotating body accelerator 202 may increase the amount of power from the power supply unit in accordance with the instruction of a vehicle, and may increase the intensity of the magnetic field of the driver coils 462 of the rear driver 460 of the fixing support using supplied power, thereby increasing the torque of the rotating body accelerator 202 and thus supplying more air volume flow. Accordingly, without giving a load to a vehicle, the driving loss and the driving noise may become lower, and the durability may become better. Also, power consumption may be reduced compared to the electric air compressor.

The power supply unit may supply direct current power to the rear driver 460 of the fixing support including the permanent magnets 461 and the driver coils 462, generating a magnetic field and thus causing an interaction with the rear rotator 340, or may supply direct current power to the rear driver 460 of the fixing support including the driver coils 462, or may supply three-phase alternating current power through 3-phase connection, allowing the driver coils 462 to generate a magnetic field at a phase angle of about 120 degrees and interact.

In order to supply a large amount of compressed air to an air supply system of the fuel cell driving device, a driving force necessary therefor may be needed. Accordingly, permanent magnets may be applied to the rotating body accelerator 201 to increase the driving capacity, or the contact area of the magnetic field of permanent magnets and the mounting diameter pitch of permanent magnets may be increased to enhance the driving force. Also, the gap between permanent magnets may be adjusted, or the present invention 020 may be applied in plurality to sequentially supply air volume flow in accordance with the power generation amount of the fuel cell driving device.

For this, when a vehicle starts up, the power supply unit, the supply power source of which is a power source of the vehicle, may recognize the startup of the vehicle, and may supply DC power or three-phase AC power to the rotating body accelerator 202 to maintain the driving state and receive a signal of the vehicle. Thus, the amount of power according to a designated driving region may be increased and supplied by a pre-inputted operation formula.

The present invention provides an air charging apparatus including an impeller, an impeller case, and a rotating body accelerator, which is mounted between an air filter and an intake pipe of an internal combustion engine in a vehicle having durability to supercharging and drives the impeller by forming a magnetic torque by interaction with intake negative pressure varying with the load of the internal combustion engine. Here, air volume flow corresponding to the characteristics of the internal combustion engine and the vehicle having durability to supercharging is supplied to increase the volumetric efficiency of the internal combustion engine by being mounted between an air filter and an inlet pipe of the internal combustion engine to compressing or pressurizing air and thus increase the air density and flow rate. In a low-speed driving region and transient section, the torque is increased to shorten the spool-up time and thus improve the response characteristic of a vehicle. In order to increase a deficient super pressure supplied by an existing supercharger in a low-speed region, the fuel consumption of the internal combustion engine is reduced. Also, the load of the internal combustion engine operated in order to maintain the super pressure at a high level in a high-speed driving region is reduced. Thus, the air supply device corresponding to the internal combustion engine having high specific power according to the carbon emission regulation and the downsizing trend of a vehicle is achieved. Without giving a load to a vehicle and an internal combustion engine, the temperature of supplied air becomes lower and the air density becomes relatively higher compared to an existing supercharger. In such air supply device, the driving loss and driving noise become lower, and the durability becomes better. Also, the air supply device uses low power or does not need the driving cost, and can be easily installed without limitations of a specific location and a mounting direction.

Also, in the rotating body accelerator, the rear driver of the fixing support interworks with the absorption negative force varying with the load of the internal combustion engine including permanent magnets and coils or coils and generates a magnetic torque with power supplied from the power supply unit in accordance with the instruction of a vehicle to drive the impeller, Thus, the present invention increases the volumetric efficiency by compressing or pressurizing air to increase the air density and flow rate and thus supplying air volume flow corresponding to the characteristics of an internal combustion engine and a vehicle, improves the response characteristics of a vehicle by increasing a torque in a low-speed driving region and a transient section and thus shortening the spool-up time, and additionally improves the volumetric efficiency by increasing the driving force in accordance with an instruction of a vehicle in a specific driving region and thus supplying compressed air having a high pressure ratio or pressurized air having a high pressurization ratio and increased air volume flow.

Also, in the rotating body accelerator, permanent magnets are disposed in the axial diameter direction to the rear rotator of the complex rotating body to increase the contact area of the permanent magnets and thus increase the driving force. Also, the rear driver of the fixing support interworks with the absorption negative force varying with the load of the internal combustion engine including permanent magnets and coils or coils and generates a magnetic torque with power supplied from the power supply unit in accordance with the instruction of a vehicle to drive the impeller, Thus, the present invention increases the volumetric efficiency by compressing or pressurizing air to increase the air density and flow rate and thus supplying air volume flow corresponding to the characteristics of an internal combustion engine and a vehicle, and improves the response characteristics of a vehicle by increasing a torque in a low-speed driving region and a transient section and thus shortening the spool-up time.

Also, by burying the permanent magnets or magnetic coating onto the circular rear surface of the impeller and thus assigning a rotation acceleration function, and reducing the inertia moment of the complex rotating body to increase the response characteristics with the respect to the load variation in the rotating body accelerator, the rotating body accelerator generates a magnetic force by interaction with the intake negative pressure varying with the load of the internal combustion engine, and drives the impeller, compressing air to increase the air density and flow rate and thus supplying air volume flow corresponding to the characteristics of an internal combustion engine and a vehicle, and improves the response characteristics of a vehicle by increasing a torque in a low-speed driving region and a transient section and thus shortening the spool-up time.

Also, in the rotating body accelerator, a front driving device is added, and thus the contact area of the permanent magnets is broadened, increasing the driving force. Thus, by interaction with the intake negative pressure varying with the load of the internal combustion engine, the rotating body accelerator generates a magnetic force to drive the impeller, compressing or pressurizing air to increase the air density and flow rate and thus supplying air volume flow corresponding to the characteristics of an internal combustion engine and a vehicle, and improves the response characteristics of a vehicle by increasing a torque and thus shortening the spool-up time in a low-speed driving region and a transient section.

Also, in the rotating body accelerator, a relay module is added, and the rear driver of the fixing support includes armature coils, Thus, by interaction with the intake negative pressure varying with the load of the internal combustion engine, the rotating body accelerator generates a magnetic force to drive the impeller, compressing or pressurizing air to increase the air density and flow rate and thus supplying air volume flow corresponding to the characteristics of an internal combustion engine and a vehicle, and improves the response characteristics of a vehicle by increasing a torque and thus shortening the spool-up time in a low-speed driving region and a transient section. Simultaneously, the rear driver of the fixing support generates power, and the relay module supplies power within a power range effective for charging of the storage battery, minimizing the power generation load charging the storage battery of the vehicle. Thus, the power consumption for power generation is reduced, or the power generation cost consumed for charging a separate storage battery used in external power consuming devices is saved.

Also, the rotating body accelerator includes one of the front rotator and the rear rotator of the complex rotating body, allowing the manufacturing of various air supply units corresponding to the characteristics of various internal combustion engines and vehicles. Thus, by interaction with the intake negative pressure varying with the load of the internal combustion engine, the rotating body accelerator generates a magnetic force to drive the impeller, compressing or pressurizing air to increase the air density and flow rate and thus supplying air volume flow corresponding to the characteristics of an internal combustion engine and a vehicle, and improves the response characteristics of a vehicle by increasing a torque and thus shortening the spool-up time in a low-speed driving region and a transient section.

The present invention also provides an air charging apparatus including an integral air filter case and driving an impeller by generating a magnetic force by interaction with intake negative pressure varying with the load of an internal combustion engine. Thus, the air charging apparatus increases the volumetric efficiency by being mounted in an air filter case and compressing or pressurizing air to increase the air density and flow rate and thus supplying air volume flow corresponding to the characteristics of an internal combustion engine and a vehicle, improves the response characteristics of a vehicle by increasing a torque in a low-speed driving region and a transient section and thus shortening the spool-up time, cools generated heat with external air flowing therein, absorbs noise to reduce driving sound, reduces the mounting space to facilitate the mounting in a vehicle, and particularly, secures the mounting space with respect to an existing vehicle in which the arrangement of parts of the internal combustion engine mounting chamber is determined.

Also, in a natural aspirated vehicle and a motor cycle, the present invention provides an air charging apparatus which is mounted between an air filter and an air pipe of an internal combustion engine, supplies air volume flow corresponding to the characteristics of the natural aspirated vehicle and the motor cycle by compressing air or pressurizing air and thus increasing the air density and flow rate by generating a magnetic torque by the rotating body accelerator by interaction with intake negative pressure varying with the load of the internal combustion engine and thus driving the impeller within an error correction range of the driving system and the control system while maintaining the advantages of the natural aspirated vehicle and the motor cycle, increases the volumetric efficiency, deals with the carbon emission regulation by reducing the fuel consumption of the internal combustion engine, and improves the acceleration force in the transient section. Thus, without giving a load to the vehicle and the internal combustion engine, the driving loss and driving noise are lower, and the durability is better. Also, the air supply device uses low power or does not need the driving cost, and can be easily installed without limitations of a specific location and a mounting direction.

Also, in a fuel cell vehicle, the present invention provides an air charging apparatus, which is mounted between an air filter and a fuel cell of a fuel cell driving device, generates a magnetic torque by the rotating body accelerator using supplied power to drive the impeller, supplies air volume flow necessary for a fuel cell of a fuel cell driving device by receiving power in a fuel cell vehicle and compressing air in accordance with the instruction of a vehicle, and is better in driving loss, driving noise, and durability. Also, the air charging apparatus is operated at lower power.

Air charging apparatuses according to the embodiments of the present invention may be used as air supply units that supply compressed air or pressurized air to the internal combustion engine and the fuel cell driving devices for vehicles, industries, and houses, and particularly, may be used as air supply units of the internal combustion engine for vehicles.

The above-disclosed subject matter is to be considered illustrative and not restrictive, and the appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. An air charging apparatus driven by a rotating magnetic field, the apparatus comprising:

an impeller disposed inside an impeller case and sucking air and compressing the air during operation;

a frame having one end that is secured to the impeller case and is in a spaced apart relationship with the impeller case, the frame supporting a rotational shaft secured to the impeller;

a fixing support secured to another end of the frame;

a front rotator secured to the rotational shaft and disposed between the impeller case and the frame and being in a spaced-apart relationship with both the impeller case and the frame, the front rotator including a plurality of permanent magnets arranged along a circumferential direction with alternating polarity;

a rear rotator secured to the rotational shaft and disposed between the frame and the fixing support and being in a spaced-apart relationship with both the frame and the fixing support, the rear rotator including a plurality of permanent magnets arranged along a circumferential direction with alternating polarity;

a front driver having a plurality of permanent magnets that are disposed in a plurality of holes in a first surface of the frame, the first surface facing the front rotator so that the plurality of permanent magnets of the front driver interacts with the plurality of the permanent magnets of the front rotator;

a rear driver having a plurality of permanent magnets that are disposed in a plurality of holes in a second surface of the frame, the second surface facing the rear rotator so that the plurality of permanent magnets of the rear driver interacts with the plurality of the permanent magnets of the rear rotator; and a rear driver of the fixing support having a plurality of permanent magnets that is disposed on the fixing support and faces the rear rotator so that the plurality of permanent magnets of the rear driver of the fixing support interacts with the plurality of the permanent magnets of the rear rotator.

2. The air charging apparatus of claim 1, further comprising:

a bearing module supporting rotation of the impeller, the front rotator, and the rear rotator;

wherein a plurality of fixtures that secures the impeller, the front rotator, and the rear rotator to the bearing module is located inside the frame.

3. The air charging apparatus of claim 2, wherein the bearing module comprises:

the rotational shaft comprising:

a body having a circular bar shape;

a bearing mounting surface, a bearing fixing step, and a key groove formed on an outer circumferential surface of the body; and screw threads formed at both ends of the body;

a bearing comprising any one of a grease lubrication type bearing, an oil lubrication bearing, an air cooling bearing, and a magnetic bearing; and keys fixing the front rotator and the rear rotator to the rotational shaft.

4. The air charging apparatus of claim 1, wherein the front rotator comprises:

a front rotational plate;

wherein the plurality of permanent magnets of the front rotator comprises 2n (n is an integer greater than 2) permanent magnets disposed in the front rotational plate.

5. The air charging apparatus of claim 1, wherein the rear rotator comprises:

a rear rotational plate;

wherein the plurality of permanent magnets of the rear rotator comprises 2n (n is an integer greater than 2) permanent magnets disposed in the rear rotational plate.

6. The air charging apparatus of claim 1, wherein the plurality of permanent magnets of the front driver comprises 2n (n is an integer equal to or greater than 4) permanent magnets.

7. The air charging apparatus of claim 1, wherein the plurality of permanent magnets of the rear driver comprises 2n (n is an integer equal to or greater than 4) permanent magnets.

* * * * *